US005629117A

United States Patent [19]

Katsukawa et al.

[11] Patent Number: 5,629,117

[45] Date of Patent: May 13, 1997

[54] ELECTROPHOTOSENSITIVE MATERIAL

[75] Inventors: Masato Katsukawa; Masashi Tanaka; Ichiro Yamazato; Yuka Nakamura, all of Osaka, Japan

[73] Assignee: Mita Industrial Co., Ltd., Osaka, Japan

[21] Appl. No.: 542,460

[22] Filed: Oct. 12, 1995

[30] Foreign Application Priority Data

Oct. 21, 1994 [JP] Japan ..... 6-282670

[51] Int. Cl.[6] ..... G03G 5/04

[52] U.S. Cl. ..... 430/83; 430/96

[58] Field of Search ..... 430/96, 59, 58, 430/83

[56] References Cited

U.S. PATENT DOCUMENTS

| | | | |
|---|---|---|---|
| 5,403,958 | 4/1995 | Morishita et al. | 430/59 |
| 5,486,439 | 1/1996 | Sakakibara et al. | 430/59 |
| 5,494,765 | 2/1996 | Fukami et al. | 430/59 |
| 5,494,766 | 2/1996 | Dohi et al. | 430/59 |

FOREIGN PATENT DOCUMENTS

| | | |
|---|---|---|
| 0420207 | 4/1991 | European Pat. Off. . |
| 0455247 | 5/1991 | European Pat. Off. . |
| 0455247 | 11/1991 | European Pat. Off. . |
| 0475676 | 3/1992 | European Pat. Off. . |

OTHER PUBLICATIONS

Journal of Applied Physics, vol. 70, No. 2, Jul. 15, 1991, Yamaguchi et al., pp. 855–859.

*Primary Examiner*—John Goodrow

*Attorney, Agent, or Firm*—Beveridge, DeGrandi, Weilacher & Young, L.L.P.

[57] ABSTRACT

There is disclosed an electrophotosensitive material using a binding resin of a bisphenol C type, bisphenol Z type, bisphenol Z type containing a substituent or bisphenol C-copolymer type polycarbonate in combination with a hole transferring material of a specific benzidine or phenylenediamine derivative. This photosensitive material is superior in mechanical strength and repeat characteristics and has a high glass transition temperature and a high sensitivity.

9 Claims, No Drawings

ELECTROPHOTOSENSITIVE MATERIAL

BACKGROUND OF THE INVENTION

The present invention relates to an electrophotosensitive material which is used for image forming apparatuses such as copying apparatus, etc.

In the image forming apparatuses such as copying apparatus, etc., an organic photoconductor (OPC) having a sensitivity within the wavelength range of a light source of the apparatus has exclusively been used.

As the organic photoconductor, there have been known a single-layer type electrophotosensitive material having a single photosensitive layer wherein an electric charge generating material and an electric charge transferring material are dispersed in a membrane of a suitable binding resin, and a multi-layer type electrophotosensitive material comprising an electric charge generating layer containing an electric charge generating material and an electric charge transferring layer wherein an electric charge transferring material is dispersed in a membrane of a binding resin, both layers being mutually laminated.

Examples of the electric charge generating material include phthalocyanine pigments, bisazo pigments, perylene pigments, etc.

Furthermore, examples of the electric charge transferring material include various hole transferring materials such as carbazole compounds, carbazole-hydrazone compounds, oxadiazole compounds, pyrazoline compounds, hydrazone compounds, stilbene compounds, phenylenediamine compounds, benzidine compounds, etc.

Furthermore, as the binding resin, a bisphenol A type polycarbonate having an excellent mechanical strength has hitherto been used. However, the bisphenol A type polycarbonate is liable to cause gelation because of its high crystallizability and is also insufficient in mechanical strength.

Therefore, there has recently been suggested various polycarbonates, e.g. bisphenol C type polycarbonate, bisphenol Z type polycarbonate, bisphenol Z type polycarbonate having a substituent, etc., which are superior to the bisphenol A type polycarbonate in mechanical strength, bisphenol C-copolymer type polycarbonate, etc. as the binding resin of the photoconductor (e.g. Japanese Unexamined Patent Publication Nos. 53-148263 and 1-273046).

However, when these novel polycarbonates are used for the formulation of a conventional photoconductor as they are, the mechanical strength of the photoconductor is improved but the sensitivity is deteriorated. In addition, the above photoconductor also has a problem that the sensitivity is considerably deteriorated when the image is formed repeatedly formed and so-called repeat characteristics are inferior. Furthermore, when the above novel polycarbonates are used, the mechanical strength of the photoconductor is improved but the degree of the improvement is insufficient. Such a photoconductor is also insufficient in durability and heat resistance because of its low glass transition temperature

SUMMARY OF THE INVENTION

A main object of the present invention is to provide an electrophotosensitive material which is superior in mechanical strength and repeat characteristics and has a high glass transition temperature and a high sensitivity.

In order to solve the above problem, the present inventors have studied intensively about electric charge generating materials and hole transferring materials to be used in combination with the polycarbonates mentioned above.

As a result, it has been found that, in a single photosensitive layer of the single-layer type photosensitive layer or an electric charge transferring layer of a multi-layer type photosensitive material, physical properties of the hole transferring material to be added in large amount (i.e. almost the same amount as that of the polycarbonate in weight ratio) and an affinity between the hole transferring material and polycarbonate have a significant influence on the above respective characteristics.

For example, when the affinity between the polycarbonate and hole transferring material is inferior, the hole transferring material is not uniformly dispersed in the photosensitive layer even if the hole transferring material itself is superior in electric charge transferring properties. Therefore, the electric charge transferring properties of the photosensitive layer become insufficient, which results in deterioration of the sensitivity of the photosensitive material. Furthermore, when the electric charge transferring properties of the photosensitive material are deteriorated, deterioration of the sensitivity at the time of repeating formation of the image becomes larger as the residual potential increases, which results in deterioration of the repeat characteristics.

Furthermore, the mechanical strength of the photosensitive material is maintained by entanglement of main chains of the polycarbonate. When a large amount of the hole transferring material, which is uncongenial to the polycarbonate, is contained in the photosensitive layer, entanglement of main chains is inhibited and the sufficient mechanical strength can not be obtained.

Furthermore, since a large amount of the hole transferring material is blended as described above, the glass transition temperature of the whole layer becomes low if its melting point is low, which results in deterioration of durability and heat resistance of the photosensitive material.

Therefore, the present inventors have studied about the above hole transferring material which is superior in physical properties such as melting point, etc. and is conformable to the polycarbonate mentioned above. As a result, it has been found that six sorts of hole transferring materials, which comprises a benzidine derivative represented by the formula (6):

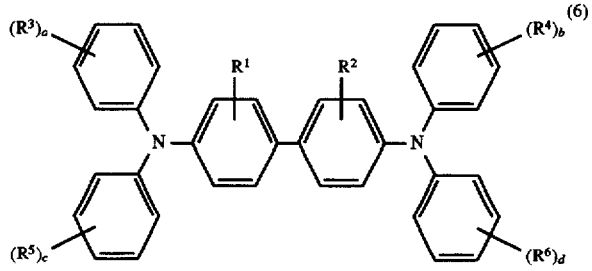

wherein $R^1$ and $R^2$ are the same or different and indicate a hydrogen atom or an alkyl group; $R^3$, $R^4$, $R^5$ and $R^6$ are the same or different and indicate an alkyl group, an alkoxy group or a halogen atom; and a, b, c and d are the same or different and indicate an integer of 0 to 5; provided that at least one of a, b, c and d indicates an integer of 2 or more, and c and d indicate an integer other than 0 when a and b indicate 0, simultaneously, a benzidine derivative represented by the formula (7):

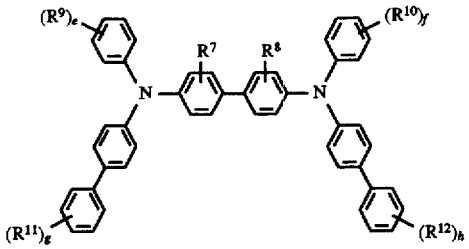

(7)

wherein $R^7$ and $R^8$ are the same or different and indicate a hydrogen atom or an alkyl group; $R^9$ and $R^{10}$ are the same or different and indicate an alkyl group, an alkoxy group, an aryl group which may have a substituent, or a halogen atom; $R^{11}$ and $R^{12}$ are the same or different and indicate an alkyl group, an alkoxy group or a halogen atom; and e, f, g and h are the same or different and indicate an integer of 0 to 5, a benzidine derivative represented by the formula (8):

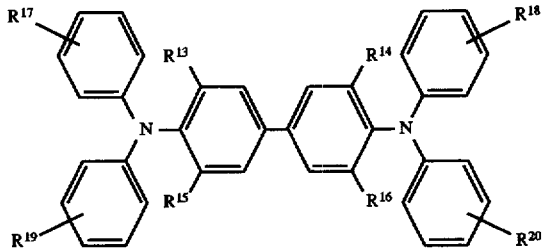

(8)

wherein $R^{13}$, $R^{14}$, $R^{15}$ and $R^{16}$ are the same or different and indicate an alkyl group; and $R^{17}$, $R^{18}$, $R^{19}$ and $R^{20}$ are the same or different and indicate a hydrogen atom, an alkyl group, an alkoxy group, an aryl group which may have a substituent, or a halogen atom, a benzidine derivative represented by the formula (9):

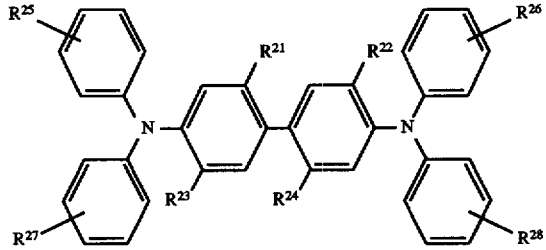

(9)

wherein $R^{21}$, $R^{22}$, $R^{23}$ and $R^{24}$ are the same or different and indicate an alkyl group; and $R^{25}$, $R^{26}$, $R^{27}$ and $R^{28}$ are the same or different and indicate a hydrogen atom, an alkyl group, an alkoxy group, an aryl group which may have a substituent, or a halogen atom, an o-phenylenediamine derivative represented by the formula (10):

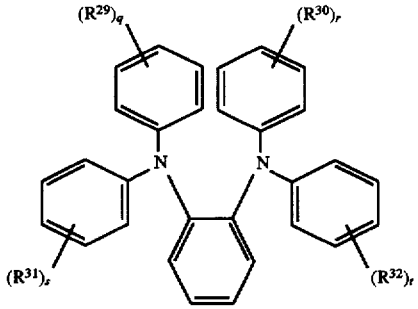

(10)

wherein $R^{29}$, $R^{30}$, $R^{31}$ and $R^{32}$ are the same or different and indicate an alkyl group, an alkoxy group, an aryl group which may have a substituent, or a halogen atom; and q, r, s and t are the same or different and indicate an integer of 1 to 2, and an m-phenylenediamine derivative represented by the formula (11):

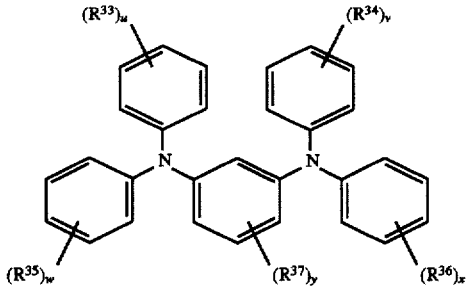

(11)

wherein $R^{33}$, $R^{34}$, $R^{35}$, $R^{36}$ and $R^{37}$ are the same or different and indicate an alkyl group, an alkoxy group, an aryl group which may have a substituent, a halogen atom, an amino group or a N-substituted amino group; u, v, w and x are the same or different and indicate an integer of 0 to 5; and y indicates an integer of 0 to 4, are suitable for the above conditions, thus the present invention has been accomplished.

That is, according to the electrophotosensitive material of the present invention, an organic photosensitive layer provided on a conductive substrate contains an electric charge generating material, at least one sort of the above six sorts of hole transferring materials and at least one of a bisphenol C type polycarbonate of the repeating unit represented by the formula (1):

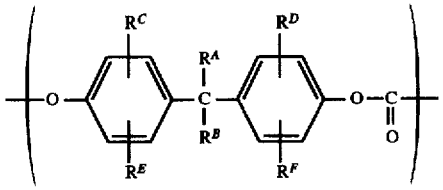

(1)

wherein $R^A$ and $R^B$ are the same or different and indicate a hydrogen atom or an alkyl group having 1 to 3 carbon atoms; $R^C$ and $R^D$ are the same or different and indicate an alkyl group having 1 to 3 carbon atoms; and $R^E$ and $R^F$ are the same or different and indicate a hydrogen atom, an alkyl group having 1 to 3 carbon atoms, or a halogen atom, a bisphenol Z type polycarbonate, which contains a substituent, of the repeating unit represented by the formula (2):

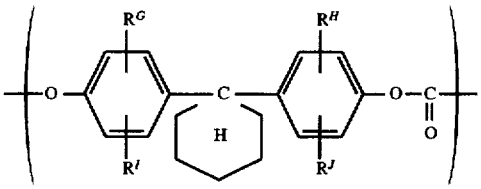

(2)

wherein $R^G$ and $R^H$ are the same or different and indicate an alkyl group having 1 to 3 carbon atoms; and $R^I$ and $R^J$ are the same or different and indicate a hydrogen atom, an alkyl group having 1 to 3 carbon atoms, or a halogen atom, a bisphenol Z type polycarbonate of a repeating unit represented by the formula (3)

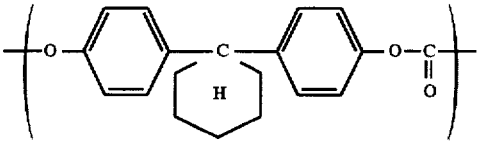

(3)

and a bisphenol C-copolymer type polycarbonate of two sorts of repeating units represented by the formula (4):

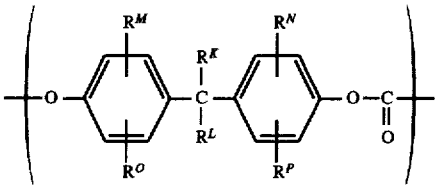

(4)

wherein $R^K$ and $R^L$ are the same or different and indicate a hydrogen atom or an alkyl group having 1 to 3 carbon atoms, and $R^K$ and $R^L$ may bond each other to form a ring; $R^M$ and $R^N$ are the same or different and indicate an alkyl group having 1 to 3 carbon atoms; and $R^O$ and $R^P$ are the same or different and indicate a hydrogen atom, an alkyl group having 1 to 3 carbon atoms, or a halogen atom and the formula (5):

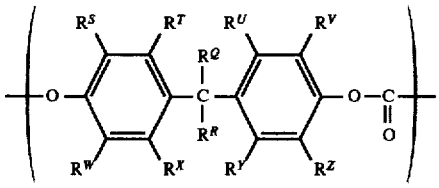

(5)

wherein $R^Q$ and $R^R$ are the same or different and indicate a hydrogen atom, an alkyl group having 1 to 3 carbon atoms, or an aryl group which may contain a substituent and $R^Q$ and $R^R$ may bond each other to form a ring; and $R^S$, $R^T$, $R^U$, $R^V$, $R^W$, $R^X$, $R^Y$ and $R^Z$ are the same or different and indicate a hydrogen atom, an alkyl group having 1 to 3 carbon atoms, or a halogen atom as the binding resin.

As described above, the above four sorts of polycarbonates to be used as the binding resin in the electrophotosensitive material of the present invention are superior to a conventional bisphenol A type polycarbonate represented by the formula (A):

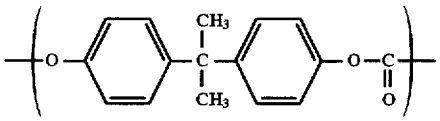

(A)

in mechanical strength.

On the other hand, the benzidine derivatives represented by the formulas (6) to (9), o-phenylenediamine derivative represented by the formula (10) and m-phenylenediamine derivative represented by the formula (11) to be used in combination with the above specific polycarbonate are superior in hole transferring properties and conformity, particularly compatibility with the above four sorts of polycarbonates. Therefore, they are uniformly dispersed in the photosensitive layer. In addition, all of the benzidine derivatives represented by the formulas (6) to (9) have a high melting point and, therefore, the glass transition temperature of the organic photosensitive layer can be increased. Furthermore, the o-phenylenediamine derivative represented by the formula (10) and m-phenylenediamine derivative represented by the formula (11) are superior in the above respective characteristics, and further the surface of the organic photosensitive layer is modified by adding any one of them to decrease a friction coefficient and to increase a loss modulus of the whole layer. Therefore, the wear resistance of the organic photosensitive layer can be improved.

DETAILED DESCRIPTION OF THE INVENTION

In the electrophotosensitive material of the present invention, examples of the alkyl group corresponding to any one of the groups $R^A$ to $R^Z$ in any one of the repeating units represented by the formulas (1), (2), (4) and (5), which constitutes the polycarbonate as the binding resin, include alkyl groups having 1 to 3 carbon atoms, such as methyl (Me), ethyl (Et), normal propyl (n-Pr), isopropyl (i-Pr), etc.

Examples of the halogen atom include chlorine, bromine, fluorine, iodine, etc.

In the repeating units represented by the formulas (4) and (5), examples of the ring to be formed by bonding the substituents $R^K$ and $R^L$ or $R^Q$ and $R^R$ together with a carbon atom of the main chain to which both substituents are bonded include rings having 3 to 7 carbon atoms, such as cyclopropane ring, cyclobutane ring, cyclopentane ring, cyclohexane ring, cycloheptane ring, etc.

In the repeating unit represented by the formula (5), examples of the aryl group corresponding to the substituents $R^Q$ and $R^R$ include phenyl group, o-terphenyl group, naphthyl group, anthryl group, phenanthryl group, etc. Furthermore, examples of the substituent with which the aryl group is substituted include alkyl group, alkoxy group, halogen atom, etc. The substituent can be substituted on any position of the aryl group.

Examples of the bisphenol C polycarbonate of the repeating unit represented by the formula (1) include those of the repeating units of the following formulas (1-1) to (1-5).

(1-1)

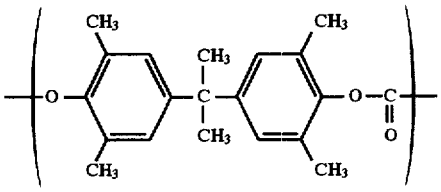

(1-2)

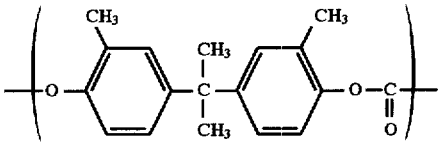

(1-3)

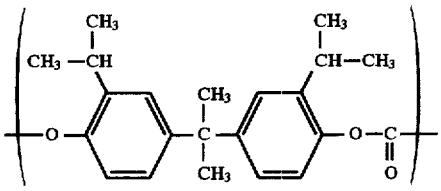

(1-4)

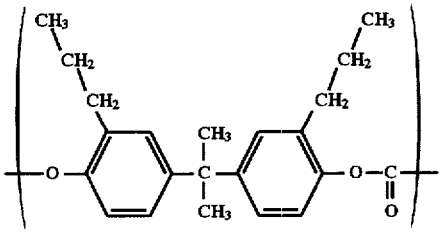

(1-5)

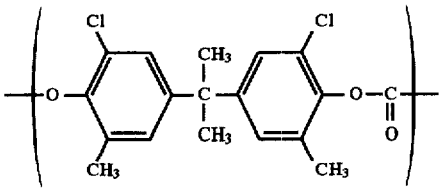

Examples of the bisphenol Z type polycarbonate of the repeating unit represented by the formula (2), which has a substituent, include those of the repeating units of the following formulas (2-1) to (2-5).

(2-1)

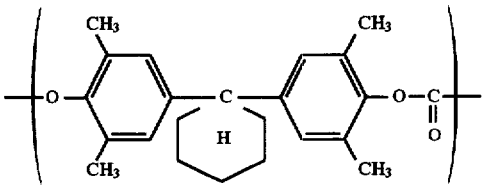

-continued (2-2)

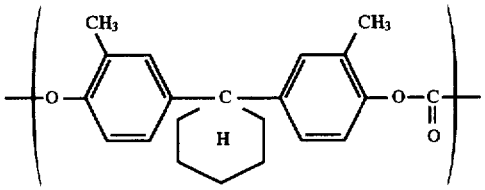

(2-3)

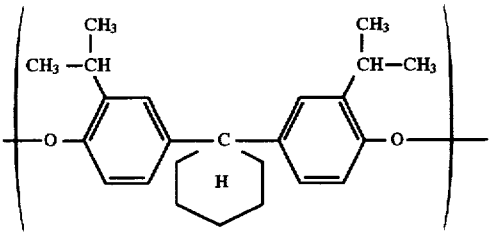

(2-4)

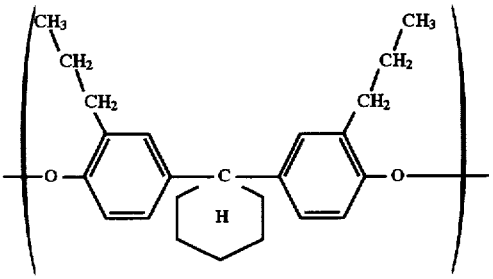

(2-5)

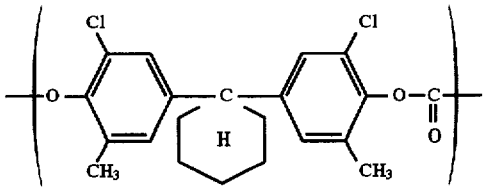

Examples of the bisphenol C-copolymer type polycarbonate comprising two sorts of repeating units represented by the formulas (4) and (5) include a random or block copolymer of the combination of two sorts represented by the following formulas (4,5-1) to (4,5-18). Incidentally, it is preferred that the composition ratio (molar ratio) of the repeating unit represented by the formula (4) to that represented by the formula (5) is within a range of about 9:1 to 3:7.

(4, 5-1)

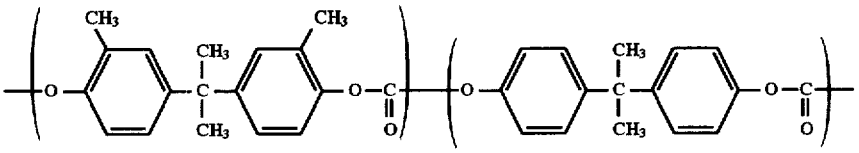

-continued
(4, 5-2)
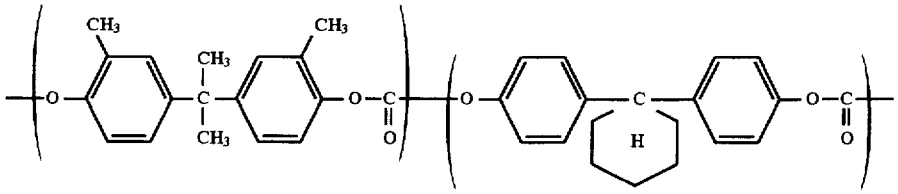
(4, 5-3)
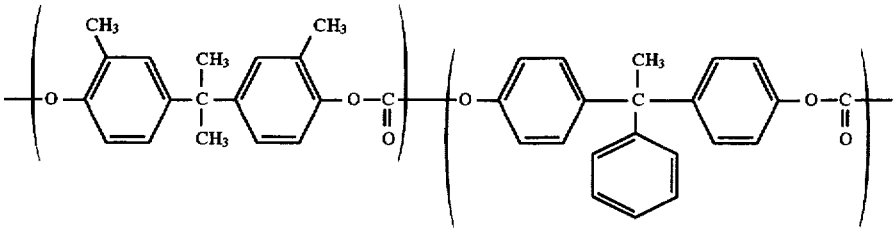
(4, 5-4)
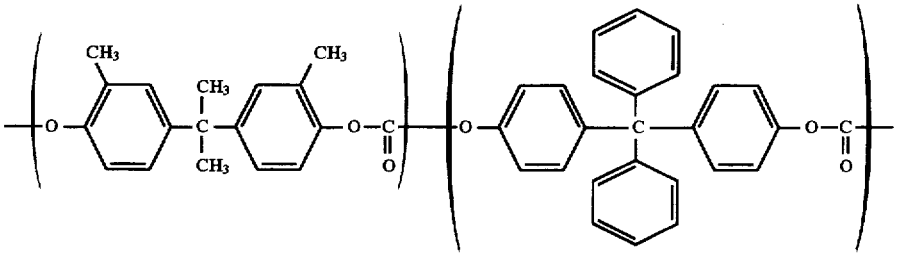
(4, 5-5)
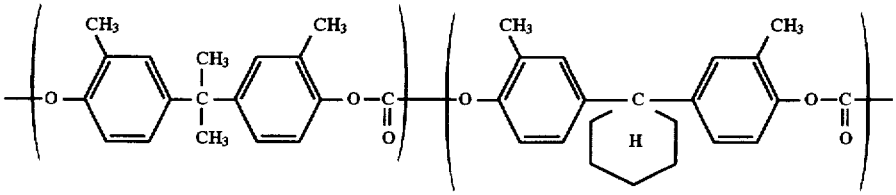
(4, 5-6)
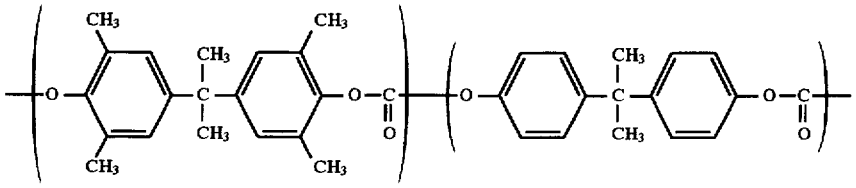
(4, 5-7)
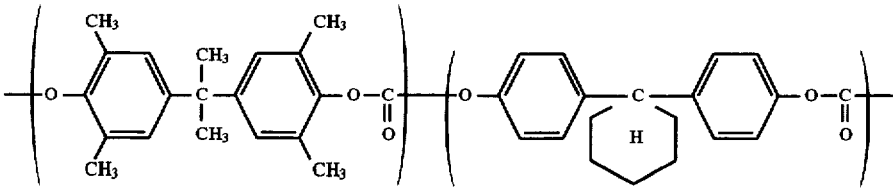
(4, 5-8)
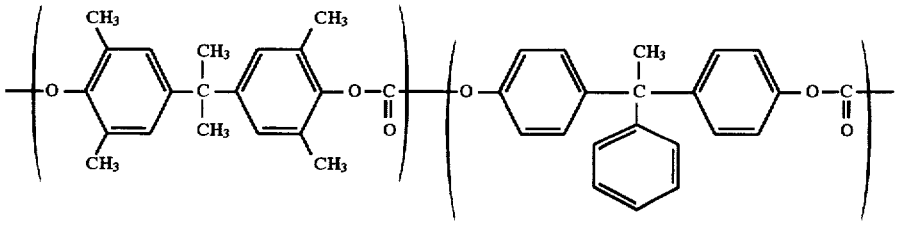

-continued
(4, 5-9)
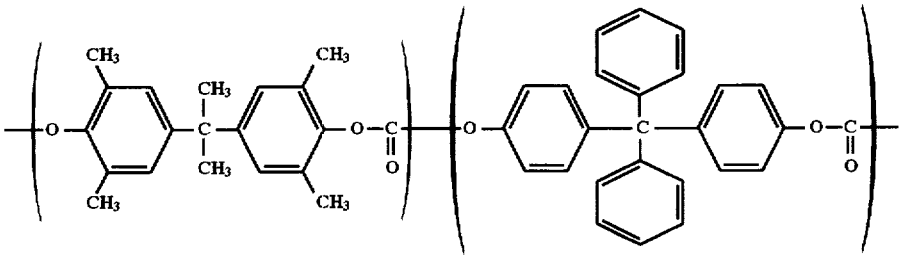
(4, 5-10)
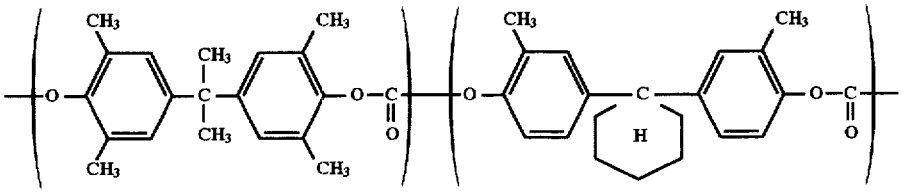
(4, 5-11)
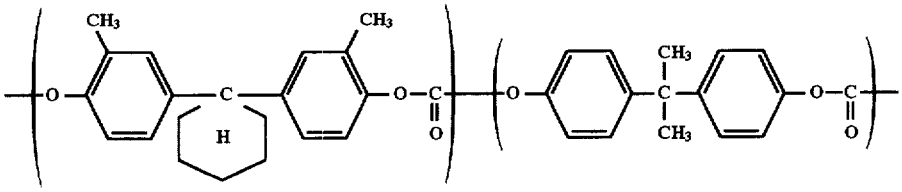
(4, 5-12)
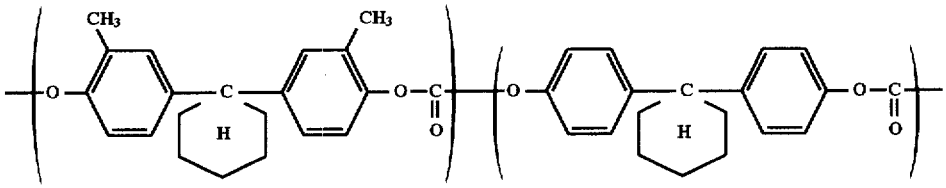
(4, 5-13)
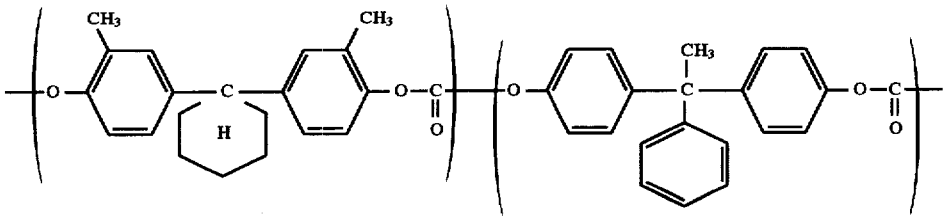
(4, 5-14)
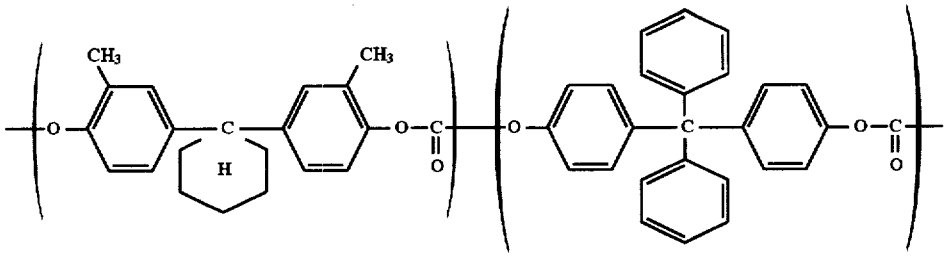
(4, 5-15)
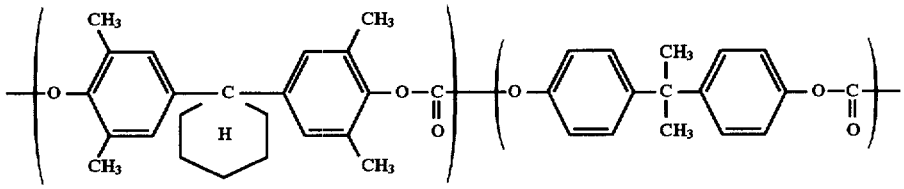

-continued

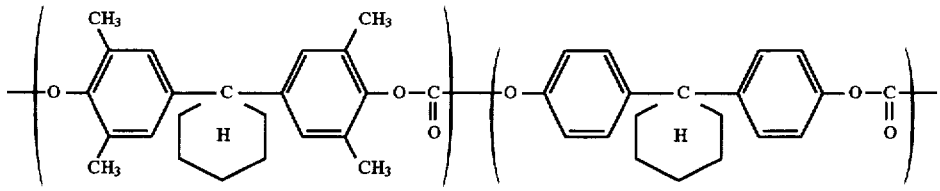

(4, 5-16)

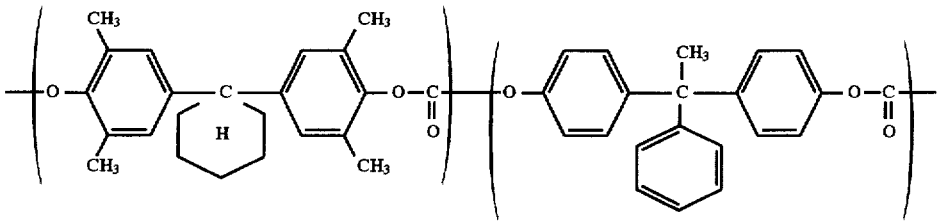

(4, 5-17)

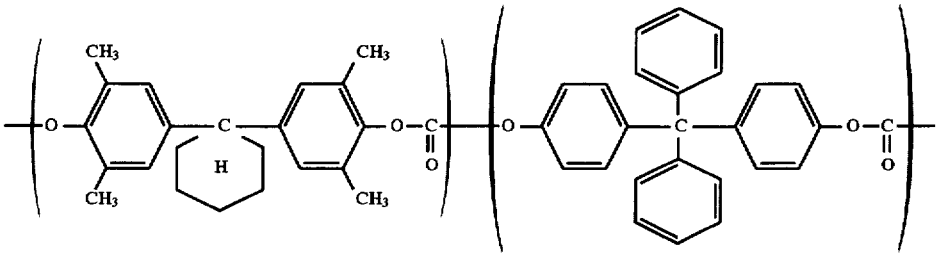

(4, 5-18)

It is preferred that the viscosity-average of the polycarbonates represented by the formulas (1), (2) and (3) and polycarbonate as the copolymer of the formulas (4) and (5) is within a range of about 20,000 to 50,000. When the molecular weight is lower than this range, mechanical characteristics such as wear resistance, etc. are not sufficient. On the other hand, when it exceeds the above range, the polycarbonate can not be dissolved in the solvent, and therefore it becomes difficult to prepare a coating solution for making a photosensitive layer.

These specific polycarbonates can be used alone or in combination thereof.

In the benzidine derivative represented by any one of the formulas (6) to (9), o-phenylenediamine derivative represented by the formula (10) and m-phenylenediamine derivative represented by the formula (11) to be contained in the organic photosensitive layer as the hole transferring material, together with the above specific polycarbonate, examples of the alkyl group corresponding to any one of the groups $R^1$ to $R^{36}$ include alkyl groups having 1 to 6 carbon atoms, such as normal butyl (n-Bu), isobutyl (i-Bu), secondary butyl (sec-Bu), tertiary butyl (tert-Bu), pentyl, hexyl, etc., in addition to the above alkyl groups having 1 to 3 carbon atoms.

Examples of the alkoxy group include alkoxy groups having 1 to 6 carbon atoms, such as methoxy group, ethoxy group, propoxy group, t-butoxy group, pentyloxy group, hexyloxy group, etc.

Examples of the aryl group and halogen group include the same groups as those described above.

Examples of the N-substituted amino group corresponding to the substituents $R^{33}$ to $R^{37}$ in the formula (11) include methylamino group, dimethylamino group, ethylamino group, diethylamino group, etc.

Regarding the benzidine derivative represented by the formula (6) among the above hole transferring materials, two or more groups such as alkyl group, alkoxy group or halogen atom are substituted on at least one of outer four phenyl groups. Since the derivative has a high melting point in comparison with a conventional benzidine derivative represented by the formula (B)

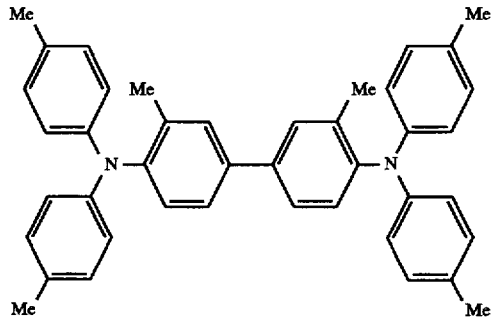

(B)

(see Japanese Patent Publication No. 5-210099), the glass transition temperature of the photosensitive layer can be improved by adding the derivative (6). Furthermore, the above benzidine derivative is superior in conformity, particularly compatibility with the specific polycarbonate. Among them, those in which an alkyl group having three or more carbon atoms is substituted on the phenyl group other than phenyl groups containing two or more substituents among outer four phenyl groups of the benzidine derivative are particularly superior in compatibility with the specific polycarbonate and are dispersed in the photosensitive layer, more uniformly.

Examples of the benzidine derivative represented by the formula (6) include compounds represented by the following formulas (6-1) to (6-5).

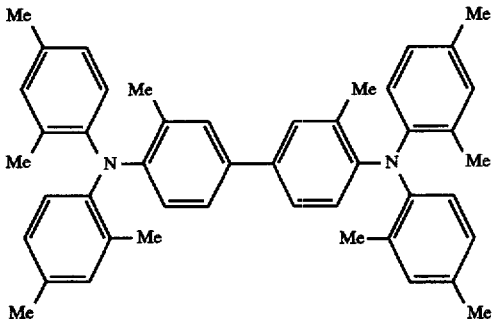
(6-1)

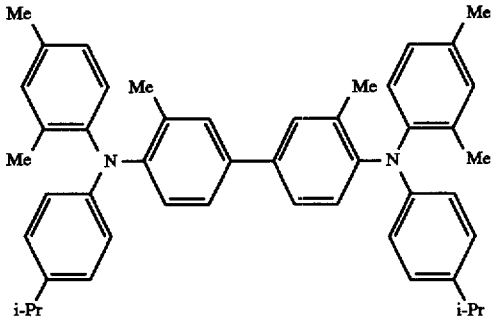
(6-2)

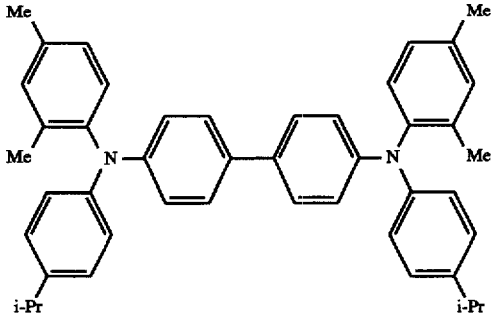
(6-3)

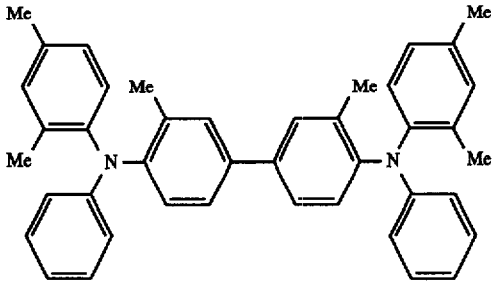
(6-4)

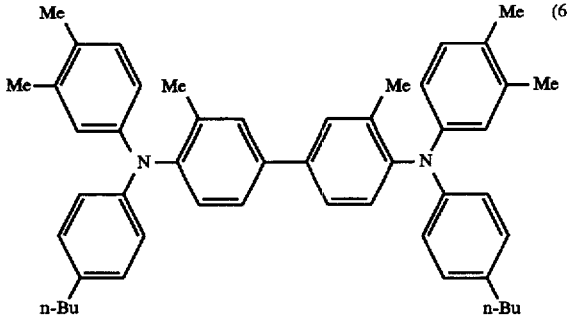
(6-5)

Regarding the benzidine derivative represented by the formula (7), aryl groups such as phenyl group are further substituted on at least two phenyl groups among outer four phenyl groups and the melting point is high in comparison with the conventional benzidine derivative represented by the formula (B) and, therefore, the glass transition temperature of the organic photosensitive layer can be improved by adding it. Furthermore, regarding the above benzidine derivative, spreading of the $\pi$ electron conjugate system is large in comparison with a conventional one and, therefore, the hole transferring properties are also improved. Furthermore, the above benzidine derivative is superior in conformity, particularly compatibility with the specific polycarbonate and, therefore, it is uniformly dispersed in the photosensitive layer.

Examples of the benzidine derivative represented by the formula (7) include compounds represented by the following formulas (7-1) to (7-7).

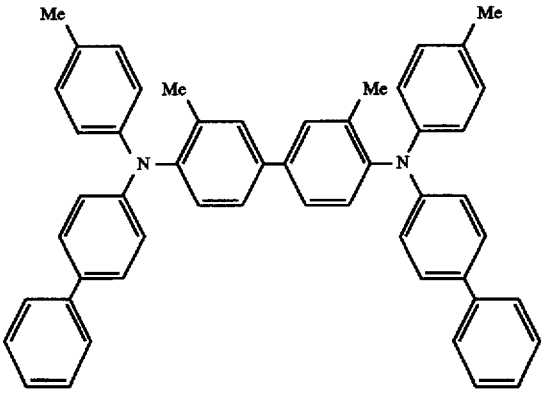
(7-1)

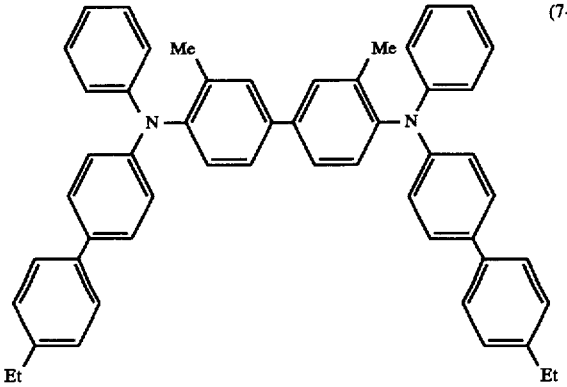
(7-2)

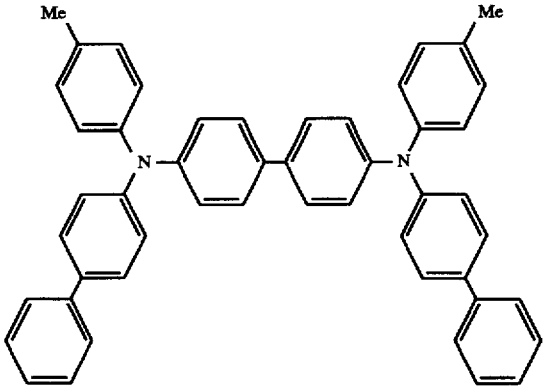
(7-3)

-continued (7-4)

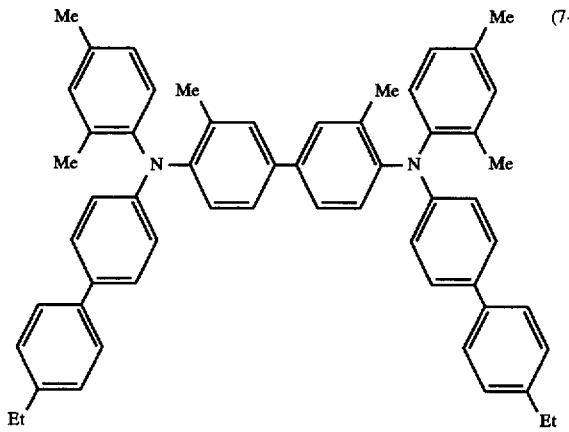

(7-5)

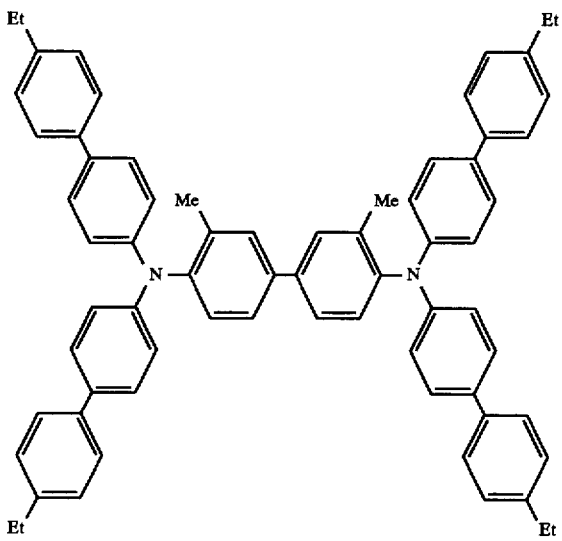

(7-6)

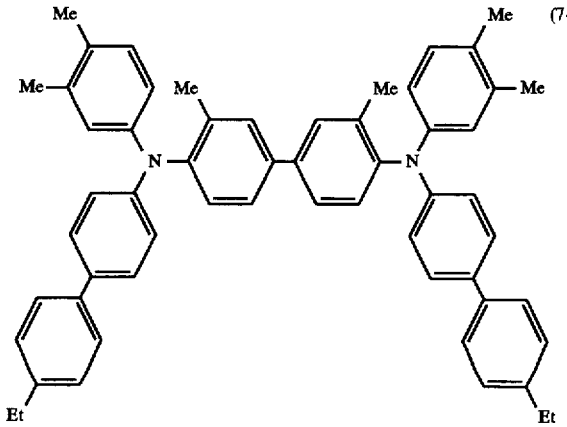

-continued (7-7)

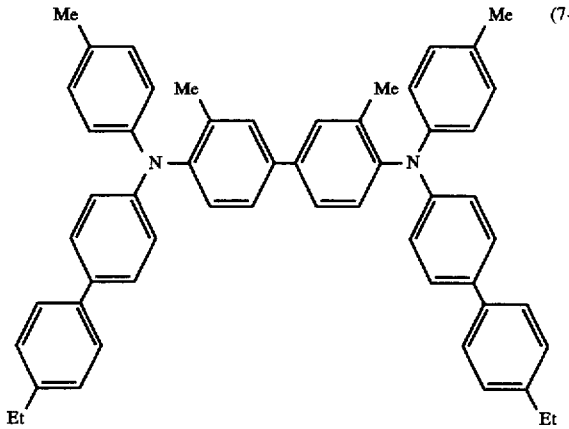

Regarding the benzidine derivative represented by the formula (8), four aryl groups are substituted on biphenyl being a center skeleton and the melting point is high in comparison with the conventional benzidine derivative represented by the formula (B) and, therefore, the glass transition temperature of the organic photosensitive layer can be improved by adding it. Among them, those in which aryl groups such as phenyl group are substituted on at least one of outer four phenyl groups have a higher melting point and, therefore, the glass transition temperature of the photosensitive layer can be further improved. Furthermore, the above benzidine derivative is superior in conformity, particularly compatibility with the specific polycarbonate and, therefore, it is uniformly dispersed in the photosensitive layer.

Examples of the benzidine derivative represented by the formula (8) include compounds represented by the following formulas (8-1) to (8-4).

(8-1)

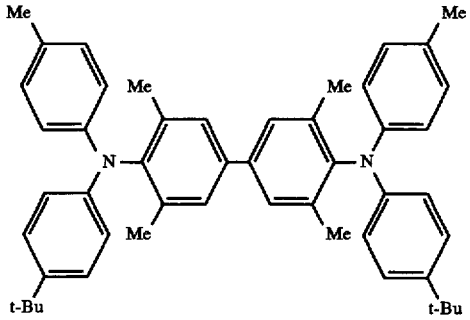

(8-2)

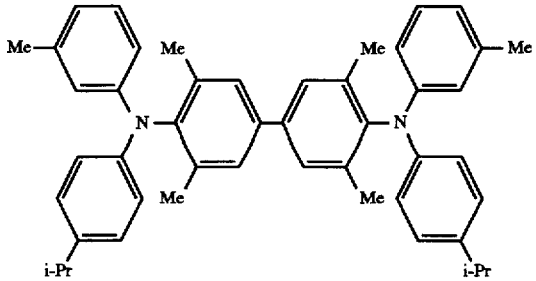

-continued

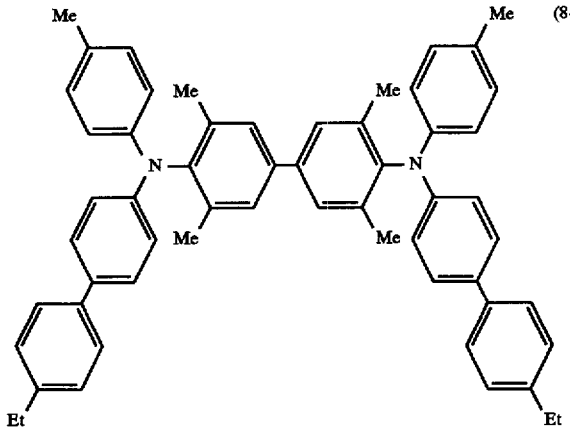

(8-3)

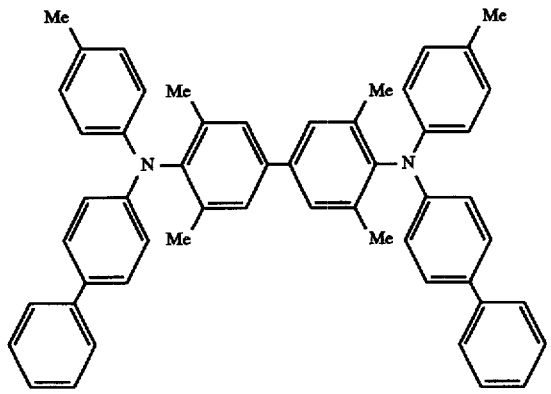

(8-4)

Regarding the benzidine derivative represented by the formula (9), four alkyl groups are substituted on biphenyl as its center skeleton, similarly, and the melting point is high in comparison with the conventional benzidine derivative represented by the formula (B) and, therefore, the glass transition temperature of the organic photosensitive layer can be improved. Furthermore, since the substitution positions of four alkyl groups are unsymmetrical, the benzidine derivative is superior to the benzidine derivative represented by the formula (8) in conformity, particularly compatibility with the specific polycarbonate and, therefore, it is dispersed in the photosensitive layer more uniformly.

Examples of the benzidine derivative represented by the formula (9) include compounds represented by the following formulas (9-1) to (9-4).

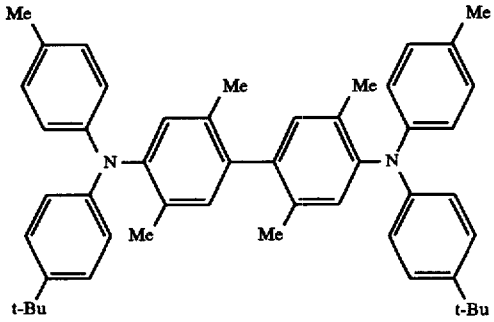

(9-1)

-continued

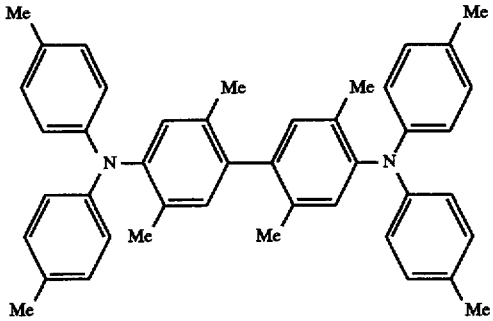

(9-2)

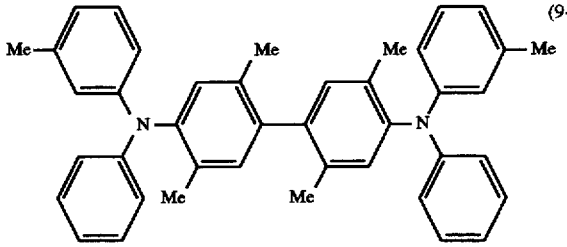

(9-3)

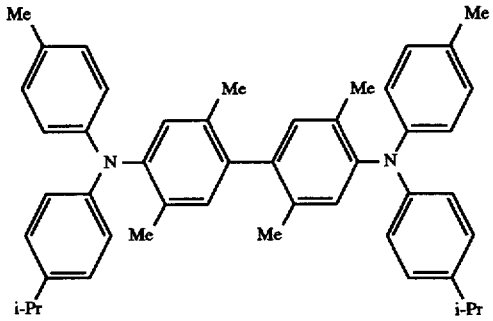

(9-4)

Regarding the o-phenylenediamine derivative represented by the formula (10) and m-phenylenediamine derivative represented by the formula (11), as described above, the surface of the organic photosensitive layer is modified to decrease the friction coefficient and to increase the loss modulus of the whole layer, by adding it. Therefore, the wear resistance of the organic photosensitive layer can be improved.

When two or more substituents or aryl groups such as phenyl group are substituted on at least one of outer four phenyl group of the above both phenylenediamine derivatives (10) and (11), the melting point is high and, therefore, the glass transition temperature of the organic photosensitive layer can be improved. Furthermore, when aryl groups are substituted on any one of outer four phenyl groups, spreading of the $\pi$ electron conjugate system is large and, therefore, the hole transferring properties are also improved.

Furthermore, the above both phenylenediamine derivatives (10) and (11) are superior in conformity, particularly compatibility with the specific polycarbonate, as described above. Among them, those in which the substitution position of the substituent to outer four phenyl groups is not the 3-position but 2-position of the phenyl group, or those in which alkyl groups having 3 or more carbon atoms are substituted on at least one of four phenyl groups are particularly superior in compatibility with the specific polycarbonate. Therefore, they are uniformly dispersed in the photosensitive layer.

Examples of the o-phenylenediamine derivative represented by the formula (10) include compounds represented by the following formulas (10-1) to (10-4).

(10-1)

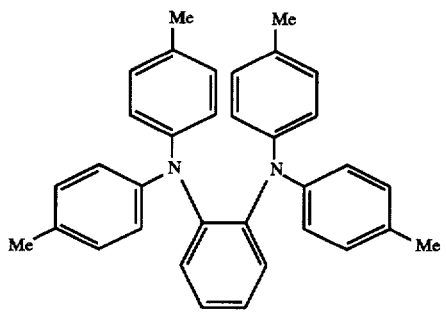

(10-2)

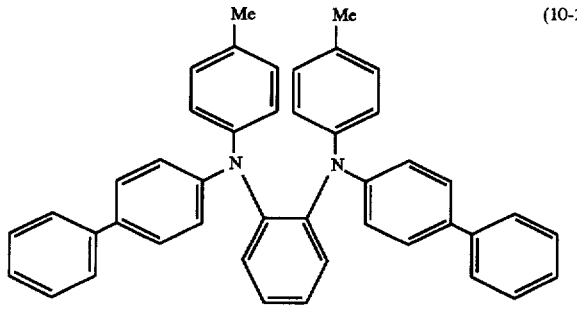

(10-3)

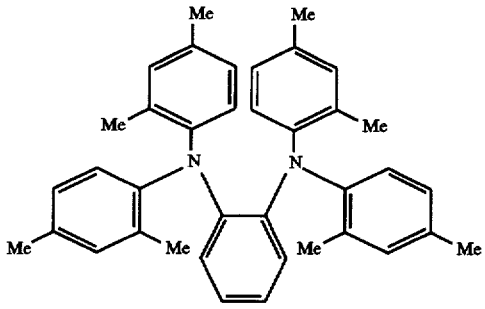

(10-4)

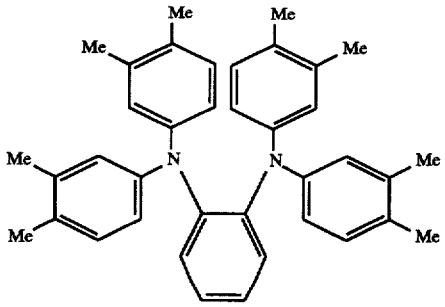

Examples of the m-phenylenediamine derivative represented by the formula (11) include compounds represented by the following formulas (11-1) to (11-5).

(11-1)

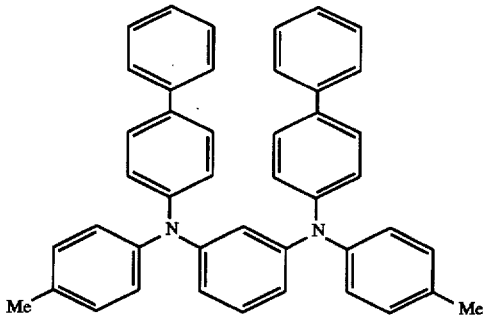

(11-2)

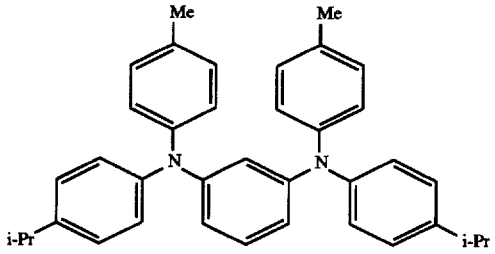

(11-3)

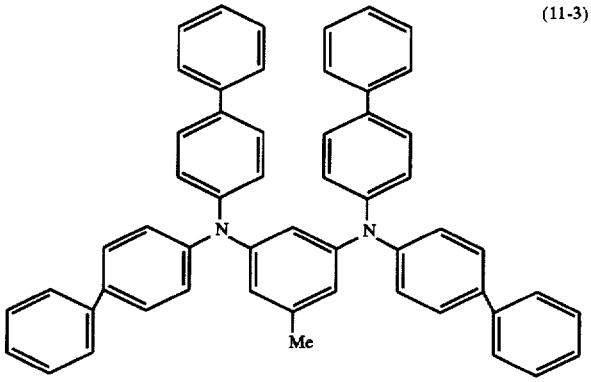

(11-4)

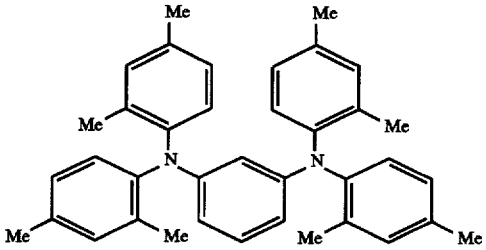

(11-5)

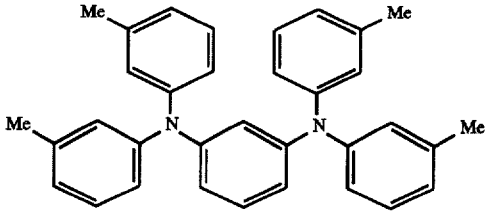

In the electrophotosensitive material of the present invention, the organic photosensitive layer to be formed on the conductive substrate includes the followings:

① single-layer type wherein the hole transferring material, the electric charge generating material and, if necessary, an electron transferring material are contained in the same layer of the above specific polycarbonate to be used as the binding resin, and ② multi-layer type comprising the electric charge transferring layer wherein the hole transferring material is contained in the specific polycarbonate, and the electric charge generating layer, the electric charge transferring layer and electric charge generating layer being mutually laminated.

Furthermore, the electric charge generating layer of the multi-layer type photosensitive layer may comprise the electric charge generating material alone, or comprise the electric charge generating material and, if necessary, the electron transferring material, which are contained in a suitable binding resin.

Particularly, the electrophotosensitive material having the single-layer type organic photosensitive layer of the above item ① is suitably used as the positive charging type because of its structure.

Furthermore, the multi-layer type organic photosensitive material of the above item ② can be used as the positive and negative types by changing the order of the electric charge transferring layer and electric charge generating layer to be laminated. That is, when the electric charge generating layer is formed on the conductive substrate and the electric charge transferring layer is then formed thereon, the negative charging type can be obtained. When the order of both layers to be formed is reversed, the positive charging type can be obtained.

Among them, in order to obtain an electrophotosensitive material, which is superior in mechanical strength and repeat characteristics and has a high glass transition temperature and a high sensitivity, by making the best use of excellent mechanical characteristics of the above four sorts of polycarbonates to be used as the binding resin of the electric charge transferring layer, the negative charging type comprising the electric charge transferring layer on the surface of the photosensitive layer is preferred. Even though it is the positive charging type, an electrophotosensitive material having high sensitivity and excellent repeat characteristics can be obtained according to the operation of the above electric charge transferring layer. In that case, it is preferred to maintain the mechanical strength, for example, by forming a surface protective layer on the electric charge generating layer.

Examples of the electric charge generating material to be used in the present invention include selenium, selenium-tellurium, amorphous silicon, pyrilium salt, azo pigments, bisazo pigments, perylene pigments, anthanthrone pigments, phthalocyanine pigments, naphthalocyanine pigments, indigo pigments, triphenylmethane pigments, threne pigments, toluidine pigments, pyrazoline pigments, quinacridon pigments, dithioketopyrrolopyrrole pigments, etc. These electric charge generating materials can be used alone or in combination thereof so that the electronphotosensitive material has an absorption wavelength within a desired range.

Examples of the electric charge generating material suitable for the organic photosensitive material having a sensitivity within the wavelength range of 700 nm or more, which is used for digital-optical image forming apparatuses using a light source such as semi-conductor laser (e.g. laser beam printer, facsimile, etc.), include phthalocyanine pigments such as X type metal-free phthalocyanine or oxotitanyl phthalocyanine. Since these phthalocyanine pigments are superior in matching with the above hole transferring material, an electrophotosensitive material using both materials in combination has a high sensitivity within the above wavelength range and can be suitably used for digital-optical image forming apparatuses.

On the other hand, examples of the electric charge generating material suitable for the organic photosensitive material having a sensitivity within the visible range, which is used for analog-optical image forming apparatuses using a white light source such as halogen lamp (e.g. electrostatic copying machine), include bisazo pigments. Since these bisazo pigments are superior in matching with the above hole transferring material, an electrophotosensitive material using both materials in combination has a high sensitivity within the above wavelength range and can be suitably used for analog-optical image forming apparatuses.

Examples of the electron transferring material, which may be added to the electric charge generating layer in the single-layer type and multi-layer type organic photosensitive layers, include various electron attractive compounds such as quinone derivatives (e.g. benzoquinone, diphenoquinone, naphthoquinone), malononitrile, thiopyran compounds, tetracyanoethylene, 2,4,8-trinitrothioxanthone, fluorenone compounds (e.g. 3,4,5,7-tetranitro-9-fluorenone), dinitrobenzene, dinitroanthracene, dinitroacridine, nitroanthraquinone, succinic anhydride, maleic anhydride, dibromomaleic anhydride, etc. They can be used alone or in combination thereof, and the diphenoquinone derivative represented by the formula (12):

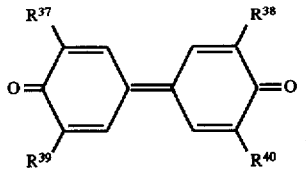

(12)

wherein $R^{37}$, $R^{38}$, $R^{39}$ and $R^{40}$ are the same or different and indicate a hydrogen atom, an alkyl group, an alkoxy group, an aryl group or an aralkyl group is suitably used, particularly.

Such a diphenoquinone derivative is superior in not only electron transferring properties but also matching with the above two sorts of electric charge generating materials, six sorts of hole transferring materials and specific polycarbonates. Particularly, it has an action of abstracting electrons from the electric charge generating material in the exposure process of the photosensitive material and, therefore, the electric charge-generating efficiency in the electric charge generating material is improved and the residual potential is decreased. Also, the diphenoquinone derivative causes no carrier trapping which inhibits six sorts of hole transferring materials from transferring electrons. Therefore, it becomes possible to attain higher sensitivity in the single-layer type photosensitive layer wherein both materials are dispersed in the same layer. At the time of exposure, not only electric charge generating material but also hole transferring material are excited to form a singlet excited state having a high reactivity. However, the diphenoquinone derivative has a quenching effect and quenches the excited hole transferring material. Therefore, it inhibits the hole transferring material from deteriorating or decomposing in the single-layer type photosensitive layer, particularly, and improves the stability of the photosensitive material.

Examples of the diphenoquinone derivative represented by the formula (12) include compounds represented by the following formulas (12-1) to (12-2).

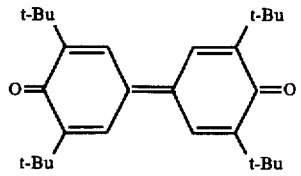

(12-1)

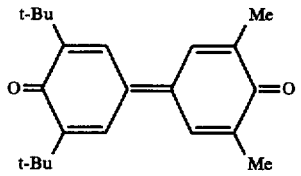

(12-2)

In the electrophotosensitive material of the present invention, the above specific polycarbonates can also be used in combination with various binding resins which have hitherto been used for the organic photosensitive layer. Examples of the other binding resin include thermoplastic resins such as styrene polymer, styrene-butadiene copolymer, styrene-acrylonitrile copolymer, styrene-maleic acid copolymer, acrylic copolymer, styrene-acrylic acid copolymer, polyethylene, ethylene-vinyl acetate copolymer, chlorinated polyethylene, polyvinyl chloride, polypropylene, ionomer, vinyl chloride-vinyl acetate copolymer, polyester, alkyd resin, polyamide, polyurethane, polycarbonate other than those described above, polyarylate, polysulfon, diaryl phthalate resin, ketone resin, polyvinyl butyral resin, polyether resin, polyester resin, etc.; crosslinking thermosetting resins such as silicone resin, epoxy resin, phenol resin, urea resin, melamine resin, etc.; photosetting resins such as epoxy acrylate, urethane acrylate, etc. These binding resins can be used alone or in combination thereof. Suitable resins are styrene polymer, acrylic polymer, styrene-acrylic copolymer, polyester, alkyd resin, polycarbonate other than those described above, or polyarylate.

These binding resins can also be used as the binding resin for the electric charge generating layer in the above multilayer type photosensitive layer.

Furthermore, in the present invention, there can be used other hole transferring materials which have hitherto been known, together with the above six sorts of hole transferring materials. Examples of the hole transferring material include nitrogen-containing cyclic compounds and condensed polycyclic compounds such as oxadiazole compounds (e.g. 2,5-di(4-methylaminophenyl)-1,3,4-oxadiazole), styryl compounds (e.g. 9-(4-diethylaminostyryl)anthracene), carbazole compounds (e.g. polyvinyl carbazole), diamine compounds other than the above six sorts of diamine compounds, organic polysilane compounds, pyrazoline compounds 1-phenyl-3-(p-dimethylaminophenyl)pyrazoline), hydrazone compounds, triphenylamine compounds, indole compounds, oxazole compounds, isoxazole compounds, thiazole compounds, thiadiazole compounds, imidazole compounds, pyrazole compounds, triazole compounds, etc. These hole transferring materials can be used alone or in combination thereof.

Furthermore, various additives known to the public, such as deterioration inhibitors (e.g. antioxidants, radical scavengers, singlet quenchers, ultraviolet absorbers, etc.), softeners, plasticizers, surface modifiers, bulking agents, thickening agents, dispersion stabilizers, wax, acceptors, donors, etc. can be formulated in the photosensitive layer without injury to the electrophotographic characteristics. The amount of these additives to be added may be the same as that used in a conventional technique. For example, it is preferred that a steric hindered phenolic antioxidant is formulated in the amount of about 0.1 to 50 parts by weight, based on 100 parts by weight of the binding resin.

In order to improve the sensitivity of the photosensitive layer, known sensitizers such as terphenyl, halonaphthoquinones, acenaphthylene may be used in combination with the electric charge generating material.

As the conductive substrate to be used for the photosensitive material of the present invention, various materials having a conductivity can be used, and examples thereof include metals such as iron, aluminum, copper, tin, platinum, silver, vanadium, molybdenum, chromium, cadmium, titanium, nickel, palladium, indium, stainless steel, brass, etc.; plastic materials vapor-deposited or laminated with the above metal; glass materials coated with aluminum iodide, tin oxide, indium oxide.

The conductive substrate may be made in the form of a sheet or a drum. The substrate itself may have a conductivity or only the surface of the substrate may have a conductivity. It is preferred that the conductive substrate has a sufficient mechanical strength when used.

The single-layer type photosensitive material in the present invention is formed by applying a coating solution obtained by dissolving or dispersing a binding resin, an electric charge generating material and a hole transferring material and, if necessary, an electron transferring material in a suitable solvent on a conductive substrate, followed by drying (so-called solution coating method).

In the single-layer type photosensitive material, it is preferred that the electric charge generating material may be blended in an amount of 0.5 to 20 parts by weight, particularly 0.5 to 10 parts by weight, based on 100 parts by weight of the binding resin.

It is preferred that the hole transferring material may be blended in an amount of 5 to 200 parts by weight, particularly 30 to 150 parts by weight, based on 100 parts by weight of the binding resin.

It is preferred that the electron transferring material may be blended in an amount of 5 to 100 parts by weight, particularly 10 to 80 parts by weight, based on 100 parts by weight of the binding resin.

When using only one or more of the above four sorts of specific polycarbonates as the binding resin, the proportion of the binding resin is that of the specific polycarbonate itself. When using in combination with the other binding resin, the proportion of the binding resin is the total amount of the specific polycarbonate and other binding resin.

Similarly, when using one or more of the above six sorts as the hole transferring material, the proportion of the hole transferring material is that of the six sorts of hole transferring materials. When using in combination with the other hole transferring material, the proportion of the hole transferring material is the total amount of the hole transferring materials.

The thickness of the single-layer type photosensitive material is preferably 5 to 50 μm, more preferably 10 to 40 μm.

The electric charge generating layer in the multi-layer photosensitive layer is formed by depositing an electric charge transferring material on a conductive substrate in the form of membrane using a vapor phase growing method such as vacuum deposition method (deposition type electric charge generating layer) or applying a coating solution obtained by dissolving or dispersing a binding resin and an electric charge generating material and, if necessary, an electron transferring material on a conductive substrate, followed by drying (resin dispersion type electric charge generating layer).

On the other hand, the electric charge transferring layer is formed by applying a coating solution obtained by dissolving or dispersing a binding resin and a hole transferring material in a suitable solvent on the above electric charge generating layer, followed by drying. The order of the electric charge generating layer to be formed may be reverse.

In the resin dispersion type electric charge generating layer of the multi-layer photosensitive material, it is preferred that the electric charge generating material may be blended in an amount of 5 to 1000 parts by weight, particularly 30 to 500 parts by weight, based on 100 parts by weight of the binding resin.

Furthermore, it is preferred that the electron transferring material may be blended in an amount of 5 to 200 parts by weight, particularly 10 to 100 parts by weight, based on 100 parts by weight of the binding resin On the other hand, in the electric charge transferring layer, it is preferred that the hole transferring material may be blended in an amount of 10 to 500 parts by weight, particularly 25 to 200 parts by weight, based on 100 parts by weight of the binding resin.

In the multi-layer type photosensitive layer, the thickness of the electric charge generating layer is preferably about 0.01 to 5 μm, particularly about 0.1 to 3 μm, and that of the electric charge transferring layer is preferably about 2 to 100 μm, particularly about 5 to 50 μm.

A barrier layer may be formed, in such a range as not to injure the characteristics of the photosensitive material, between the conductive substrate and photosensitive layer in the single-layer type photosensitive material, or between the conductive substrate and electric charge generating layer or between the conductive substrate layer and electric charge transferring layer in the multi-layer type photosensitive material. Furthermore, a protective layer may be formed on the surface of the photosensitive layer.

When the photosensitive layer is formed by the application method, the electric charge generating material, electric charge transferring material and binding resin may be dispersed and mixed with a suitable solvent using a known method, such as roll mill, ball mill, atriter, paint shaker, ultrasonic dispersion device, etc., and the resulting solution may be applied using a known means, followed by drying.

As the solvent for preparing a dispersion solution, there can be used various organic solvents, and examples thereof include alcohols such as methanol, ethanol, isopropanol, butanol, etc.; aliphatic hydrocarbons such as n-hexane, octane, cyclohexane, etc.; aromatic hydrocarbons such as benzene, toluene, xylene, etc.; halogenated hydrocarbons such as dichloromethane, dichloroethane, carbon tetrachloride, chlorobenzene, etc.; ethers such as dimethyl ether, diethyl ether, tetrahydrofuran, ethylene glycol dimethyl ether, diethylene glycol dimethyl ether, etc.; ketones such as acetone, methyl ethyl ketone, cyclohexanone, etc.; esters such as ethyl acetate, methyl acetate, etc.; dimethylformaldehyde, dimethylformamide, dimethyl sulfoxide, etc. These solvents may be used alone or in combination thereof.

In order to improve a dispersibility of the electric charge transferring material and electric charge generating material as well as a smoothness of the surface of the photosensitive layer, surfactants, leveling agents, etc. may be used.

EXAMPLES

The following Examples and Comparative Examples further illustrate the present invention in detail. (Single-layer type photosensitive material for digital light source)

Examples 1 to 40

5 Parts by weight of a phthalocyanine pigment (electric charge generating material, CGM) and 50 parts by weight of a benzidine derivative (hole transferring material, HTM) represented by the formula (6) and, if necessary, 30 parts by weight of a predetermined electron transferring material (ETM) were added to 800 parts by weight of tetrahydrofuran, together with 100 parts by weight of a bisphenol C type polycarbonate (binding resin) represented by the above-described compound numbers (1-1) to (1-5), and the mixture was mixed and dispersed for 50 hours using a ball mill to prepare a coating solution for single-layer type photosensitive layer. Then, this coating solution was applied on an aluminum tube by using a dip coating method, followed by hot-air drying at 100° C. for 60 minutes to produce a single-layer type photosensitive material for digital light source, which has a single-layer type photosensitive layer of about 15 to 20 μm in film thickness, respectively.

Incidentally, the viscosity-average of the above respective polycarbonates used is within the range of 20,000 to 25,000.

Comparative Example 1

According to the same manner as that described in Examples 1 to 40 except for using 50 parts by weight of a carbazole hydrazone derivative represented by the formula (C):

(C)

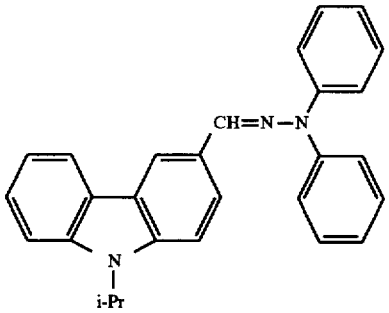

as the hole transferring material, a single-layer type photosensitive material for digital light source was produced.

Comparative Example 2

According to the same manner as that described in Examples 1 to 40 except for using 100 parts by weight of a bis phenol A type polycarbonate represented by the formula (A) as the binding resin, a single-layer type photosensitive material for digital light source was produced. The viscosity-average of the bisphenol A type polycarbonate used is within the same range as that of the Examples (i.e. 20,000 to 25,000).

Comparative Example 3

According to the same manner as that described in Examples 1 to 40 except for using 50 parts by weight of a conventional benzidine derivative represented by the formula (B) as the hole transferring material, a single-layer type photosensitive material for digital light source was produced.

Concrete compounds of the hole transferring material (HTM), electron transferring material (ETM) and binding resin used in the above respective Examples and Comparative Examples are shown in Tables 1 to 5, using the compound numbers of the above-described embodiments. Furthermore, as the phthalocyanine pigment, two sorts (i.e., X type metal-free phthalocyanine and oxotitanyl phthalocyanine) were used. The kind of the phthalocyanine pigment to be used in the respective Examples and Comparative Examples is shown in Tables 1 to 5, using the following symbols.

X: X type metal-free phthalocyanine

Ti: Oxotitanyl phthalocyanine

The single-layer type photosensitive materials of the above respective Examples and Comparative Examples were subjected to the following tests, and their characteristics were evaluated.

Photosensitivity test I

By using a drum sensitivity tester manufactured by GENTEC Co., a voltage was applied on the surface of the photosensitive material of the respective Examples and Comparative Examples to charge the surface at +700 V. Then, monochromatic light [wavelength: 780 nm (half-width: 20 nm), light intensity: 16 μW/cm 2] from white light of a halogen lamp as an exposure light source through a band-pass filter was irradiated on the surface of the photosensitive material (irradiation time: 80 msec.). Furthermore, a surface potential at the time at which 330 msec. has passed since the beginning of exposure was measured as a potential after exposure $V_L$ (V).

Repeat characteristics test I

A photosensitive material of the respective Examples and Comparative Examples was fit with an imaging unit of a facsimile for plain paper (Model LDC-650, manufactured by Mita Industrial Co., Ltd.) and, after the image was formed 10,000 times, an initial surface potential $V_0$ (V) and a potential after exposure $V_L$ (V) were measured using the above drum sensitivity tester. Then, a change in measured value from the initial value (i.e. $\Delta V_0$ (V) and $\Delta V_L$ (V)) was determined, respectively. The initial value used herein means a value before the image is repeatedly formed. The potential after exposure $V_L$ (V) means a measured result of the above photosensitivity test.

Wear resistance test I

A photosensitive material of the respective Examples and Comparative Examples was fit with an imaging unit of the above facsimile for plain paper and, after rotating 150,000 times without passing a paper through it, a change in film thickness of the organic photosensitive layer was determined, respectively. The above results are shown in Tables 1 to 5.

TABLE 1

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1 | X | 6-1 | 12-1 | 1-1 | 161 | −12 | 11 | 2.9 |
| 2 | X | 6-1 | 12-1 | 1-2 | 185 | −9 | 6 | 3.1 |
| 3 | X | 6-1 | 12-1 | 1-3 | 174 | −14 | 9 | 3.3 |
| 4 | X | 6-1 | 12-1 | 1-4 | 170 | −12 | 15 | 2.7 |
| 5 | X | 6-1 | 12-1 | 1-5 | 166 | −21 | 18 | 3.4 |
| 6 | X | 6-1 | 12-2 | 1-2 | 169 | −14 | 20 | 3.0 |
| 7 | X | 6-1 | — | 1-2 | 170 | −22 | 10 | 3.2 |
| 8 | Ti | 6-1 | 12-1 | 1-2 | 198 | −11 | 10 | 3.2 |

TABLE 2

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 9 | X | 6-2 | 12-1 | 1-1 | 171 | −19 | 13 | 2.8 |
| 10 | X | 6-2 | 12-1 | 1-2 | 165 | −22 | 13 | 2.9 |
| 11 | X | 6-2 | 12-1 | 1-3 | 177 | −24 | 17 | 3.0 |
| 12 | X | 6-2 | 12-1 | 1-4 | 181 | −8 | 12 | 3.3 |
| 13 | X | 6-2 | 12-1 | 1-5 | 174 | −15 | 9 | 3.3 |
| 14 | X | 6-2 | 12-2 | 1-2 | 166 | −17 | 10 | 3.6 |
| 15 | X | 6-2 | — | 1-2 | 194 | −16 | 9 | 3.5 |
| 16 | Ti | 6-2 | 12-1 | 1-2 | 199 | −19 | 8 | 3.0 |

TABLE 3

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 17 | X | 6-3 | 12-1 | 1-1 | 159 | −20 | 13 | 3.3 |
| 18 | X | 6-3 | 12-1 | 1-2 | 164 | −24 | 16 | 2.9 |
| 19 | X | 6-3 | 12-1 | 1-3 | 166 | −17 | 15 | 2.8 |
| 20 | X | 6-3 | 12-1 | 1-4 | 164 | −17 | 13 | 2.7 |
| 21 | X | 6-3 | 12-1 | 1-5 | 159 | −17 | 12 | 3.3 |
| 22 | X | 6-3 | 12-2 | 1-2 | 169 | −15 | 11 | 3.0 |
| 23 | X | 6-3 | — | 1-2 | 198 | −17 | 10 | 3.2 |
| 24 | Ti | 6-3 | 12-1 | 1-2 | 201 | −19 | 9 | 2.9 |

TABLE 4

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 25 | X | 6-4 | 12-1 | 1-1 | 181 | −25 | 8 | 3.4 |
| 26 | X | 6-4 | 12-1 | 1-2 | 172 | −14 | 6 | 3.2 |
| 27 | X | 6-4 | 12-1 | 1-3 | 177 | −17 | 9 | 3.0 |
| 28 | X | 6-4 | 12-1 | 1-4 | 174 | −16 | 7 | 3.4 |
| 29 | X | 6-4 | 12-1 | 1-5 | 170 | −13 | 9 | 3.5 |
| 30 | X | 6-4 | 12-2 | 1-2 | 169 | −10 | 11 | 3.6 |
| 31 | X | 6-4 | — | 1-2 | 201 | −6 | 13 | 3.4 |
| 32 | Ti | 6-4 | 12-1 | 1-2 | 204 | −5 | 12 | 3.6 |

TABLE 5

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 33 | X | 6-5 | 12-1 | 1-1 | 161 | −20 | 9 | 3.3 |
| 34 | X | 6-5 | 12-1 | 1-2 | 162 | −10 | 22 | 3.1 |
| 35 | X | 6-5 | 12-1 | 1-3 | 172 | −15 | 24 | 3.4 |
| 36 | X | 6-5 | 12-1 | 1-4 | 177 | −6 | 21 | 3.4 |
| 37 | X | 6-5 | 12-1 | 1-5 | 169 | −9 | 24 | 3.4 |
| 38 | X | 6-5 | 12-2 | 1-2 | 174 | −10 | 19 | 3.5 |
| 39 | X | 6-5 | — | 1-2 | 200 | −11 | 17 | 3.6 |
| 40 | Ti | 6-5 | 12-1 | 1-2 | 205 | −13 | 20 | 3.4 |
| COMP. EX. 1 | X | C | — | 1-2 | 265 | −85 | 35 | 4.2 |
| COMP. EX. 2 | X | 6-1 | — | A | 200 | −64 | 42 | 8.4 |
| COMP. EX. 3 | X | B | — | 1-2 | 248 | −105 | 34 | 4.6 |

Examples 41 to 96

According to the same manner as that described in Examples 1 to 40 except for using 50 parts by weight of a benzidine derivative represented by the formula (7) as the hole transferring material, a single-layer type photosensitive material for digital light source was produced, respectively.

Comparative Example 4

According to the same manner as that described in Examples 41 to 96 except for using 50 parts by weight of a carbazole hydrazone derivative represented by the formula (C) as the hole transferring material, a single-layer type photosensitive material for digital light source was produced.

Comparative Example 5

According to the same manner as that described in Examples 41 to 96 except for using 100 parts by weight of the same bisphenol A type polycarbonate represented by the formula (A) as the binding resin, a single-layer type photosensitive material for digital light source was produced.

Comparative Example 6

According to the same manner as that described in Examples 41 to 96 except for using 50 parts by weight of a conventional benzidine derivative represented by the formula (B) as the hole transferring material, a single-layer type photosensitive material for digital light source was produced.

Concrete compounds of the hole transferring material, electron transferring material and binding resin used in the above respective Examples and Comparative Examples are shown in Tables 6 to 12, using the compound numbers of the above-described embodiments.

The single-layer type photosensitive material of the respective Examples and comparative Examples was subjected to the above respective tests I and its characteristics were evaluated. The results are shown in Tables 6 to 12.

TABLE 6

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 41 | X | 7-1 | 12-1 | 1-1 | 172 | −16 | 20 | 3.3 |
| 42 | X | 7-1 | 12-1 | 1-2 | 170 | −20 | 11 | 2.8 |
| 43 | X | 7-1 | 12-1 | 1-3 | 166 | −24 | 9 | 3.0 |
| 44 | X | 7-1 | 12-1 | 1-4 | 169 | −11 | 18 | 2.9 |
| 45 | X | 7-1 | 12-1 | 1-5 | 177 | −19 | 12 | 2.9 |
| 46 | X | 7-1 | 12-2 | 1-2 | 182 | −16 | 11 | 3.4 |
| 47 | X | 7-1 | — | 1-2 | 199 | −15 | 19 | 3.3 |
| 48 | Ti | 7-1 | 12-1 | 1-2 | 194 | −13 | 12 | 3.1 |

TABLE 7

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 49 | X | 7-2 | 12-1 | 1-1 | 172 | −16 | 15 | 3.0 |
| 50 | X | 7-2 | 12-1 | 1-2 | 174 | −20 | 16 | 2.9 |
| 51 | X | 7-2 | 12-1 | 1-3 | 176 | −9 | 13 | 3.4 |
| 52 | X | 7-2 | 12-1 | 1-4 | 179 | −14 | 12 | 3.3 |
| 53 | X | 7-2 | 12-1 | 1-5 | 182 | −13 | 11 | 3.6 |
| 54 | X | 7-2 | 12-2 | 1-2 | 164 | −24 | 10 | 3.4 |
| 55 | X | 7-2 | — | 1-2 | 195 | −20 | 9 | 3.2 |
| 56 | Ti | 7-2 | 12-1 | 1-2 | 190 | −20 | 11 | 3.0 |

TABLE 8

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 57 | X | 7-3 | 12-1 | 1-1 | 166 | −14 | 14 | 2.5 |
| 58 | X | 7-3 | 12-1 | 1-2 | 174 | −20 | 13 | 3.2 |
| 59 | X | 7-3 | 12-1 | 1-3 | 170 | −19 | 11 | 3.4 |
| 60 | X | 7-3 | 12-1 | 1-4 | 169 | −11 | 9 | 3.2 |
| 61 | X | 7-3 | 12-1 | 1-5 | 180 | −13 | 14 | 3.1 |
| 62 | X | 7-3 | 12-2 | 1-2 | 182 | −10 | 13 | 3.0 |
| 63 | X | 7-3 | — | 1-2 | 198 | −9 | 12 | 3.3 |
| 64 | Ti | 7-3 | 12-1 | 1-2 | 190 | −20 | 14 | 3.6 |

TABLE 9

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 65 | X | 7-4 | 12-1 | 1-1 | 169 | −12 | 13 | 2.5 |
| 66 | X | 7-4 | 12-1 | 1-2 | 164 | −10 | 11 | 3.3 |
| 67 | X | 7-4 | 12-1 | 1-3 | 174 | −6 | 19 | 2.8 |
| 68 | X | 7-4 | 12-1 | 1-4 | 177 | −5 | 14 | 3.1 |
| 69 | X | 7-4 | 12-1 | 1-5 | 176 | −9 | 20 | 3.4 |
| 70 | X | 7-4 | 12-2 | 1-2 | 174 | −12 | 21 | 3.3 |
| 71 | X | 7-4 | — | 1-2 | 193 | −14 | 14 | 3.2 |
| 72 | Ti | 7-4 | 12-1 | 1-2 | 190 | −12 | 10 | 3.3 |

TABLE 10

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 73 | X | 7-5 | 12-1 | 1-1 | 175 | −14 | 13 | 3.6 |
| 74 | X | 7-5 | 12-1 | 1-2 | 174 | −13 | 11 | 2.9 |
| 75 | X | 7-5 | 12-1 | 1-3 | 174 | −12 | 18 | 3.0 |
| 76 | X | 7-5 | 12-1 | 1-4 | 172 | −10 | 16 | 3.1 |
| 77 | X | 7-5 | 12-1 | 1-5 | 171 | −18 | 14 | 3.0 |
| 78 | X | 7-5 | 12-2 | 1-2 | 173 | −17 | 13 | 3.4 |
| 79 | X | 7-5 | — | 1-2 | 194 | −15 | 11 | 3.2 |
| 80 | Ti | 7-5 | 12-1 | 1-2 | 189 | −13 | 14 | 3.1 |

TABLE 11

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 81 | X | 7-6 | 12-1 | 1-1 | 166 | −11 | 6 | 2.9 |
| 82 | X | 7-6 | 12-1 | 1-2 | 154 | −9 | 9 | 2.8 |
| 83 | X | 7-6 | 12-1 | 1-3 | 150 | −22 | 11 | 3.3 |
| 84 | X | 7-6 | 12-1 | 1-4 | 169 | −20 | 13 | 3.2 |
| 85 | X | 7-6 | 12-1 | 1-5 | 177 | −20 | 10 | 3.0 |
| 86 | X | 7-6 | 12-2 | 1-2 | 174 | −19 | 8 | 3.4 |
| 87 | X | 7-6 | — | 1-2 | 191 | −17 | 14 | 3.2 |
| 88 | Ti | 7-6 | 12-1 | 1-2 | 192 | −15 | 12 | 3.3 |

TABLE 12

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 89 | X | 7-7 | 12-1 | 1-1 | 177 | −12 | 12 | 3.3 |
| 90 | X | 7-7 | 12-1 | 1-2 | 170 | −15 | 12 | 3.6 |
| 91 | X | 7-7 | 12-1 | 1-3 | 160 | −14 | 15 | 2.9 |
| 92 | X | 7-7 | 12-1 | 1-4 | 165 | −16 | 13 | 2.5 |
| 93 | X | 7-7 | 12-1 | 1-5 | 163 | −13 | 12 | 3.2 |
| 94 | X | 7-7 | 12-2 | 1-2 | 169 | −11 | 11 | 3.0 |
| 95 | X | 7-7 | — | 1-2 | 194 | −9 | 9 | 3.0 |
| 96 | Ti | 7-7 | 12-1 | 1-2 | 189 | −7 | 10 | 3.0 |
| COMP. EX. 4 | X | C | — | 1-2 | 284 | −77 | 42 | 4.0 |
| COMP. EX. 5 | X | 7-1 | — | A | 221 | −70 | 49 | 7.7 |
| COMP. EX. 6 | X | B | — | 1-2 | 276 | −100 | 36 | 4.4 |

Examples 97 to 128

According to the same manner as that described in Examples 1 to 40 except for using 50 parts by weight of a benzidine derivative represented by the formula (8) as the hole transferring material, a single-layer type photosensitive material for digital light source was produced, respectively.

Comparative Example 7

According to the same manner as that described in Examples 97 to 128 except for using 50 parts by weight of a carbazole hydrazone derivative represented by the formula (C) as the hole transferring material, a single-layer type photosensitive material for digital light source was produced.

Comparative Example 8

According to the same manner as that described in Examples 97 to 128 except for using 100 parts by weight of the same bisphenol A type polycarbonate represented by the formula (A) as the binding resin, a single-layer type photosensitive material for digital light source was produced.

Comparative Example 9

According to the same manner as that described in Examples 97 to 128 except for using 50 parts by weight of a conventional benzidine derivative represented by the formula (B) as the hole transferring material, a single-layer type photosensitive material for digital light source was produced.

Incidentally, concrete compounds of the hole transferring material, electron transferring material and binding resin used in the above respective Examples and Comparative Examples are shown in Tables 13 to 16, using the compound numbers of the above-described embodiments.

The single-layer type photosensitive material of the respective Examples and Comparative Examples was subjected to the above respective tests I and its characteristics were evaluated. The results are shown in Tables 13 to 16.

TABLE 13

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 97 | X | 8-1 | 12-1 | 1-1 | 170 | −19 | 15 | 3.1 |
| 98 | X | 8-1 | 12-1 | 1-2 | 166 | −20 | 10 | 3.0 |
| 99 | X | 8-1 | 12-1 | 1-3 | 165 | −15 | 9 | 3.5 |
| 100 | X | 8-1 | 12-1 | 1-4 | 174 | −9 | 20 | 3.3 |
| 101 | X | 8-1 | 12-1 | 1-5 | 177 | −11 | 11 | 3.0 |
| 102 | X | 8-1 | 12-2 | 1-2 | 180 | −12 | 14 | 2.9 |
| 103 | X | 8-1 | — | 1-2 | 194 | −13 | 14 | 3.0 |
| 104 | Ti | 8-1 | 12-1 | 1-2 | 199 | −14 | 12 | 3.0 |

TABLE 14

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 105 | X | 8-2 | 12-1 | 1-1 | 166 | −6 | 13 | 3.5 |
| 106 | X | 8-2 | 12-1 | 1-2 | 165 | −5 | 11 | 3.3 |
| 107 | X | 8-2 | 12-1 | 1-3 | 165 | −15 | 10 | 3.6 |
| 108 | X | 8-2 | 12-1 | 1-4 | 171 | −20 | 9 | 3.1 |
| 109 | X | 8-2 | 12-1 | 1-5 | 170 | −22 | 13 | 3.1 |
| 110 | X | 8-2 | 12-2 | 1-2 | 174 | −24 | 10 | 3.0 |
| 111 | X | 8-2 | — | 1-2 | 198 | −20 | 14 | 3.3 |
| 112 | Ti | 8-2 | 12-1 | 1-2 | 200 | −15 | 12 | 3.2 |

TABLE 15

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 113 | X | 8-3 | 12-1 | 1-1 | 171 | −12 | 16 | 3.0 |
| 114 | X | 8-3 | 12-1 | 1-2 | 166 | −10 | 15 | 2.9 |
| 115 | X | 8-3 | 12-1 | 1-3 | 165 | −9 | 13 | 3.4 |
| 116 | X | 8-3 | 12-1 | 1-4 | 163 | −15 | 16 | 3.4 |
| 117 | X | 8-3 | 12-1 | 1-5 | 162 | −9 | 15 | 3.2 |
| 118 | X | 8-3 | 12-2 | 1-2 | 161 | −6 | 14 | 3.3 |
| 119 | X | 8-3 | — | 1-2 | 200 | −20 | 12 | 3.6 |
| 120 | Ti | 8-3 | 12-1 | 1-2 | 205 | −20 | 10 | 3.7 |

TABLE 16

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 121 | X | 8-4 | 12-1 | 1-1 | 170 | −9 | 9 | 3.3 |
| 122 | X | 8-4 | 12-1 | 1-2 | 172 | −14 | 8 | 3.2 |
| 123 | X | 8-4 | 12-1 | 1-3 | 174 | −12 | 10 | 3.3 |
| 124 | X | 8-4 | 12-1 | 1-4 | 175 | −11 | 13 | 3.4 |
| 125 | X | 8-4 | 12-1 | 1-5 | 177 | −12 | 15 | 3.3 |

TABLE 16-continued

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 126 | X | 8-4 | 12-2 | 1-2 | 174 | −15 | 15 | 3.1 |
| 127 | X | 8-4 | — | 1-2 | 198 | −16 | 15 | 3.2 |
| 128 | Ti | 8-4 | 12-1 | 1-2 | 201 | −10 | 15 | 3.1 |
| COMP. EX. 7 | X | C | — | 1-2 | 277 | −90 | 44 | 5.3 |
| COMP. EX. 8 | X | 8-1 | — | A | 214 | −77 | 32 | 9.2 |
| COMP. EX. 9 | X | B | — | 1-2 | 265 | −121 | 30 | 4.6 |

Examples 129 to 160

According to the same manner as that described in Examples 1 to 40 except for using 50 parts by weight of a benzidine derivative represented by the formula (9) as the hole transferring material, a single-layer type photosensitive material for digital light source was produced, respectively.

Comparative Example 10

According to the same manner as that described in Examples 129 to 160 except for using 50 parts by weight of a carbazole hydrazone derivative represented by the formula (C) as the hole transferring material, a single-layer type photosensitive material for digital light source was produced.

Comparative Example 11

According to the same manner as that described in Examples 129 to 160 except for using 100 parts by weight of the same bisphenol A type polycarbonate represented by the formula (A) as the binding resin, a single-layer type photosensitive material for digital light source was produced.

Comparative Example 12

According to the same manner as that described in Examples 129 to 160 except for using 50 parts by weight of a conventional benzidine derivative represented by the formula (B) as the hole transferring material, a single-layer type photosensitive material for digital light source was produced.

Incidentally, concrete compounds of the hole transferring material, electron transferring material and binding resin used in the above respective Examples and Comparative Examples are shown in Tables 17 to 20, using the compound numbers of the above-described embodiments.

The single-layer type photosensitive material of the respective Examples and Comparative Examples was subjected to the above respective tests I and its characteristics were evaluated. The results are shown in Tables 17 to 20.

TABLE 17

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 129 | X | 9-1 | 12-1 | 1-1 | 160 | −14 | 13 | 2.9 |
| 130 | X | 9-1 | 12-1 | 1-2 | 159 | −13 | 12 | 3.1 |
| 131 | X | 9-1 | 12-1 | 1-3 | 170 | −20 | 10 | 3.3 |
| 132 | X | 9-1 | 12-1 | 1-4 | 172 | −9 | 15 | 3.5 |
| 133 | X | 9-1 | 12-1 | 1-5 | 170 | −12 | 14 | 3.1 |
| 134 | X | 9-1 | 12-2 | 1-2 | 166 | −11 | 9 | 2.9 |
| 135 | X | 9-1 | — | 1-2 | 196 | −14 | 13 | 3.0 |
| 136 | Ti | 9-1 | 12-1 | 1-2 | 194 | −10 | 14 | 3.0 |

TABLE 18

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 137 | X | 9-2 | 12-1 | 1-1 | 172 | −15 | 10 | 3.3 |
| 138 | X | 9-2 | 12-1 | 1-2 | 177 | −13 | 14 | 3.4 |
| 139 | X | 9-2 | 12-1 | 1-3 | 174 | −15 | 13 | 3.1 |
| 140 | X | 9-2 | 12-1 | 1-4 | 173 | −18 | 12 | 3.0 |
| 141 | X | 9-2 | 12-1 | 1-5 | 172 | −17 | 12 | 2.9 |
| 142 | X | 9-2 | 12-2 | 1-2 | 170 | −16 | 13 | 2.9 |
| 143 | X | 9-2 | — | 1-2 | 195 | −15 | 10 | 3.3 |
| 144 | Ti | 9-2 | 12-1 | 1-2 | 196 | −17 | 12 | 2.9 |

TABLE 19

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 145 | X | 9-3 | 12-1 | 1-1 | 169 | −14 | 12 | 3.4 |
| 146 | X | 9-3 | 12-1 | 1-2 | 172 | −13 | 19 | 3.2 |
| 147 | X | 9-3 | 12-1 | 1-3 | 174 | −18 | 14 | 3.1 |
| 148 | X | 9-3 | 12-1 | 1-4 | 173 | −15 | 13 | 3.2 |
| 149 | X | 9-3 | 12-1 | 1-5 | 166 | −17 | 12 | 3.4 |
| 150 | X | 9-3 | 12-2 | 1-2 | 165 | −16 | 11 | 3.5 |
| 151 | X | 9-3 | — | 1-2 | 200 | −14 | 12 | 3.2 |
| 152 | Ti | 9-3 | 12-1 | 1-2 | 199 | −12 | 12 | 3.4 |

TABLE 20

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 153 | X | 9-4 | 12-1 | 1-1 | 175 | −14 | 12 | 3.3 |
| 154 | X | 9-4 | 12-1 | 1-2 | 175 | −20 | 14 | 3.1 |
| 155 | X | 9-4 | 12-1 | 1-3 | 173 | −21 | 13 | 2.9 |
| 156 | X | 9-4 | 12-1 | 1-4 | 174 | −14 | 14 | 3.3 |
| 157 | X | 9-4 | 12-1 | 1-5 | 170 | −13 | 15 | 3.0 |
| 158 | X | 9-4 | 12-2 | 1-2 | 176 | −12 | 16 | 2.8 |
| 159 | X | 9-4 | — | 1-2 | 191 | −10 | 17 | 3.3 |
| 160 | Ti | 9-4 | 12-1 | 1-2 | 192 | −9 | 16 | 3.4 |
| COMP. EX. 10 | X | C | — | 1-2 | 266 | −104 | 39 | 4.5 |
| COMP. EX. 11 | X | 9-1 | — | A | 201 | −88 | 40 | 9.6 |
| COMP. EX. 12 | X | B | — | 1-2 | 271 | −99 | 30 | 4.8 |

Examples 161–192

According to the same manner as that described in Examples 1 to 40 except for using 50 parts by weight of an o-phenylenediamine derivative represented by the formula (10) as the hole transferring material, a single-layer type photosensitive material for digital light source was produced, respectively.

Comparative Example 13

According to the same manner as that described in Examples 161 to 192 except for using 50 parts by weight of a carbazole hydrazone derivative represented by the formula (C) as the hole transferring material, a single-layer type photosensitive material for digital light source was produced.

Comparative Example 14

According to the same manner as that described in Examples 161 to 192 except for using 100 parts by weight of the same bisphenol A type polycarbonate represented by the formula (A) as the binding resin, a single-layer type photosensitive material for digital light source was produced.

Comparative Example 15

According to the same manner as that described in Examples 161 to 192 except for using 50 parts by weight of a conventional benzidine derivative represented by the formula (B) as the hole transferring material, a single-layer type photosensitive material for digital light source was produced.

Incidentally, concrete compounds of the hole transferring material, electron transferring material and binding resin used in the above respective Examples and Comparative Examples are shown in Tables 21 to 24, using the compound numbers of the above-described embodiments.

The single-layer type photosensitive material of the respective Examples and Comparative Examples was subjected to the above respective tests I and its characteristics were evaluated. The results are shown in Tables 21 to 24.

TABLE 21

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 161 | X | 10-1 | 12-1 | 1-1 | 181 | −11 | 14 | 1.9 |
| 162 | X | 10-1 | 12-1 | 1-2 | 177 | −18 | 13 | 1.8 |
| 163 | X | 10-1 | 12-1 | 1-3 | 183 | −11 | 12 | 1.7 |
| 164 | X | 10-1 | 12-1 | 1-4 | 169 | −9 | 15 | 1.6 |
| 165 | X | 10-1 | 12-1 | 1-5 | 177 | −15 | 9 | 1.1 |
| 166 | X | 10-1 | 12-2 | 1-2 | 180 | −13 | 10 | 1.4 |
| 167 | X | 10-1 | — | 1-2 | 205 | −12 | 15 | 1.3 |
| 168 | Ti | 10-1 | 12-1 | 1-2 | 211 | −20 | 15 | 1.8 |

TABLE 22

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 169 | X | 10-2 | 12-1 | 1-1 | 175 | −10 | 10 | 1.3 |
| 170 | X | 10-2 | 12-1 | 1-2 | 177 | −9 | 8 | 1.5 |
| 171 | X | 10-2 | 12-1 | 1-3 | 176 | −8 | 13 | 1.8 |
| 172 | X | 10-2 | 12-1 | 1-4 | 184 | −14 | 12 | 1.7 |
| 173 | X | 10-2 | 12-1 | 1-5 | 182 | −15 | 12 | 1.3 |
| 174 | X | 10-2 | 12-2 | 1-2 | 181 | −10 | 13 | 1.6 |
| 175 | X | 10-2 | — | 1-2 | 201 | −15 | 11 | 1.5 |
| 176 | Ti | 10-2 | 12-1 | 1-2 | 209 | −20 | 10 | 1.9 |

TABLE 23

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 177 | X | 10-3 | 12-1 | 1-1 | 180 | −14 | 12 | 1.3 |
| 178 | X | 10-3 | 12-1 | 1-2 | 175 | −13 | 10 | 1.1 |
| 179 | X | 10-3 | 12-1 | 1-3 | 177 | −12 | 11 | 1.9 |
| 180 | X | 10-3 | 12-1 | 1-4 | 181 | −11 | 14 | 1.8 |
| 181 | X | 10-3 | 12-1 | 1-5 | 174 | −10 | 13 | 1.8 |
| 182 | X | 10-3 | 12-2 | 1-2 | 175 | −9 | 12 | 1.7 |
| 183 | X | 10-3 | — | 1-2 | 210 | −14 | 10 | 2.0 |
| 184 | Ti | 10-3 | 12-1 | 1-2 | 215 | −13 | 8 | 1.9 |

TABLE 24

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 185 | X | 10-4 | 12-1 | 1-1 | 174 | −15 | 10 | 1.5 |
| 186 | X | 10-4 | 12-1 | 1-2 | 173 | −13 | 15 | 1.3 |
| 187 | X | 10-4 | 12-1 | 1-3 | 174 | −15 | 16 | 1.2 |
| 188 | X | 10-4 | 12-1 | 1-4 | 176 | −15 | 17 | 1.1 |
| 189 | X | 10-4 | 12-1 | 1-5 | 175 | −16 | 14 | 1.8 |
| 190 | X | 10-4 | 12-2 | 1-2 | 177 | −11 | 13 | 1.6 |
| 191 | X | 10-4 | — | 1-2 | 196 | −13 | 11 | 1.5 |
| 192 | Ti | 10-4 | 12-1 | 1-2 | 205 | −14 | 12 | 1.3 |
| COMP. EX. 13 | X | C | — | 1-2 | 270 | −65 | 24 | 4.7 |
| COMP. EX. 14 | X | 10-1 | — | A | 200 | −77 | 38 | 8.9 |
| COMP. EX. 15 | X | B | — | 1-2 | 284 | −102 | 34 | 5.0 |

Examples 193 to 232

According to the same manner as that described in Examples 1 to 40 except for using 50 parts by weight of a m-phenylenediamine derivative represented by the formula (11) as the hole transferring material, a single-layer type photosensitive material for digital light source was produced, respectively.

Comparative Example 16

According to the same manner as that described in Examples 193 to 232 except for using 50 parts by weight of a carbazole hydrazone derivative represented by the formula (C) as the hole transferring material, a single-layer type photosensitive material for digital light source was produced.

Comparative Example 17

According to the same manner as that described in Examples 193 to 232 except for using 100 parts by weight of the same bisphenol A type polycarbonate represented by the formula (A) as the binding resin, a single-layer type photosensitive material for digital light source was produced.

Comparative Example 18

According to the same manner as that described in Examples 193 to 232 except for using 50 parts by weight of a conventional benzidine derivative represented by the formula (B) as the hole transferring material, a single-layer type photosensitive material for digital light source was produced.

Incidentally, concrete compounds of the hole transferring material, electron transferring material and binding resin used in the above respective Examples and Comparative Examples were shown in Tables 25 to 29, using the compound numbers of the above-described embodiments.

The single-layer type photosensitive material of the respective Examples and Comparative Examples was subjected to the above respective tests I and its characteristics were evaluated. The results are shown in Tables 25 to 29.

TABLE 25

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 193 | X | 11-1 | 12-1 | 1-1 | 176 | −15 | 10 | 1.8 |
| 194 | X | 11-1 | 12-1 | 1-2 | 175 | −14 | 9 | 1.2 |
| 195 | X | 11-1 | 12-1 | 1-3 | 174 | −11 | 14 | 1.3 |
| 196 | X | 11-1 | 12-1 | 1-4 | 176 | −10 | 12 | 1.9 |
| 197 | X | 11-1 | 12-1 | 1-5 | 181 | −15 | 12 | 2.0 |
| 198 | X | 11-1 | 12-2 | 1-2 | 170 | −17 | 11 | 1.1 |
| 199 | X | 11-1 | — | 1-2 | 201 | −16 | 14 | 1.4 |
| 200 | Ti | 11-1 | 12-1 | 1-2 | 205 | −20 | 10 | 1.3 |

TABLE 26

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 201 | X | 11-2 | 12-1 | 1-1 | 181 | −12 | 11 | 1.0 |
| 202 | X | 11-2 | 12-1 | 1-2 | 174 | −18 | 13 | 1.0 |
| 203 | X | 11-2 | 12-1 | 1-3 | 175 | −15 | 12 | 1.5 |
| 204 | X | 11-2 | 12-1 | 1-4 | 181 | −11 | 11 | 1.3 |
| 205 | X | 11-2 | 12-1 | 1-5 | 174 | −9 | 14 | 1.6 |
| 206 | X | 11-2 | 12-2 | 1-2 | 175 | −14 | 13 | 1.5 |
| 207 | X | 11-2 | — | 1-2 | 205 | −13 | 11 | 1.6 |
| 208 | Ti | 11-2 | 12-1 | 1-2 | 209 | −12 | 8 | 1.5 |

TABLE 27

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 209 | X | 11-3 | 12-1 | 1-1 | 176 | −12 | 13 | 1.3 |
| 210 | X | 11-3 | 12-1 | 1-2 | 177 | −13 | 12 | 1.2 |
| 211 | X | 11-3 | 12-1 | 1-3 | 174 | −12 | 15 | 1.2 |
| 212 | X | 11-3 | 12-1 | 1-4 | 174 | −14 | 14 | 1.5 |
| 213 | X | 11-3 | 12-1 | 1-5 | 174 | −15 | 13 | 1.4 |
| 214 | X | 11-3 | 12-2 | 1-2 | 178 | −10 | 12 | 1.3 |
| 215 | X | 11-3 | — | 1-2 | 209 | −9 | 11 | 1.2 |
| 216 | Ti | 11-3 | 12-1 | 1-2 | 214 | −8 | 10 | 1.5 |

TABLE 28

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 217 | X | 11-4 | 12-1 | 1-1 | 181 | −12 | 12 | 1.6 |
| 218 | X | 11-4 | 12-1 | 1-2 | 174 | −11 | 11 | 1.8 |
| 219 | X | 11-4 | 12-1 | 1-3 | 178 | −14 | 9 | 1.9 |
| 220 | X | 11-4 | 12-1 | 1-4 | 177 | −15 | 10 | 2.0 |
| 221 | X | 11-4 | 12-1 | 1-5 | 171 | −20 | 15 | 1.5 |
| 222 | X | 11-4 | 12-2 | 1-2 | 173 | −21 | 13 | 2.2 |
| 223 | X | 11-4 | — | 1-2 | 215 | −20 | 12 | 2.0 |
| 224 | Ti | 11-4 | 12-1 | 1-2 | 220 | −10 | 11 | 1.8 |

TABLE 29

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 225 | X | 11-4 | 12-1 | 1-1 | 174 | −18 | 14 | 1.3 |
| 226 | X | 11-4 | 12-1 | 1-2 | 173 | −19 | 13 | 1.8 |
| 227 | X | 11-4 | 12-1 | 1-3 | 174 | −20 | 12 | 1.9 |
| 228 | X | 11-4 | 12-1 | 1-4 | 175 | −9 | 11 | 2.0 |
| 229 | X | 11-4 | 12-1 | 1-5 | 180 | −11 | 9 | 1.5 |
| 230 | X | 11-4 | 12-2 | 1-2 | 179 | −12 | 8 | 1.6 |

TABLE 29-continued

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 231 | X | 11-4 | — | 1-2 | 203 | −11 | 11 | 1.5 |
| 232 | Ti | 11-4 | 12-1 | 1-2 | 216 | −14 | 10 | 1.6 |
| COMP. EX. 16 | X | C | — | 1-2 | 259 | −77 | 33 | 4.8 |
| COMP. EX. 17 | X | 11-1 | — | A | 198 | −85 | 25 | 9.0 |
| COMP. EX. 18 | X | B | — | 1-2 | 284 | −108 | 30 | 5.1 |

(Single-layer type photosensitive material for analog light source)

Examples 233 to 261

According to the same manner as that described in Examples 1 to 232 except for using 5 parts by weight of a bisazo pigment represented by the formula (13):

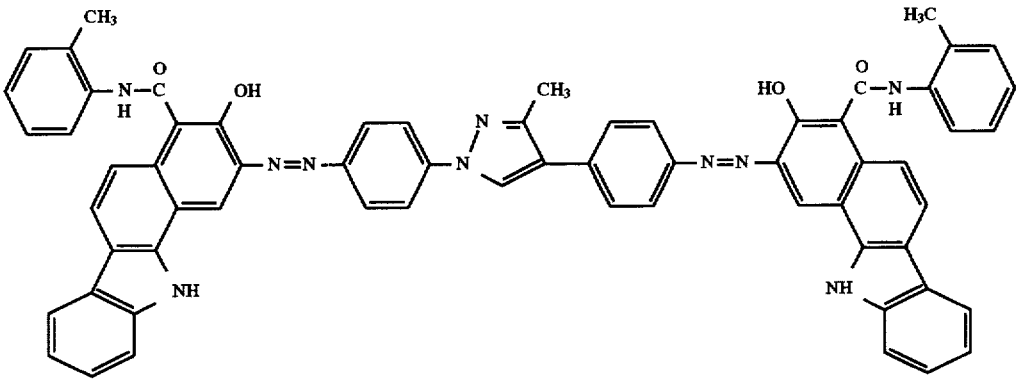

(13)

as the electric charge generating material, a single-layer type photosensitive material for digital light source was produced, respectively.

Incidentally, concrete compounds of the hole transferring material, electron transferring material and binding resin used in the above respective Examples and Comparative Examples are shown in Tables 30 to 35, using the compound numbers of the above-described embodiments.

The single-layer type photosensitive materials of the respective Example were subjected to the following tests and their characteristics were evaluated.

Photosensitivity test II

By using a drum sensitivity tester manufactured by GEN-TEC Co., a voltage was applied on the surface of the photosensitive material of the respective Examples to charge the surface at +700 V. Then, white light (light intensity: 147 lux second) of a halogen lamp as an exposure light source was irradiated on the surface of the photosensitive material (irradiation time: 50 msec.). A surface potential at the time at which 330 msec. has passed since the beginning of exposure was measured as a potential after exposure $V_L$ (V).

Repeat characteristics test II

A photosensitive material of the respective Examples was fit with an electrostatic copying apparatus (Model DC-2556, manufactured by Mira Industrial Co., Ltd.) and, after the image was formed 10,000 times, an initial surface potential $V_0$ (V) and a potential after exposure $V_L$ (V) were measured using the above drum sensitivity tester. Then, a change in measured value from the initial value (i.e. $\Delta V_0$ (V) and $\Delta V_L$ (V)) was determined, respectively. The initial value used herein means a value before the image is repeatedly formed. The potential after exposure $V_L$ (V) means a measured result of the above photosensitivity test.

Wear resistance test II

A photosensitive material of the respective Examples was fit with the above electrostatic copying apparatus and, after rotating 150,000 times without passing a paper through it, a change in film thickness of the organic photosensitive layer was determined, respectively. The above results are shown in Tables 30 to 35.

TABLE 30

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 233 | 13 | 6-1 | 12-1 | 1-2 | 204 | −10 | 8 | 3.4 |
| 234 | 13 | 6-2 | 12-1 | 1-2 | 190 | −24 | 11 | 2.8 |
| 235 | 13 | 6-3 | 12-1 | 1-2 | 194 | −10 | 13 | 3.1 |
| 236 | 13 | 6-4 | 12-1 | 1-2 | 192 | −11 | 11 | 3.0 |
| 237 | 13 | 6-5 | 12-1 | 1-2 | 194 | −9 | 22 | 3.3 |

TABLE 31

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 238 | 13 | 7-1 | 12-1 | 1-2 | 204 | −16 | 11 | 3.2 |
| 239 | 13 | 7-2 | 12-1 | 1-2 | 200 | −15 | 14 | 3.1 |
| 240 | 13 | 7-3 | 12-1 | 1-2 | 192 | −14 | 13 | 3.1 |
| 241 | 13 | 7-4 | 12-1 | 1-2 | 190 | −14 | 13 | 3.4 |
| 242 | 13 | 7-5 | 12-1 | 1-2 | 194 | −12 | 11 | 3.0 |
| 243 | 13 | 7-6 | 12-1 | 1-2 | 201 | −11 | 15 | 3.1 |
| 244 | 13 | 7-7 | 12-1 | 1-2 | 199 | −8 | 8 | 2.7 |

TABLE 32

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 245 | 13 | 8-1 | 12-1 | 1-2 | 204 | −12 | 10 | 2.8 |
| 246 | 13 | 8-2 | 12-1 | 1-2 | 205 | −16 | 12 | 3.2 |
| 247 | 13 | 8-3 | 12-1 | 1-2 | 210 | −15 | 15 | 3.5 |
| 248 | 13 | 8-4 | 12-1 | 1-2 | 199 | −8 | 12 | 3.1 |

TABLE 33

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 249 | 13 | 9-1 | 12-1 | 1-2 | 200 | −8 | 14 | 2.9 |
| 250 | 13 | 9-2 | 12-1 | 1-2 | 202 | −19 | 14 | 3.1 |
| 251 | 13 | 9-3 | 12-1 | 1-2 | 209 | −11 | 14 | 3.1 |
| 252 | 13 | 9-4 | 12-1 | 1-2 | 198 | −12 | 15 | 3.3 |

TABLE 34

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 253 | 13 | 10-1 | 12-1 | 1-2 | 209 | −8 | 13 | 2.0 |
| 254 | 13 | 10-2 | 12-1 | 1-2 | 215 | −16 | 9 | 1.8 |
| 255 | 13 | 10-3 | 12-1 | 1-2 | 220 | −15 | 14 | 1.8 |
| 256 | 13 | 10-4 | 12-1 | 1-2 | 210 | −13 | 13 | 1.2 |

TABLE 35

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 257 | 13 | 11-1 | 12-1 | 1-2 | 210 | −9 | 9 | 1.1 |
| 258 | 13 | 11-2 | 12-1 | 1-2 | 215 | −14 | 7 | 1.3 |
| 259 | 13 | 11-3 | 12-1 | 1-2 | 220 | −11 | 9 | 1.9 |
| 260 | 13 | 11-4 | 12-1 | 1-2 | 224 | −16 | 14 | 1.7 |

TABLE 35-continued

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 261 | 13 | 11-5 | 12-1 | 1-2 | 219 | −13 | 13 | 1.7 |

(Multi-layer type photosensitive material for digital light source)

Examples 262 to 290

2 Parts by weight of X type metal-free phthalocyanine (electric charge generating material) and 1 part by weight of polyvinyl butyral (hole transferring material) were dispersed and mixed together with 120 parts by weight of dichloromethane using a ball mill to prepare a coating solution for electric charge generating layer. Then, this coating solution was applied on an aluminum tube using a dip coating method, followed by hot-air drying at 100° C. for 60 minutes to produce an electric charge generating layer having a thickness of 0.5 μm.

Then, 80 parts by weight of a hole transferring material represented by any one of the formulas (6) to (11) and 100 parts by weight of bisphenol C type polycarbonate (binding resin) of the repeating unit represented by the formula (1-2) mentioned above were dispersed and mixed together with 800 parts by weight of benzene with a ball mill to prepare a coating solution for electric charge transferring layer. Then, this coating solution was applied on the above electric charge generating layer using a dip coating method, followed by hot-air drying at 90° C. for 60 minutes to form an electric charge transferring layer having a thickness of 15 μm, thereby producing a multi-layer type photosensitive material for digital light source, respectively.

Concrete compounds of the hole transferring material and binding resin used in the above respective Examples are shown in Tables 36 to 41, using the compound numbers of the above-described embodiments.

The multi-layer type photosensitive material of the respective Example was subjected to the following tests and its characteristics were evaluated.

Photosensitivity test III

By using a drum sensitivity tester manufactured by GENTEC Co., a voltage was applied on the surface of the photosensitive materials of the respective Examples to charge the surface at −700 V. Then, monochromatic light [wavelength: 780 nm (half-width: 20 nm), light intensity: 16 $\mu W/cm^2$] from white light of a halogen lamp as an exposure light source through a band-pass filter was irradiated on the surface of the photosensitive material (irradiation time: 80 msec.). A surface potential at the time at which 330 msec. has passed since the beginning of exposure was measured as a potential after exposure $V_L$ (V).

Repeat characteristics test III

A photosensitive material of the respective Examples was fit with an electrostatic laser printer (Model LP-2080, manufactured by Mita Industrial Co., Ltd.) and, after the image was formed 10,000 times, an initial surface potential $V_0$ (V) and a potential after exposure $V_L$ (V) were measured using the above drum sensitivity tester. Then, a change in measured value from the initial value (i.e. $\Delta V_0$ (V) and $\Delta V_L$ (V)) was determined, respectively. The initial value used herein means a value before the image is repeatedly formed. The potential after exposure $V_L$ (V) means a measured result of the above photosensitivity test.

Wear resistance test III

A photosensitive material of the respective Examples was fit with an imaging unit of the above electrostatic laser printer and, after rotating 150,000 times without passing a paper through it, a change in thickness of the organic photosensitive layer was determined, respectively. The above results are shown in Tables 36 to 41.

TABLE 36

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 262 | 6-1 | 1-2 | −102 | −14 | 9 | 3.1 |
| 263 | 6-2 | 1-2 | −98 | −22 | 13 | 2.9 |
| 264 | 6-3 | 1-2 | −105 | −22 | 12 | 3.3 |
| 265 | 6-4 | 1-2 | −99 | −19 | 19 | 3.1 |
| 266 | 6-5 | 1-2 | −94 | −10 | 18 | 3.5 |

TABLE 37

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 267 | 7-1 | 1-2 | −94 | −14 | 14 | 2.9 |
| 268 | 7-2 | 1-2 | −102 | −16 | 13 | 2.9 |
| 269 | 7-3 | 1-2 | −109 | −13 | 13 | 3.1 |
| 270 | 7-4 | 1-2 | −100 | −15 | 19 | 3.1 |
| 271 | 7-5 | 1-2 | −96 | −16 | 16 | 3.1 |
| 272 | 7-6 | 1-2 | −99 | −13 | 13 | 3.0 |
| 273 | 7-7 | 1-2 | −101 | −6 | 7 | 2.9 |

TABLE 38

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 274 | 8-1 | 1-2 | −94 | −11 | 13 | 3.3 |
| 275 | 8-2 | 1-2 | −93 | −13 | 14 | 2.6 |
| 276 | 8-3 | 1-2 | −94 | −18 | 11 | 3.8 |
| 277 | 8-4 | 1-2 | −93 | −12 | 11 | 3.0 |

TABLE 39

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 278 | 9-1 | 1-2 | −90 | −7 | 11 | 3.3 |
| 279 | 9-2 | 1-2 | −94 | −20 | 13 | 2.8 |
| 280 | 9-3 | 1-2 | −93 | −9 | 13 | 3.0 |
| 281 | 9-4 | 1-2 | −89 | −14 | 12 | 3.1 |

TABLE 40

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 282 | 10-1 | 1-2 | −111 | −11 | 12 | 2.0 |
| 283 | 10-2 | 1-2 | −110 | −13 | 14 | 1.6 |
| 284 | 10-3 | 1-2 | −109 | −16 | 13 | 1.9 |
| 285 | 10-4 | 1-2 | −100 | −11 | 10 | 1.1 |

TABLE 41

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 286 | 11-1 | 1-2 | −99 | −14 | 13 | 1.3 |
| 287 | 11-2 | 1-2 | −104 | −15 | 10 | 1.4 |
| 288 | 11-3 | 1-2 | −109 | −14 | 14 | 1.8 |
| 289 | 11-4 | 1-2 | −98 | −15 | 13 | 1.6 |
| 290 | 11-5 | 1-2 | −96 | −12 | 11 | 1.8 |

(Multi-layer type photosensitive material for analog light source)

Examples 291 to 319

According to the same manner as that described in Examples 262 to 290 except for using 2 parts by weight of a bisazo pigment represented by the formula (13) as the electric charge generating material, a multi-layer type photosensitive material for digital light source was produced, respectively.

Concrete compounds of the hole transferring material and binding resin used in the above respective Examples are shown in Tables 42 to 47, using the compound numbers of the above-described embodiments.

The multi-layer type photosensitive material of the respective Example was subjected to the following tests and its characteristics were evaluated.

Photosensitivity test IV

By using a drum sensitivity tester manufactured by GENTEC Co., a voltage was applied on the surface of the photosensitive materials of the respective Examples to charge the surface at −700 V. Then, white light (light intensity: 147 lux second) of a halogen lamp as an exposure light source was irradiated on the surface of the photosensitive material (irradiation time: 50 msec.). A surface potential at the time at which 330 msec. has passed since the beginning of light exposure was measured as a potential after exposure $V_L$ (V).

Repeatability test IV

A photosensitive material of the respective Examples was fit with an electrostatic copying apparatus modified according to the negative charging specification (Model DC-2556, manufactured by Mira Industrial Co., Ltd.) and, after the image was formed 10,000 times, an initial surface potential $V_0$ (V) and a potential after exposure $V_L$ (V) were measured using the above drum sensitivity tester. Then, a change in measured value from the initial value (i.e. $\Delta V_0$ (V) and $\Delta V_L$ (V)) was determined, respectively. The initial value used herein means a value before the image is repeatedly formed. The potential after exposure $V_L$ (V) means a measured result of the above photosensitivity test.

Wear resistance test IV

A photosensitive material of the respective Examples was fit with the above electrostatic copying apparatus and, after rotating 150,000 times without passing a paper through it, a change in thickness of the organic photosensitive layer was determined, respectively. The above results are shown in Tables 42 to 47.

TABLE 42

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 291 | 6-1 | 1-2 | −134 | −13 | 14 | 3.5 |
| 292 | 6-2 | 1-2 | −140 | −24 | 15 | 3.4 |
| 293 | 6-3 | 1-2 | −150 | −24 | 11 | 3.2 |
| 294 | 6-4 | 1-2 | −141 | −20 | 21 | 3.4 |
| 295 | 6-5 | 1-2 | −130 | −14 | 16 | 3.0 |

TABLE 43

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 296 | 7-1 | 1-2 | −139 | −12 | 22 | 2.8 |
| 297 | 7-2 | 1-2 | −142 | −13 | 13 | 2.6 |
| 298 | 7-3 | 1-2 | −142 | −14 | 13 | 2.8 |
| 299 | 7-4 | 1-2 | −140 | −10 | 14 | 3.5 |
| 300 | 7-5 | 1-2 | −130 | −14 | 15 | 3.3 |
| 301 | 7-6 | 1-2 | −141 | −15 | 12 | 3.4 |
| 302 | 7-7 | 1-2 | −142 | −5 | 14 | 3.3 |

TABLE 44

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 303 | 8-1 | 1-2 | −140 | −9 | 15 | 3.6 |
| 304 | 8-2 | 1-2 | −133 | −13 | 19 | 2.9 |
| 305 | 8-3 | 1-2 | −131 | −10 | 13 | 3.4 |
| 306 | 8-4 | 1-2 | −130 | −14 | 14 | 2.9 |

TABLE 45

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 307 | 9-1 | 1-2 | −133 | −14 | 8 | 3.2 |
| 308 | 9-2 | 1-2 | −139 | −15 | 13 | 3.5 |

TABLE 45-continued

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 309 | 9-3 | 1-2 | −144 | −10 | 11 | 2.9 |
| 310 | 9-4 | 1-2 | −129 | −13 | 13 | 3.0 |

TABLE 46

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 311 | 10-1 | 1-2 | −150 | −10 | 11 | 2.0 |
| 312 | 10-2 | 1-2 | −149 | −11 | 13 | 1.5 |
| 313 | 10-3 | 1-2 | −150 | −16 | 11 | 1.6 |
| 314 | 10-4 | 1-2 | −144 | −9 | 9 | 1.5 |

TABLE 47

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 315 | 11-1 | 1-2 | −142 | −13 | 12 | 1.2 |
| 316 | 11-2 | 1-2 | −144 | −15 | 9 | 1.5 |
| 317 | 11-3 | 1-2 | −143 | −12 | 13 | 1.7 |
| 318 | 11-4 | 1-2 | −139 | −16 | 15 | 1.5 |
| 319 | 11-5 | 1-2 | −142 | −11 | 14 | 1.9 |

(Single-layer type photosensitive material for digital light source)

Examples 320 to 359

According to the same manner as that described in Examples 1 to 40 except for using 100 parts by weight of a bisphenol Z type polycarbonate of the repeating unit represented by any one of the formulas (2-1) to (2-5) as the binding resin, a single-layer type photosensitive material for digital light source was produced, respectively.

The viscosity-average of the respective polycarbonates used is within the range of about 20,000 to 25,000.

Comparative Example 19

According to the same manner as that described in Examples 320 to 359 except for using 50 parts by weight of a carbazole hydrazone derivative represented by the formula (C) as the hole transferring material, a single-layer type photosensitive material for digital light source was produced.

Comparative Example 20

According to the same manner as that described in Examples 320 to 359 except for using 100 parts by weight of the bisphenol A type polycarbonate represented by the formula (A) as the binding resin, a single-layer type photosensitive material for digital light source was produced.

Comparative Example 21

According to the same manner as that described in Examples 320 to 359 except for using 50 parts by weight of a conventional benzidine derivative represented by the formula (B) as the hole transferring material, a single-layer type photosensitive material for digital light source was produced.

Concrete compounds of the hole transferring material, electron transferring material and binding resin used in the above respective Examples and Comparative Examples are shown in Tables 48 to 52, using the compound numbers of the above-described embodiments.

The single-layer type photosensitive material of the respective Examples and Comparative Examples was subjected to the above respective tests I and its characteristics were evaluated. The results are shown in Tables 48 to 52.

TABLE 48

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 320 | X | 6-1 | 12-1 | 2-1 | 168 | −15 | 6 | 2.9 |
| 321 | X | 6-1 | 12-1 | 2-2 | 172 | −12 | 10 | 3.1 |
| 322 | X | 6-1 | 12-1 | 2-3 | 175 | −20 | 8 | 3.3 |
| 323 | X | 6-1 | 12-1 | 2-4 | 175 | −10 | 15 | 3.2 |
| 324 | X | 6-1 | 12-1 | 2-5 | 166 | −8 | 7 | 2.6 |
| 325 | X | 6-1 | 12-2 | 2-2 | 165 | −15 | 20 | 2.9 |
| 326 | X | 6-1 | — | 2-2 | 176 | −12 | 13 | 3.4 |
| 327 | Ti | 6-1 | 12-1 | 2-2 | 202 | −10 | 8 | 2.8 |

TABLE 49

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 328 | X | 6-2 | 12-1 | 2-1 | 172 | −19 | 8 | 2.5 |
| 329 | X | 6-2 | 12-1 | 2-2 | 175 | −16 | 18 | 2.5 |
| 330 | X | 6-2 | 12-1 | 2-3 | 169 | −10 | 14 | 2.6 |
| 331 | X | 6-2 | 12-1 | 2-4 | 180 | −15 | 20 | 3.1 |
| 332 | X | 6-2 | 12-1 | 2-5 | 174 | −11 | 10 | 3.3 |
| 333 | X | 6-2 | 12-2 | 2-2 | 173 | −9 | 9 | 3.0 |
| 334 | X | 6-2 | — | 2-2 | 200 | −20 | 10 | 2.8 |
| 335 | Ti | 6-2 | 12-1 | 2-2 | 211 | −20 | 11 | 2.6 |

TABLE 50

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 336 | X | 6-3 | 12-1 | 2-1 | 175 | −18 | 10 | 3.2 |
| 337 | X | 6-3 | 12-1 | 2-2 | 174 | −16 | 10 | 3.4 |
| 338 | X | 6-3 | 12-1 | 2-3 | 178 | −20 | 12 | 2.7 |
| 339 | X | 6-3 | 12-1 | 2-4 | 181 | −10 | 20 | 2.6 |
| 340 | X | 6-3 | 12-1 | 2-5 | 180 | −11 | 14 | 3.0 |
| 341 | X | 6-3 | 12-2 | 2-2 | 169 | −13 | 8 | 3.1 |
| 342 | X | 6-3 | — | 2-2 | 198 | −8 | 10 | 3.4 |
| 343 | Ti | 6-3 | 12-1 | 2-2 | 205 | −16 | 16 | 2.8 |

TABLE 51

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 344 | X | 6-4 | 12-1 | 2-1 | 172 | −18 | 20 | 2.7 |
| 345 | X | 6-4 | 12-1 | 2-2 | 181 | −9 | 18 | 2.9 |
| 346 | X | 6-4 | 12-1 | 2-3 | 174 | −11 | 11 | 2.9 |
| 347 | X | 6-4 | 12-1 | 2-4 | 173 | −7 | 15 | 3.1 |
| 348 | X | 6-4 | 12-1 | 2-5 | 175 | −15 | 8 | 3.0 |
| 349 | X | 6-4 | 12-2 | 2-2 | 176 | −19 | 18 | 2.8 |
| 350 | X | 6-4 | — | 2-2 | 202 | −20 | 16 | 2.6 |
| 351 | Ti | 6-4 | 12-1 | 2-2 | 211 | −11 | 20 | 3.1 |

TABLE 52

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 352 | X | 6-5 | 12-1 | 2-1 | 169 | −21 | 6 | 2.7 |
| 353 | X | 6-5 | 12-1 | 2-2 | 166 | −21 | 10 | 3.1 |
| 354 | X | 6-5 | 12-1 | 2-3 | 174 | −14 | 8 | 2.6 |
| 355 | X | 6-5 | 12-1 | 2-4 | 173 | −10 | 14 | 2.8 |
| 356 | X | 6-5 | 12-1 | 2-5 | 175 | −10 | 12 | 3.0 |
| 357 | X | 6-5 | 12-2 | 2-2 | 174 | −13 | 20 | 3.2 |
| 358 | X | 6-5 | — | 2-2 | 200 | −11 | 18 | 3.4 |
| 359 | Ti | 6-5 | 12-1 | 2-2 | 199 | −13 | 6 | 3.1 |
| COMP. EX. 19 | X | C | — | 2-2 | 270 | −75 | 32 | 4.3 |
| COMP. EX. 20 | X | 6-1 | — | A | 219 | −69 | 40 | 9.4 |
| COMP. EX. 21 | X | B | — | 2-2 | 286 | −124 | 29 | 4.6 |

Examples 360 to 415

According to the same manner as that described in Examples 320 to 359 except for using 50 parts by weight of a benzidine derivative represented by the formula (7) as the hole transferring material, a single-layer type photosensitive material for digital light source was produced, respectively.

Comparative Example 22

According to the same manner as that described in Examples 360 to 415 except for using 50 parts by weight of a carbazole hydrazone derivative represented by the formula (C) as the hole transferring material, a single-layer type photosensitive material for digital light source was produced.

Comparative Example 23

According to the same manner as that described in Examples 360 to 415 except for using 100 parts by weight of the same bisphenol A type polycarbonate represented by the formula (A) as the binding resin, a single-layer type photosensitive material for digital light source was produced.

Comparative Example 24

According to the same manner as that described in Examples 360 to 415 except for using 50 parts by weight of a conventional benzidine derivative represented by the formula (B) as the hole transferring material, a single-layer type photosensitive material for digital light source was produced.

Concrete compounds of the hole transferring material, electron transferring material and binding resin used in the above respective Examples and Comparative Examples are shown in Tables 53 to 59, using the compound numbers of the above-described embodiments.

The single-layer type photosensitive material of the respective Examples and Comparative Examples was subjected to the above respective tests I and its characteristics were evaluated. The results are shown in Tables 53 to 59.

TABLE 53

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 360 | X | 7-1 | 12-1 | 2-1 | 172 | −11 | 15 | 2.8 |
| 361 | X | 7-1 | 12-1 | 2-2 | 174 | −20 | 20 | 3.2 |
| 362 | X | 7-1 | 12-1 | 2-3 | 169 | −8 | 18 | 3.3 |
| 363 | X | 7-1 | 12-1 | 2-4 | 175 | −11 | 8 | 3.1 |
| 364 | X | 7-1 | 12-1 | 2-5 | 174 | −14 | 11 | 2.5 |
| 365 | X | 7-1 | 12-2 | 2-2 | 171 | −19 | 14 | 2.3 |
| 366 | X | 7-1 | — | 2-2 | 198 | −15 | 20 | 2.2 |
| 367 | Ti | 7-1 | 12-1 | 2-2 | 209 | −15 | 13 | 2.9 |

TABLE 54

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 368 | X | 7-2 | 12-1 | 2-1 | 170 | −8 | 8 | 3.0 |
| 369 | X | 7-2 | 12-1 | 2-2 | 165 | −7 | 10 | 3.1 |
| 370 | X | 7-2 | 12-1 | 2-3 | 168 | −10 | 11 | 3.1 |
| 371 | X | 7-2 | 12-1 | 2-4 | 173 | −21 | 10 | 3.3 |
| 372 | X | 7-2 | 12-1 | 2-5 | 172 | −14 | 20 | 3.0 |
| 373 | X | 7-2 | 12-2 | 2-2 | 179 | −16 | 14 | 2.7 |
| 374 | X | 7-2 | — | 2-2 | 204 | −11 | 11 | 2.5 |
| 375 | Ti | 7-2 | 12-1 | 2-2 | 212 | −20 | 20 | 3.0 |

TABLE 55

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 376 | X | 7-3 | 12-1 | 2-1 | 181 | −16 | 14 | 2.7 |
| 377 | X | 7-3 | 12-1 | 2-2 | 175 | −18 | 8 | 2.7 |
| 378 | X | 7-3 | 12-1 | 2-3 | 174 | −14 | 20 | 3.0 |
| 379 | X | 7-3 | 12-1 | 2-4 | 173 | −13 | 9 | 2.5 |
| 380 | X | 7-3 | 12-1 | 2-5 | 176 | −8 | 9 | 2.4 |
| 381 | X | 7-3 | 12-2 | 2-2 | 172 | −9 | 10 | 3.0 |
| 382 | X | 7-3 | — | 2-2 | 210 | −21 | 21 | 2.9 |
| 383 | Ti | 7-3 | 12-1 | 2-2 | 220 | −23 | 17 | 3.1 |

TABLE 56

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 384 | X | 7-4 | 12-1 | 2-1 | 169 | −10 | 8 | 2.8 |
| 385 | X | 7-4 | 12-1 | 2-2 | 168 | −8 | 9 | 2.6 |
| 386 | X | 7-4 | 12-1 | 2-3 | 172 | −8 | 22 | 2.8 |
| 387 | X | 7-4 | 12-1 | 2-4 | 177 | −9 | 15 | 3.1 |
| 388 | X | 7-4 | 12-1 | 2-5 | 167 | −15 | 13 | 3.1 |
| 389 | X | 7-4 | 12-2 | 2-2 | 180 | −13 | 9 | 2.5 |
| 390 | X | 7-4 | — | 2-2 | 209 | −9 | 10 | 3.1 |
| 391 | Ti | 7-4 | 12-1 | 2-2 | 214 | −20 | 14 | 2.8 |

TABLE 57

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 392 | X | 7-5 | 12-1 | 2-1 | 174 | −16 | 19 | 3.1 |
| 393 | X | 7-5 | 12-1 | 2-2 | 173 | −17 | 21 | 2.7 |
| 394 | X | 7-5 | 12-1 | 2-3 | 172 | −9 | 20 | 2.7 |
| 395 | X | 7-5 | 12-1 | 2-4 | 172 | −21 | 18 | 2.6 |
| 396 | X | 7-5 | 12-1 | 2-5 | 177 | −20 | 9 | 2.8 |
| 397 | X | 7-5 | 12-2 | 2-2 | 180 | −20 | 10 | 3.1 |
| 398 | X | 7-5 | — | 2-2 | 208 | −9 | 13 | 2.7 |
| 399 | Ti | 7-5 | 12-1 | 2-2 | 211 | −15 | 12 | 3.0 |

TABLE 58

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 400 | X | 7-6 | 12-1 | 2-1 | 171 | −19 | 8 | 2.9 |
| 401 | X | 7-6 | 12-1 | 2-2 | 173 | −16 | 10 | 2.9 |
| 402 | X | 7-6 | 12-1 | 2-3 | 175 | −10 | 10 | 3.1 |
| 403 | X | 7-6 | 12-1 | 2-4 | 177 | −10 | 15 | 3.0 |
| 404 | X | 7-6 | 12-1 | 2-5 | 174 | −13 | 11 | 2.5 |
| 405 | X | 7-6 | 12-2 | 2-2 | 173 | −20 | 8 | 3.1 |
| 406 | X | 7-6 | — | 2-2 | 204 | −7 | 20 | 3.3 |
| 407 | Ti | 7-6 | 12-1 | 2-2 | 211 | −10 | 21 | 2.6 |

TABLE 59

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 408 | X | 7-7 | 12-1 | 2-1 | 173 | −9 | 21 | 2.5 |
| 409 | X | 7-7 | 12-1 | 2-2 | 175 | −21 | 7 | 2.8 |
| 410 | X | 7-7 | 12-1 | 2-3 | 176 | −20 | 10 | 2.7 |
| 411 | X | 7-7 | 12-1 | 2-4 | 173 | −15 | 7 | 3.3 |
| 412 | X | 7-7 | 12-1 | 2-5 | 172 | −18 | 11 | 3.2. |
| 413 | X | 7-7 | 12-2 | 2-2 | 171 | −14 | 8 | 3.1 |
| 414 | X | 7-7 | — | 2-2 | 194 | −19 | 12 | 3.3 |
| 415 | Ti | 7-7 | 12-1 | 2-2 | 205 | −20 | 15 | 2.5 |
| COMP. EX. 22 | X | C | — | 2-2 | 269 | −72 | 44 | 4.0 |
| COMP. EX. 23 | X | 7-1 | — | A | 219 | −82 | 39 | 9.3 |
| COMP. EX. 24 | X | B | — | 2-2 | 266 | −121 | 31 | 4.4 |

Examples 416 to 447

According to the same manner as that described in Examples 320 to 359 except for using 50 parts by weight of a benzidine derivative represented by the formula (8) as the hole transferring material, a single-layer type photosensitive material for digital light source was produced, respectively.

Comparative Example 25

According to the same manner as that described in Examples 416 to 447 except for using 50 parts by weight of a carbazole hydrazone derivative represented by the formula (C) as the hole transferring material, a single-layer type photosensitive material for digital light source was produced.

Comparative Example 26

According to the same manner as that described in Examples 416 to 447 except for using 100 parts by weight of a bisphenol A type polycarbonate represented by the formula (A) as the binding resin, a single-layer type photosensitive material for digital light source was produced.

Comparative Example 27

According to the same manner as that described in Examples 416 to 447 except for using 50 parts by weight of a conventional benzidine derivative represented by the formula (B) as the hole transferring material, a single-layer type photosensitive material for digital light source was produced.

Concrete compounds of the hole transferring material, electron transferring material and binding resin used in the above respective Examples and Comparative Examples are shown in Tables 60 to 63, using the compound numbers of the above-described embodiments.

The single-layer type photosensitive material of the respective Examples and Comparative Examples was subjected to the above respective tests I and its characteristics were evaluated. The results are shown in Tables 60 to 63.

TABLE 60

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 416 | X | 8-1 | 12-1 | 2-1 | 172 | −11 | 19 | 2.2 |
| 417 | X | 8-1 | 12-1 | 2-2 | 174 | −18 | 20 | 2.4 |
| 418 | X | 8-1 | 12-1 | 2-3 | 175 | −15 | 14 | 3.1 |
| 419 | X | 8-1 | 12-1 | 2-4 | 174 | −7 | 20 | 3.1 |
| 420 | X | 8-1 | 12-1 | 2-5 | 173 | −21 | 10 | 2.8 |
| 421 | X | 8-1 | 12-2 | 2-2 | 169 | −19 | 8 | 2.3 |
| 422 | X | 8-1 | — | 2-2 | 202 | −19 | 9 | 3.5 |
| 423 | Ti | 8-1 | 12-1 | 2-2 | 214 | −11 | 9 | 3.3 |

TABLE 61

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 424 | X | 8-2 | 12-1 | 2-1 | 172 | −15 | 21 | 3.1 |
| 425 | X | 8-2 | 12-1 | 2-2 | 177 | −14 | 19 | 3.0 |
| 426 | X | 8-2 | 12-1 | 2-3 | 180 | −20 | 18 | 2.9 |
| 427 | X | 8-2 | 12-1 | 2-4 | 168 | −19 | 8 | 3.1 |
| 428 | X | 8-2 | 12-1 | 2-5 | 171 | −8 | 9 | 2.7 |
| 429 | X | 8-2 | 12-2 | 2-2 | 172 | −9 | 15 | 3.0 |
| 430 | X | 8-2 | — | 2-2 | 206 | −19 | 13 | 2.8 |
| 431 | Ti | 8-2 | 12-1 | 2-2 | 218 | −17 | 21 | 2.7 |

TABLE 62

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 432 | X | 8-3 | 12-1 | 2-1 | 173 | −21 | 15 | 2.8 |
| 433 | X | 8-3 | 12-1 | 2-2 | 174 | −18 | 10 | 2.9 |
| 434 | X | 8-3 | 12-1 | 2-3 | 173 | −12 | 21 | 3.1 |
| 435 | X | 8-3 | 12-1 | 2-4 | 172 | −10 | 18 | 2.9 |
| 436 | X | 8-3 | 12-1 | 2-5 | 176 | −17 | 10 | 3.1 |
| 437 | X | 8-3 | 12-2 | 2-2 | 170 | −8 | 7 | 2.9 |
| 438 | X | 8-3 | — | 2-2 | 199 | −10 | 8 | 3.0 |
| 439 | Ti | 8-3 | 12-1 | 2-2 | 209 | −8 | 15 | 2.8 |

TABLE 63

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 440 | X | 8-4 | 12-1 | 2-1 | 166 | −20 | 16 | 2.7 |
| 441 | X | 8-4 | 12-1 | 2-2 | 172 | −22 | 14 | 2.7 |
| 442 | X | 8-4 | 12-1 | 2-3 | 170 | −16 | 21 | 2.8 |
| 443 | X | 8-4 | 12-1 | 2-4 | 181 | −10 | 20 | 2.9 |
| 444 | X | 8-4 | 12-1 | 2-5 | 174 | −15 | 17 | 2.7 |
| 445 | X | 8-4 | 12-2 | 2-2 | 173 | −11 | 10 | 2.6 |
| 446 | X | 8-4 | — | 2-2 | 203 | −13 | 10 | 3.1 |
| 447 | Ti | 8-4 | 12-1 | 2-2 | 211 | −9 | 15 | 2.9 |
| COMP. EX. 5 | X | C | — | 2-2 | 288 | −88 | 41 | 4.0 |
| COMP. EX. 6 | X | 8-1 | — | A | 220 | −92 | 38 | 8.5 |
| COMP. EX. 7 | X | B | — | 2-2 | 274 | −100 | 36 | 4.4 |

Examples 448 to 479

According to the same manner as that described in Examples 320 to 359 except for using 50 parts by weight of a benzidine derivative represented by the formula (9) as the hole transferring material, a single-layer type photosensitive material for digital light source was produced, respectively.

Comparative Example 28

According to the same manner as that described in Examples 448 to 479 except for using 50 parts by weight of a carbazole hydrazone derivative represented by the formula (C) as the hole transferring material, a single-layer type photosensitive material for digital light source was produced.

Comparative Example 29

According to the same manner as that described in Examples 448 to 479 except for using 100 parts by weight of a bisphenol A type polycarbonate represented by the formula (A) as the binding resin, a single-layer type photosensitive material for digital light source was produced.

Comparative Example 30

According to the same manner as that described in Examples 448 to 479 except for using 50 parts by weight of a conventional benzidine derivative represented by the formula (B) as the hole transferring material, a single-layer type photosensitive material for digital light source was produced.

Incidentally, concrete compounds of the hole transferring material, electron transferring material and binding resin used in the above respective Examples and Comparative Examples are shown in Tables 64 to 67, using the compound numbers of the above-described embodiments.

The single-layer type photosensitive material of the respective Examples and Comparative Examples was subjected to the above respective tests I and its characteristics were evaluated. The results are shown in Tables 64 to 67.

TABLE 64

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 448 | X | 9-1 | 12-1 | 2-1 | 168 | −9 | 18 | 3.0 |
| 449 | X | 9-1 | 12-1 | 2-2 | 172 | −7 | 14 | 2.9 |
| 450 | X | 9-1 | 12-1 | 2-3 | 175 | −16 | 15 | 3.1 |
| 451 | X | 9-1 | 12-1 | 2-4 | 174 | −10 | 15 | 2.6 |
| 452 | X | 9-1 | 12-1 | 2-5 | 173 | −21 | 10 | 2.8 |
| 453 | X | 9-1 | 12-2 | 2-2 | 172 | −15 | 9 | 3.1 |
| 454 | X | 9-1 | — | 2-2 | 204 | −9 | 21 | 3.0 |
| 455 | Ti | 9-1 | 12-1 | 2-2 | 211 | −15 | 19 | 2.6 |

TABLE 65

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 456 | X | 9-2 | 12-1 | 2-1 | 181 | −21 | 17 | 2.7 |
| 457 | X | 9-2 | 12-1 | 2-2 | 180 | −23 | 21 | 2.7 |
| 458 | X | 9-2 | 12-1 | 2-3 | 172 | −20 | 17 | 3.1 |
| 459 | X | 9-2 | 12-1 | 2-4 | 173 | −18 | 8 | 3.3 |
| 460 | X | 9-2 | 12-1 | 2-5 | 171 | −16 | 15 | 3.0 |
| 461 | X | 9-2 | 12-2 | 2-2 | 175 | −14 | 20 | 3.2 |
| 462 | X | 9-2 | — | 2-2 | 211 | −14 | 14 | 2.5 |
| 463 | Ti | 9-2 | 12-1 | 2-2 | 225 | −15 | 18 | 3.1 |

TABLE 66

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 464 | X | 9-3 | 12-1 | 2-1 | 172 | −15 | 10 | 3.1 |
| 465 | X | 9-3 | 12-1 | 2-2 | 166 | −20 | 18 | 2.9 |
| 466 | X | 9-3 | 12-1 | 2-3 | 169 | −21 | 11 | 3.0 |
| 467 | X | 9-3 | 12-1 | 2-4 | 172 | −9 | 8 | 3.0 |
| 468 | X | 9-3 | 12-1 | 2-5 | 174 | −10 | 10 | 2.9 |
| 469 | X | 9-3 | 12-2 | 2-2 | 172 | −13 | 6 | 3.0 |
| 470 | X | 9-3 | — | 2-2 | 201 | −15 | 15 | 2.8 |
| 471 | Ti | 9-3 | 12-1 | 2-2 | 200 | −9 | 10 | 2.7 |

TABLE 67

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 472 | X | 9-4 | 12-1 | 2-1 | 171 | −5 | 19 | 2.8 |
| 473 | X | 9-4 | 12-1 | 2-2 | 168 | −8 | 14 | 2.9 |
| 474 | X | 9-4 | 12-1 | 2-3 | 172 | −11 | 8 | 2.5 |
| 475 | X | 9-4 | 12-1 | 2-4 | 177 | −14 | 10 | 2.9 |
| 476 | X | 9-4 | 12-1 | 2-5 | 175 | −8 | 15 | 3.0 |

TABLE 67-continued

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 477 | X | 9-4 | 12-2 | 2-2 | 173 | −21 | 9 | 3.1 |
| 478 | X | 9-4 | — | 2-2 | 198 | −14 | 18 | 2.8 |
| 479 | Ti | 9-4 | 12-1 | 2-2 | 199 | −9 | 20 | 2.9 |
| COMP. EX. 28 | X | C | — | 2-2 | 270 | −81 | 39 | 4.4 |
| COMP. EX. 29 | X | 9-1 | — | A | 231 | −99 | 42 | 9.2 |
| COMP. EX. 30 | X | B | — | 2-2 | 266 | −101 | 34 | 4.8 |

Examples 480 to 511

According to the same manner as that described in Examples 320 to 359 except for using 50 parts by weight of an o-phenylenediamine derivative represented by the formula (10) as the hole transferring material, a single-layer type photosensitive material for digital light source was produced, respectively.

Comparative Example 31

According to the same manner as that described in Examples 480 to 511 except for using 50 parts by weight of a carbazole hydrazone derivative represented by the formula (C) as the hole transferring material, a single-layer type photosensitive material for digital light source was produced.

Comparative Example 32

According to the same manner as that described in Examples 480 to 511 except for using 100 parts by weight of a bisphenol A type polycarbonate represented by the formula (A) as the binding resin, a single-layer type photosensitive material for digital light source was produced.

Comparative Example 33

According to the same manner as that described in Examples 480 to 511 except for using 50 parts by weight of a conventional benzidine derivative represented by the formula (B) as the hole transferring material, a single-layer type photosensitive material for digital light source was produced.

Incidentally, concrete compounds of the hole transferring material, electron transferring material and binding resin used in the above respective Examples and Comparative Examples are shown in Tables 68 to 71, using the compound numbers of the above-described embodiments.

The single-layer type photosensitive material of the respective Examples and Comparative Examples was subjected to the above respective tests I and its characteristics were evaluated. The results are shown in Tables 68 to 71.

TABLE 68

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 480 | X | 10-1 | 12-1 | 2-1 | 168 | −10 | 8 | 1.6 |
| 481 | X | 10-1 | 12-1 | 2-2 | 172 | −9 | 10 | 1.4 |
| 482 | X | 10-1 | 12-1 | 2-3 | 174 | −21 | 19 | 1.9 |
| 483 | X | 10-1 | 12-1 | 2-4 | 170 | −18 | 11 | 1.3 |
| 484 | X | 10-1 | 12-1 | 2-5 | 184 | −10 | 12 | 1.9 |
| 485 | X | 10-1 | 12-2 | 2-2 | 172 | −15 | 8 | 1.8 |
| 486 | X | 10-1 | — | 2-2 | 198 | −8 | 20 | 2.0 |
| 487 | Ti | 10-1 | 12-1 | 2-2 | 202 | −14 | 15 | 1.9 |

TABLE 69

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 488 | X | 10-2 | 12-1 | 2-1 | 170 | −18 | 10 | 1.4 |
| 489 | X | 10-2 | 12-1 | 2-2 | 174 | −18 | 18 | 1.3 |
| 490 | X | 10-2 | 12-1 | 2-3 | 172 | −16 | 19 | 1.8 |
| 491 | X | 10-2 | 12-1 | 2-4 | 173 | −7 | 23 | 1.8 |
| 492 | X | 10-2 | 12-1 | 2-5 | 175 | −10 | 19 | 1.5 |
| 493 | X | 10-2 | 12-2 | 2-2 | 174 | −15 | 9 | 2.0 |
| 494 | X | 10-2 | — | 2-2 | 202 | −21 | 13 | 2.1 |
| 495 | Ti | 10-2 | 12-1 | 2-2 | 210 | −20 | 10 | 1.8 |

TABLE 70

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 496 | X | 10-3 | 12-1 | 2-1 | 172 | −9 | 15 | 1.5 |
| 497 | X | 10-3 | 12-1 | 2-2 | 170 | −10 | 14 | 1.3 |
| 498 | X | 10-3 | 12-1 | 2-3 | 166 | −10 | 18 | 1.4 |
| 499 | X | 10-3 | 12-1 | 2-4 | 169 | −15 | 20 | 1.8 |
| 500 | X | 10-3 | 12-1 | 2-5 | 180 | −11 | 20 | 1.6 |
| 501 | X | 10-3 | 12-2 | 2-2 | 174 | −13 | 18 | 1.5 |
| 502 | X | 10-3 | — | 2-2 | 200 | −14 | 9 | 2.0 |
| 503 | Ti | 10-3 | 12-1 | 2-2 | 208 | −20 | 11 | 1.0 |

TABLE 71

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 504 | X | 10-4 | 12-1 | 2-1 | 181 | −14 | 13 | 1.3 |
| 505 | X | 10-4 | 12-1 | 2-2 | 174 | −17 | 11 | 1.9 |
| 506 | X | 10-4 | 12-1 | 2-3 | 172 | −15 | 18 | 2.1 |
| 507 | X | 10-4 | 12-1 | 2-4 | 173 | −17 | 13 | 1.6 |
| 508 | X | 10-4 | 12-1 | 2-5 | 175 | −20 | 15 | 1.4 |
| 509 | X | 10-4 | 12-2 | 2-2 | 175 | −19 | 10 | 1.4 |
| 510 | X | 10-4 | — | 2-2 | 194 | −21 | 19 | 1.8 |
| 511 | Ti | 10-4 | 12-1 | 2-2 | 202 | −15 | 14 | 1.5 |
| COMP. EX. 31 | X | C | — | 2-2 | 281 | −98 | 41 | 4.3 |
| COMP. EX. 32 | X | 10-1 | — | A | 230 | −81 | 45 | 9.2 |
| COMP. EX. 33 | X | B | — | 2-2 | 274 | −92 | 36 | 4.4 |

Examples 512 to 551

According to the same manner as that described in Examples 320 to 359 except for using 50 parts by weight of a m-phenylenediamine derivative represented by the formula (11) as the hole transferring material, a single-layer type photosensitive material for digital light source was produced, respectively.

Comparative Example 34

According to the same manner as that described in Examples 512 to 551 except for using 50 parts by weight of a carbazole hydrazone derivative represented by the formula (C) as the hole transferring material, a single-layer type photosensitive material for digital light source was produced.

Comparative Example 35

According to the same manner as that described in Examples 512 to 551 except for using 100 parts by weight of a bisphenol A type polycarbonate represented by the formula (A) as the binding resin, a single-layer type photosensitive material for digital light source was produced.

Comparative Example 36

According to the same manner as that described in Examples 512 to 551 except for using 50 parts by weight of a conventional benzidine derivative represented by the formula (B) as the hole transferring material, a single-layer type photosensitive material for digital light source was produced.

Incidentally, concrete compounds of the hole transferring material, electron transferring material and binding resin used in the above respective Examples and Comparative Examples are shown in Tables 72 to 76, using the compound numbers of the above-described embodiments.

The single-layer type photosensitive material of the respective Examples and Comparative Examples was subjected to the above respective tests I and its characteristics were evaluated. The results are shown in Tables 72 to 76.

TABLE 72

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 512 | X | 11-1 | 12-1 | 2-1 | 170 | −18 | 10 | 2.0 |
| 513 | X | 11-1 | 12-1 | 2-2 | 169 | −14 | 13 | 1.5 |
| 514 | X | 11-1 | 12-1 | 2-3 | 174 | −21 | 10 | 1.4 |
| 515 | X | 11-1 | 12-1 | 2-4 | 176 | −16 | 11 | 1.6 |
| 516 | X | 11-1 | 12-1 | 2-5 | 181 | −10 | 21 | 1.3 |
| 517 | X | 11-1 | 12-2 | 2-2 | 174 | −11 | 9 | 1.8 |
| 518 | X | 11-1 | — | 2-2 | 194 | −20 | 8 | 1.9 |
| 519 | Ti | 11-1 | 12-1 | 2-2 | 205 | −16 | 14 | 1.8 |

TABLE 73

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 520 | X | 11-2 | 12-1 | 2-1 | 169 | −10 | 10 | 1.9 |
| 521 | X | 11-2 | 12-1 | 2-2 | 172 | −21 | 11 | 2.0 |
| 522 | X | 11-2 | 12-1 | 2-3 | 170 | −11 | 15 | 1.8 |
| 523 | X | 11-2 | 12-1 | 2-4 | 174 | −14 | 11 | 1.3 |
| 524 | X | 11-2 | 12-1 | 2-5 | 172 | −16 | 9 | 1.9 |
| 525 | X | 11-2 | 12-2 | 2-2 | 170 | −18 | 15 | 1.7 |
| 526 | X | 11-2 | — | 2-2 | 199 | −14 | 8 | 1.0 |
| 527 | Ti | 11-2 | 12-1 | 2-2 | 211 | −10 | 10 | 1.8 |

TABLE 74

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 528 | X | 11-3 | 12-1 | 2-1 | 168 | −21 | 11 | 2.1 |
| 529 | X | 11-3 | 12-1 | 2-2 | 172 | −20 | 12 | 2.0 |
| 530 | X | 11-3 | 12-1 | 2-3 | 174 | −11 | 10 | 1.8 |
| 531 | X | 11-3 | 12-1 | 2-4 | 172 | −15 | 9 | 1.4 |
| 532 | X | 11-3 | 12-1 | 2-5 | 172 | −9 | 21 | 1.4 |
| 533 | X | 11-3 | 12-2 | 2-2 | 169 | −11 | 18 | 1.6 |
| 534 | X | 11-3 | — | 2-2 | 201 | −8 | 18 | 1.8 |
| 535 | Ti | 11-3 | 12-1 | 2-2 | 214 | −10 | 15 | 1.8 |

TABLE 75

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 536 | X | 11-4 | 12-1 | 2-1 | 172 | −13 | 15 | 1.5 |
| 537 | X | 11-4 | 12-1 | 2-2 | 174 | −21 | 9 | 2.1 |
| 538 | X | 11-4 | 12-1 | 2-3 | 173 | −20 | 12 | 1.8 |
| 539 | X | 11-4 | 12-1 | 2-4 | 174 | −18 | 19 | 2.0 |
| 540 | X | 11-4 | 12-1 | 2-5 | 172 | −13 | 20 | 1.4 |
| 541 | X | 11-4 | 12-2 | 2-2 | 176 | −19 | 20 | 1.8 |
| 542 | X | 11-4 | — | 2-2 | 196 | −11 | 18 | 1.7 |
| 543 | Ti | 11-4 | 12-1 | 2-2 | 210 | −9 | 16 | 2.0 |

TABLE 76

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 544 | X | 11-4 | 12-1 | 2-1 | 177 | −9 | 16 | 2.0 |
| 545 | X | 11-4 | 12-1 | 2-2 | 181 | −10 | 10 | 1.8 |
| 546 | X | 11-4 | 12-1 | 2-3 | 174 | −20 | 19 | 1.6 |
| 547 | X | 11-4 | 12-1 | 2-4 | 173 | −11 | 9 | 2.0 |
| 548 | X | 11-4 | 12-1 | 2-5 | 172 | −15 | 10 | 2.1 |
| 549 | X | 11-4 | 12-2 | 2-2 | 175 | −14 | 18 | 2.3 |

TABLE 76-continued

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 550 | X | 11-4 | — | 2-2 | 194 | −8 | 10 | 1.8 |
| 551 | Ti | 11-4 | 12-1 | 2-2 | 218 | −10 | 15 | 1.9 |
| COMP. EX. 34 | X | C | — | 2-2 | 268 | −68 | 30 | 3.9 |
| COMP. EX. 35 | X | 11-1 | — | A | 224 | −74 | 41 | 8.8 |
| COMP. EX. 36 | X | B | — | 2-2 | 276 | −101 | 34 | 4.1 |

(Single-layer type photosensitive material for analog light source)

Examples 552 to 580

According to the same manner as that described in Examples 320 to 551 except for using 5 parts by weight of a bisazo pigment represented by the formula (13) as the electric charge generating material, a single-layer type photosensitive material for analog light source was produced, respectively.

Concrete compounds of the hole transferring material, electron transferring material and binding resin used in the above respective Examples are shown in Tables 77 to 82, using the compound numbers of the above-described embodiments.

The single-layer type photosensitive material of the respective Examples was subjected to the above respective tests II and its characteristics were evaluated. The results are shown in Tables 77 to 82.

TABLE 77

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 552 | 13 | 6-1 | 12-1 | 2-2 | 212 | −21 | 10 | 2.0 |
| 553 | 13 | 6-2 | 12-1 | 2-2 | 101 | −18 | 8 | 2.9 |
| 554 | 13 | 6-3 | 12-1 | 2-2 | 211 | −11 | 13 | 2.7 |
| 555 | 13 | 6-4 | 12-1 | 2-2 | 209 | −8 | 11 | 3.0 |
| 556 | 13 | 6-5 | 12-1 | 2-2 | 214 | −15 | 10 | 2.9 |

TABLE 78

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 557 | 13 | 7-1 | 12-1 | 2-2 | 211 | −21 | 20 | 3.2 |
| 558 | 13 | 7-2 | 12-1 | 2-2 | 220 | −21 | 10 | 3.1 |
| 559 | 13 | 7-3 | 12-1 | 2-2 | 229 | −20 | 16 | 3.3 |
| 560 | 13 | 7-4 | 12-1 | 2-2 | 221 | −21 | 9 | 2.7 |
| 561 | 13 | 7-5 | 12-1 | 2-2 | 219 | −13 | 15 | 3.1 |
| 562 | 13 | 7-6 | 12-1 | 2-2 | 228 | −20 | 18 | 2.7 |
| 563 | 13 | 7-7 | 12-1 | 2-2 | 220 | −6 | 9 | 2.8 |

TABLE 79

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 564 | 13 | 8-1 | 12-1 | 2-2 | 226 | −20 | 8 | 2.8 |
| 565 | 13 | 8-2 | 12-1 | 2-2 | 221 | −7 | 16 | 2.6 |
| 566 | 13 | 8-3 | 12-1 | 2-2 | 218 | −11 | 9 | 3.1 |
| 567 | 13 | 8-4 | 12-1 | 2-2 | 222 | −11 | 23 | 2.7 |

TABLE 80

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 568 | 13 | 9-1 | 12-1 | 2-2 | 224 | −20 | 18 | 3.0 |
| 569 | 13 | 9-2 | 12-1 | 2-2 | 230 | −9 | 22 | 2.8 |
| 570 | 13 | 9-3 | 12-1 | 2-2 | 221 | −11 | 11 | 3.1 |
| 571 | 13 | 9-4 | 12-1 | 2-2 | 214 | −15 | 14 | 2.7 |

TABLE 81

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 572 | 13 | 10-1 | 12-1 | 2-2 | 221 | −19 | 14 | 2.2 |
| 573 | 13 | 10-2 | 12-1 | 2-2 | 225 | −21 | 15 | 1.9 |
| 574 | 13 | 10-3 | 12-1 | 2-2 | 230 | −19 | 10 | 1.4 |
| 575 | 13 | 10-4 | 12-1 | 2-2 | 228 | −13 | 9 | 1.3 |

TABLE 82

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 576 | 13 | 11-1 | 12-1 | 2-2 | 211 | −9 | 13 | 2.0 |
| 577 | 13 | 11-2 | 12-1 | 2-2 | 205 | −9 | 10 | 1.8 |
| 578 | 13 | 11-3 | 12-1 | 2-2 | 214 | −10 | 20 | 1.4 |
| 579 | 13 | 11-4 | 12-1 | 2-2 | 220 | −13 | 14 | 1.4 |
| 580 | 13 | 11-5 | 12-1 | 2-2 | 228 | −13 | 11 | 2.0 |

(Multi-layer type photosensitive material for digital light source)

Examples 581 to 609

According to the same manner as that described in Examples 262 to 290 except for using 100 parts by weight of a bisphenol Z type polycarbonate of the repeating unit represented by the formula (2-2), which has a substituent, as the binding resin, a multi-layer type photosensitive material for digital light source was produced, respectively.

Concrete compounds of the hole transferring material and binding resin used in the above respective Examples are shown in Tables 83 to 88, using the compound numbers of the above-described embodiments.

The multi-layer type photosensitive material of the respective Examples was subjected to the above respective tests III and its characteristics were evaluated. The results are shown in Tables 83 to 88.

TABLE 83

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 581 | 6-1 | 2-2 | −98 | −10 | 15 | 2.7 |
| 582 | 6-2 | 2-2 | −136 | −11 | 15 | 2.5 |
| 583 | 6-3 | 2-2 | −100 | −20 | 8 | 3.0 |
| 584 | 6-4 | 2-2 | −96 | −14 | 14 | 3.3 |
| 585 | 6-5 | 2-2 | −95 | −20 | 14 | 2.7 |

TABLE 84

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 586 | 7-1 | 2-2 | −94 | −20 | 11 | 3.4 |
| 587 | 7-2 | 2-2 | −104 | −9 | 8 | 3.3 |
| 588 | 7-3 | 2-2 | −101 | −16 | 10 | 3.3 |
| 589 | 7-4 | 2-2 | −98 | −8 | 18 | 2.8 |
| 590 | 7-5 | 2-2 | −99 | −10 | 20 | 2.9 |
| 591 | 7-6 | 2-2 | −107 | −15 | 16 | 3.0 |
| 592 | 7-7 | 2-2 | −99 | −10 | 10 | 2.7 |

TABLE 85

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 593 | 8-1 | 2-2 | −102 | −10 | 10 | 2.4 |
| 594 | 8-2 | 2-2 | −99 | −15 | 18 | 3.3 |
| 595 | 8-3 | 2-2 | −102 | −7 | 10 | 3.2 |
| 596 | 8-4 | 2-2 | −96 | −15 | 11 | 2.8 |

TABLE 86

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 597 | 9-1 | 2-2 | −107 | −10 | 15 | 3.1 |
| 598 | 9-2 | 2-2 | −108 | −13 | 18 | 2.5 |
| 599 | 9-3 | 2-2 | −102 | −20 | 23 | 3.0 |

TABLE 86-continued

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 600 | 9-4 | 2-2 | −99 | −18 | 15 | 2.9 |

TABLE 87

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 601 | 10-1 | 2-2 | −97 | −14 | 11 | 1.5 |
| 602 | 10-2 | 2-2 | −102 | −18 | 19 | 1.8 |
| 603 | 10-3 | 2-2 | −97 | −10 | 10 | 1.3 |
| 604 | 10-4 | 2-2 | −101 | −13 | 15 | 1.9 |

TABLE 88

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 605 | 11-1 | 2-2 | −98 | −14 | 19 | 1.8 |
| 606 | 11-2 | 2-2 | −100 | −9 | 15 | 1.6 |
| 607 | 11-3 | 2-2 | −99 | −14 | 18 | 1.2 |
| 608 | 11-4 | 2-2 | −101 | −15 | 13 | 1.9 |
| 609 | 11-5 | 2-2 | −99 | −10 | 10 | 2.1 |

(Multi-layer type photosensitive material for analog light source)

Examples 610 to 638

According to the same manner as that described in Examples 581 to 609 except for using 2 parts by weight of a bisazo pigment represented by the formula (13) as the electric charge generating material, a multi-layer type photosensitive material for analog light source was produced, respectively.

Concrete compounds of the hole transferring material and binding resin used in the above respective Examples are shown in Tables 89 to 94, using the compound numbers of the above-described embodiments.

The multi-layer type photosensitive material of the respective Examples was subjected to the above respective tests IV and its characteristics were evaluated. The results are shown in Tables 89 to 94.

TABLE 89

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 610 | 6-1 | 2-2 | −142 | −12 | 15 | 3.0 |
| 611 | 6-2 | 2-2 | −176 | −10 | 18 | 3.0 |
| 612 | 6-3 | 2-2 | −135 | −21 | 10 | 3.1 |
| 613 | 6-4 | 2-2 | −142 | −16 | 8 | 2.6 |
| 614 | 6-5 | 2-2 | −138 | −19 | 18 | 3.0 |

TABLE 90

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 615 | 7-1 | 2-2 | −132 | −10 | 8 | 2.8 |
| 616 | 7-2 | 2-2 | −139 | −13 | 15 | 2.9 |
| 617 | 7-3 | 2-2 | −142 | −20 | 13 | 3.4 |
| 618 | 7-4 | 2-2 | −136 | −13 | 15 | 3.0 |
| 619 | 7-5 | 2-2 | −141 | −14 | 19 | 2.9 |
| 620 | 7-6 | 2-2 | −140 | −8 | 14 | 3.0 |
| 621 | 7-7 | 2-2 | −141 | −15 | 13 | 2.9 |

TABLE 91

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 622 | 8-1 | 2-2 | −141 | −15 | 15 | 3.0 |
| 623 | 8-2 | 2-2 | −135 | −20 | 14 | 3.0 |
| 624 | 8-3 | 2-2 | −141 | −9 | 18 | 2.8 |
| 625 | 8-4 | 2-2 | −135 | −21 | 18 | 3.0 |

TABLE 92

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 626 | 9-1 | 2-2 | −141 | −8 | 16 | 2.9 |
| 627 | 9-2 | 2-2 | −144 | −16 | 13 | 3.1 |
| 628 | 9-3 | 2-2 | −138 | −21 | 11 | 2.6 |
| 629 | 9-4 | 2-2 | −142 | −9 | 10 | 3.0 |

TABLE 93

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 630 | 10-1 | 2-2 | −136 | −8 | 8 | 1.2 |
| 631 | 10-2 | 2-2 | −141 | −8 | 13 | 1.9 |
| 632 | 10-3 | 2-2 | −136 | −9 | 9 | 1.4 |
| 633 | 10-4 | 2-2 | −139 | −14 | 13 | 1.8 |

TABLE 94

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 634 | 11-1 | 2-2 | −139 | −8 | 10 | 1.9 |
| 635 | 11-2 | 2-2 | −142 | −11 | 8 | 2.1 |
| 636 | 11-3 | 2-2 | −138 | −15 | 16 | 1.9 |
| 637 | 11-4 | 2-2 | −142 | −10 | 18 | 1.6 |
| 638 | 11-5 | 2-2 | −139 | −12 | 9 | 1.4 |

(Single-layer type photosensitive material for digital light source)

Examples 639 to 646

According to the same manner as that described in Examples 1 to 40 except for using 100 parts by weight of a bisphenol Z type polycarbonate of the repeating unit represented by the formula (3) (viscosity-average: about 20,000 to 25,000) as the binding resin, a single-layer type photosensitive material for digital light source was produced, respectively.

Comparative Example 37

According to the same manner as that described in Examples 639 to 646 except for using 50 parts by weight of a carbazole hydrazone derivative represented by the formula (C) as the hole transferring material, a single-layer type photosensitive material for digital light source was produced.

Comparative Example 38

According to the same manner as that described in Examples 639 to 646 except for using 100 parts by weight of a bisphenol A type polycarbonate represented by the formula (A) as the binding resin, a single-layer type photosensitive material for digital light source was produced.

Comparative Example 39

According to the same manner as that described in Examples 639 to 646 except for using 50 parts by weight of a conventional benzidine derivative represented by the formula (B) as the hole transferring material, a single-layer type photosensitive material for digital light source was produced.

Incidentally, concrete compounds of the hole transferring material, electron transferring material and binding resin used in the above respective Examples and Comparative Examples are shown in Table 95, using the compound numbers of the above-described embodiments.

The single-layer type photosensitive material of the respective Examples and Comparative Examples was subjected to the above respective tests I and its characteristics were evaluated. The results are shown in Table 95.

TABLE 95

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 639 | X | 6-1 | 12-1 | 3 | 172 | −14 | 14 | 2.8 |
| 640 | X | 6-2 | 12-1 | 3 | 174 | −18 | 14 | 2.9 |
| 641 | X | 6-3 | 12-1 | 3 | 171 | −17 | 12 | 2.6 |
| 642 | X | 6-4 | 12-1 | 3 | 170 | −15 | 21 | 3.3 |
| 643 | X | 6-5 | 12-1 | 3 | 168 | −18 | 10 | 3.1 |
| 644 | X | 6-1 | 12-2 | 3 | 172 | −21 | 15 | 2.7 |
| 645 | X | 6-1 | — | 3 | 199 | −10 | 18 | 2.5 |
| 646 | Ti | 6-1 | 12-1 | 3 | 205 | −11 | 20 | 3.1 |
| COMP. EX. 37 | X | C | — | 3 | 266 | −84 | 36 | 4.2 |
| COMP. EX. 38 | X | 6-1 | — | A | 214 | −92 | 44 | 8.4 |
| COMP. EX. 39 | X | B | — | 3 | 274 | −98 | 37 | 4.4 |

Examples 647 to 657

According to the same manner as that described in Examples 639 to 646 except for using 50 parts by weight of a benzidine derivative represented by the formula (7) as the hole transferring material, a single-layer type photosensitive material for digital light source was produced, respectively.

Comparative Example 40

According to the same manner as that described in Examples 647 to 657 except for using 50 parts by weight of a carbazole hydrazone derivative represented by the formula (C) as the hole transferring material, a single-layer type photosensitive material for digital light source was produced.

Comparative Example 41

According to the same manner as that described in Examples 647 to 657 except for using 100 parts by weight of a bisphenol A type polycarbonate represented by the formula (A) as the binding resin, a single-layer type photosensitive material for digital light source was produced.

Comparative Example 42

According to the same manner as that described in Examples 647 to 657 except for using 50 parts by weight of a conventional benzidine derivative represented by the formula (B) as the hole transferring material, a single-layer type photosensitive material for digital light source was produced.

Incidentally, concrete compounds of the hole transferring material, electron transferring material and binding resin used in the above respective Examples and Comparative Examples are shown in Table 96, using the compound numbers of the above-described embodiments.

The single-layer type photosensitive material of the respective Examples and Comparative Examples was subjected to the above respective tests I and its characteristics were evaluated. The results are shown in Table 96.

TABLE 96

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 647 | X | 7-1 | 12-1 | 3 | 166 | −19 | 14 | 2.8 |
| 648 | X | 7-2 | 12-1 | 3 | 172 | −16 | 13 | 2.9 |
| 649 | X | 7-3 | 12-1 | 3 | 170 | −20 | 20 | 2.9 |
| 650 | X | 7-4 | 12-1 | 3 | 176 | −10 | 10 | 3.1 |
| 651 | X | 7-4 | 12-1 | 3 | 175 | −11 | 11 | 2.7 |
| 652 | X | 7-5 | 12-1 | 3 | 176 | −15 | 9 | 2.5 |
| 653 | X | 7-6 | 12-1 | 3 | 170 | −13 | 12 | 2.8 |
| 654 | X | 7-7 | 12-1 | 3 | 168 | −14 | 15 | 2.9 |
| 655 | X | 7-1 | 12-2 | 3 | 174 | −16 | 14 | 2.9 |
| 656 | X | 7-1 | — | 3 | 199 | −13 | 20 | 3.3 |
| 657 | Ti | 7-1 | 12-1 | 3 | 205 | −9 | 10 | 2.7 |
| COMP. EX. 40 | X | C | — | 3 | 284 | −92 | 44 | 4.1 |
| COMP. EX. 41 | X | 7-1 | — | A | 230 | −88 | 38 | 9.4 |
| COMP. EX. 42 | X | B | — | 3 | 277 | −105 | 40 | 4.3 |

Examples 658 to 664

According to the same manner as that described in Examples 639 to 646 except for using 50 parts by weight of a benzidine derivative represented by the formula (8) as the hole transferring material, a single-layer type photosensitive material for digital light source was produced, respectively.

Comparative Example 43

According to the same manner as that described in Examples 658 to 664 except for using 50 parts by weight of a carbazole hydrazone derivative represented by the formula (C) as the hole transferring material, a single-layer type photosensitive material for digital light source was produced.

Comparative Example 44

According to the same manner as that described in Examples 658 to 664 except for using 100 parts by weight of a bisphenol A type polycarbonate represented by the formula (A) as the binding resin, a single-layer type photosensitive material for digital light source was produced.

Comparative Example 45

According to the same manner as that described in Examples 658 to 664 except for using 50 parts by weight of a conventional benzidine derivative represented by the formula (B) as the hole transferring material, a single-layer type photosensitive material for digital light source was produced.

Incidentally, concrete compounds of the hole transferring material, electron transferring material and binding resin used in the above respective Examples and Comparative Examples are shown in Table 97, using the compound numbers of the above-described embodiments.

The single-layer type photosensitive material of the respective Examples and Comparative Examples was subjected to the above respective tests I and its characteristics were evaluated. The results are shown in Table 97.

TABLE 97

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 658 | X | 8-1 | 12-1 | 3 | 172 | −20 | 12 | 2.9 |
| 659 | X | 8-2 | 12-1 | 3 | 174 | −18 | 13 | 3.1 |
| 660 | X | 8-3 | 12-1 | 3 | 173 | −10 | 10 | 3.3 |
| 661 | X | 8-4 | 12-1 | 3 | 175 | −14 | 15 | 3.2 |
| 662 | X | 8-1 | 12-2 | 3 | 170 | −10 | 20 | 3.1 |
| 663 | X | 8-1 | — | 3 | 199 | −10 | 19 | 3.0 |
| 664 | Ti | 8-1 | 12-1 | 3 | 201 | −81 | 14 | 2.8 |
| COMP. EX. 43 | X | C | — | 3 | 284 | −85 | 41 | 4.3 |
| COMP. EX. 44 | X | 8-1 | — | A | 235 | −72 | 40 | 9.1 |
| COMP. EX. 45 | X | B | — | 3 | 282 | −111 | 34 | 4.9 |

Examples 665 to 671

According to the same manner as that described in Examples 639 to 646 except for using 50 parts by weight of a benzidine derivative represented by the formula (9) as the hole transferring material, a single-layer type photosensitive material for digital light source was produced, respectively..

Comparative Example 46

According to the same manner as that described in Examples 665 to 671 except for using 50 parts by weight of a carbazole hydrazone derivative represented by the formula (C) as the hole transferring material, a single-layer type photosensitive material for digital light source was produced.

Comparative Example 47

According to the same manner as that described in Examples 665 to 671 except for using 100 parts by weight of a bisphenol A type polycarbonate represented by the formula (A) as the binding resin, a single-layer type photosensitive material for digital light source was produced.

Comparative Example 48

According to the same manner as that described in Examples 665 to 671 except for using 50 parts by weight of a conventional benzidine derivative represented by the formula (B) as the hole transferring material, a single-layer type photosensitive material for digital light source was produced.

Incidentally, concrete compounds of the hole transferring material, electron transferring material and binding resin used in the above respective Examples and Comparative Examples are shown in Table 98, using the compound numbers of the above-described embodiments.

The single-layer type photosensitive material of the respective Examples and Comparative Examples was subjected to the above respective tests I and its characteristics were evaluated. The results are shown in Table 98.

TABLE 98

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 665 | X | 9-1 | 12-1 | 3 | 166 | −19 | 10 | 2.9 |
| 666 | X | 9-2 | 12-1 | 3 | 172 | −11 | 14 | 3.1 |
| 667 | X | 9-3 | 12-1 | 3 | 181 | −10 | 11 | 3.1 |
| 668 | X | 9-4 | 12-1 | 3 | 185 | −20 | 8 | 2.8 |
| 669 | X | 9-1 | 12-2 | 3 | 166 | −18 | 20 | 2.9 |
| 670 | X | 9-1 | — | 3 | 195 | −9 | 18 | 2.5 |
| 671 | Ti | 9-1 | 12-1 | 3 | 204 | −10 | 19 | 2.8 |
| COMP. EX. 46 | X | C | — | 3 | 268 | −92 | 40 | 4.8 |
| COMP. EX. 47 | X | 9-1 | — | A | 231 | −90 | 39 | 9.1 |
| COMP. EX. 48 | X | B | — | 3 | 284 | −110 | 35 | 4.5 |

Examples 672 to 678

According to the same manner as that described in Examples 639 to 646 except for using 50 parts by weight of an o-phenylenediamine derivative represented by the formula (10) as the hole transferring material, a single-layer type photosensitive material for digital light source was produced, respectively.

Comparative Example 49

According to the same manner as that described in Examples 672 to 678 except for using 50 parts by weight of a carbazole hydrazone derivative represented by the formula (C) as the hole transferring material, a single-layer type photosensitive material for digital light source was produced.

Comparative Example 50

According to the same manner as that described in Examples 672 to 678 except for using 100 parts by weight of a bisphenol A type polycarbonate represented by the formula (A) as the binding resin, a single-layer type photosensitive material for digital light source was produced.

Comparative Example 51

According to the same manner as that described in Examples 672 to 648 except for using 50 parts by weight of a conventional benzidine derivative represented by the formula (B) as the hole transferring material, a single-layer type photosensitive material for digital light source was produced.

Concrete compounds of the hole transferring material, electron transferring material and binding resin used in the above respective Examples and Comparative Examples are shown in Table 99, using the compound numbers of the above-described embodiments.

The single-layer type photosensitive material of the respective Examples and Comparative Examples was subjected to the above respective tests I and its characteristics were evaluated. The results are shown in Table 99.

TABLE 99

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 672 | X | 10-1 | 12-1 | 3 | 171 | −15 | 9 | 1.6 |
| 673 | X | 10-2 | 12-1 | 3 | 166 | −13 | 11 | 1.3 |
| 674 | X | 10-3 | 12-1 | 3 | 172 | −18 | 10 | 1.3 |
| 675 | X | 10-4 | 12-1 | 3 | 173 | −8 | 10 | 1.8 |
| 676 | X | 10-1 | 12-2 | 3 | 171 | −10 | 14 | 1.9 |
| 677 | X | 10-1 | — | 3 | 199 | −9 | 13 | 1.9 |
| 678 | Ti | 10-1 | 12-1 | 3 | 205 | −18 | 19 | 1.8 |
| COMP. EX. 49 | X | C | — | 3 | 284 | −80 | 38 | 3.2 |
| COMP. EX. 50 | X | 10-1 | — | A | 220 | −92 | 41 | 8.5 |
| COMP. EX. 51 | X | B | — | 3 | 269 | −92 | 35 | 3.5 |

Examples 679 to 686

According to the same manner as that described in Examples 639 to 646 except for using 50 parts by weight of a m-phenylenediamine derivative represented by the formula (11) as the hole transferring material, a single-layer type photosensitive material for digital light source was produced, respectively.

Comparative Example 52

According to the same manner as that described in Examples 679 to 686 except for using 50 parts by weight of a carbazole hydrazone derivative represented by the formula (C) as the hole transferring material, a single-layer type photosensitive material for digital light source was produced.

Concrete compounds of the hole transferring material, electron transferring material and binding resin used in the above respective Examples and Comparative Examples are shown in Table 100, using the compound numbers of the above-described embodiments.

The single-layer type photosensitive material of the respective Examples and Comparative Examples was subjected to the above respective tests I and its characteristics were evaluated. The results are shown in Table 100.

TABLE 100

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 679 | X | 11-1 | 12-1 | 3 | 168 | −10 | 7 | 1.2 |
| 680 | X | 11-2 | 12-1 | 3 | 172 | −11 | 14 | 1.4 |
| 681 | X | 11-3 | 12-1 | 3 | 171 | −15 | 10 | 1.9 |
| 682 | X | 11-4 | 12-1 | 3 | 172 | −10 | 13 | 1.8 |
| 683 | X | 11-5 | 12-1 | 3 | 173 | −19 | 11 | 1.9 |
| 684 | X | 11-1 | 12-2 | 3 | 174 | −21 | 20 | 2.2 |
| 685 | X | 11-1 | — | 3 | 199 | −11 | 21 | 1.3 |
| 686 | Ti | 11-1 | 12-1 | 3 | 205 | −18 | 12 | 1.8 |
| COMP. EX. 52 | X | C | — | 3 | 268 | −74 | 39 | 4.2 |
| COMP. EX. 53 | X | 11-1 | — | A | 220 | −81 | 35 | 9.5 |
| COMP. EX. 54 | X | B | — | 3 | 271 | −91 | 35 | 4.1 |

Comparative Example 53

According to the same manner as that described in Examples 679 to 686 except for using 100 parts by weight of a bisphenol A type polycarbonate represented by the formula (A) as the binding resin, a single-layer type photosensitive material for digital light source was produced.

Comparative Example 54

According to the same manner as that described in Examples 679 to 686 except for using 50 parts by weight of a conventional benzidine derivative represented by the formula (B) as the hole transferring material, a single-layer type photosensitive material for digital light source was produced.

(Single-layer type photosensitive material for analog light source)

Examples 687 to 692

According to the same manner as that described in Examples 639 to 686 except for using 5 parts by weight of a bisazo pigment represented by the formula (13) as the electric charge generating material, a single-layer type photosensitive material for analog light source was produced, respectively.

Concrete compounds of the hole transferring material, electron transferring material and binding resin used in the above respective Examples are shown in Table 101, using the compound numbers of the above-described embodiments.

The single-layer type photosensitive material of the respective Examples was subjected to the above respective tests II and its characteristics were evaluated. The results are shown in Table 101.

TABLE 101

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 687 | 13 | 6-1 | 12-1 | 3 | 211 | −18 | 13 | 3.8 |
| 688 | 13 | 7-1 | 12-1 | 3 | 220 | −21 | 19 | 2.9 |
| 689 | 13 | 8-1 | 12-1 | 3 | 215 | −12 | 19 | 2.9 |
| 690 | 13 | 9-1 | 12-1 | 3 | 215 | −21 | 9 | 3.0 |
| 691 | 13 | 10-1 | 12-1 | 3 | 221 | −15 | 18 | 1.3 |
| 692 | 13 | 11-1 | 12-1 | 3 | 220 | −13 | 13 | 1.7 |

(Multi-layer type photosensitive material for digital light source)

Examples 693 to 698

According to the same manner as that described in Examples 262 to 290 except for using 100 parts by weight of a bisphenol Z type polycarbonate of the repeating unit represented by the formula (3) as the binding resin, a multi-layer type photosensitive material for digital light source was produced, respectively.

Concrete compounds of the hole transferring material and binding resin used in the above respective Examples are shown in Table 102, using the compound numbers of the above-described embodiments.

The multi-layer type photosensitive material of the respective Examples was subjected to the above respective tests III and its characteristics were evaluated. The results are shown in Table 102.

TABLE 102

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 693 | 6-1 | 3 | −96 | −9 | 14 | 2.9 |
| 694 | 7-1 | 3 | −100 | −18 | 13 | 3.1 |
| 695 | 8-1 | 3 | −101 | −9 | 21 | 2.9 |
| 696 | 9-1 | 3 | −93 | −18 | 15 | 3.1 |
| 697 | 10-1 | 3 | −99 | −13 | 11 | 2.0 |
| 698 | 11-1 | 3 | −99 | −18 | 15 | 1.9 |

(Multi-layer type photosensitive material for analog light source)

Examples 699 to 704

According to the same manner as that described in Examples 693 to 698 except for using 2 parts by weight of a bisazo pigment represented by the formula (13) as the electric charge generating material, a multi-layer type photosensitive material for analog light source was produced, respectively.

Concrete compounds of the hole transferring material and binding resin used in the above respective Examples are shown in Table 103, using the compound numbers of the abovedescribed embodiments.

The multi-layer type photosensitive material of the respective Examples was subjected to the above respective tests IV and its characteristics were evaluated. The results are shown in Table 103.

TABLE 103

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 699 | 6-1 | 3 | −138 | −8 | 9 | 2.9 |
| 700 | 7-1 | 3 | −141 | −10 | 11 | 3.0 |
| 701 | 8-1 | 3 | −141 | −16 | 13 | 3.0 |
| 702 | 9-1 | 3 | −132 | −16 | 13 | 3.0 |
| 703 | 10-1 | 3 | −138 | −10 | 14 | 2.2 |
| 704 | 11-1 | 3 | −141 | −11 | 18 | 2.0 |

(Single-layer type photosensitive material for digital light source)

Examples 705 to 809

According to the same manner as that described in Examples 1 to 40 except for using 100 parts by weight of a bisphenol C type random copolymer type polycarbonate of the repeating unit represented by any one of the formulas (4,5-1) to (4,5-18) as the binding resin, a single-layer type photosensitive material for digital light source was produced, respectively.

In the respective polycarbonates, the composition ratio (molar ratio) of the component contained in the formula (4) to the component contained in the formula (5) is 8:2. Furthermore, the viscosity-average of the respective polycarbonates is within the range of 20,000 to 25,000.

Comparative Example 55

According to the same manner as that described in Examples 705 to 809 except for using 50 parts by weight of a carbazole hydrazone derivative represented by the formula (C) as the hole transferring material, a single-layer type photosensitive material for digital light source was produced.

Comparative Example 56

According to the same manner as that described in Examples 705 to 809 except for using 100 parts by weight of a bisphenol A type polycarbonate represented by the formula (A) as the binding resin, a single-layer type photosensitive material for digital light source was produced.

Comparative Example 57

According to the same manner as that described in Examples 705 to 809 except for using 50 parts by weight of a conventional benzidine derivative represented by the formula (B) as the hole transferring material, a single-layer type photosensitive material for digital light source was produced.

Concrete compounds of the hole transferring material, electron transferring material and binding resin used in the above respective Examples and Comparative Examples are shown in Tables 104 to 113, using the compound numbers of the above-described embodiments.

The single-layer type photosensitive material of the respective Examples and Comparative Examples was subjected to the above respective tests I and its characteristics were evaluated. The results are shown in Tables 104 to 113.

TABLE 104

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 705 | X | 6-1 | 12-1 | 4.5-1 | 169 | −15 | 18 | 3.1 |
| 706 | X | 6-1 | 12-1 | 4.5-2 | 174 | −21 | 12 | 3.2 |
| 707 | X | 6-1 | 12-1 | 4.5-3 | 171 | −24 | 11 | 2.9 |
| 708 | X | 6-1 | 12-1 | 4.5-4 | 172 | −25 | 19 | 3.3 |
| 709 | X | 6-1 | 12-1 | 4.5-5 | 174 | −13 | 14 | 3.5 |
| 710 | X | 6-1 | 12-1 | 4.5-6 | 173 | −12 | 13 | 3.2 |
| 711 | X | 6-1 | 12-1 | 4.5-7 | 165 | −11 | 19 | 3.5 |
| 712 | X | 6-1 | 12-1 | 4.5-8 | 166 | −15 | 20 | 3.1 |
| 713 | X | 6-1 | 12-1 | 4.5-9 | 169 | −18 | 10 | 3.0 |
| 714 | X | 6-1 | 12-1 | 4.5-10 | 174 | −19 | 11 | 2.9 |
| 715 | X | 6-1 | 12-1 | 4.5-11 | 181 | −17 | 14 | 2.8 |

TABLE 105

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 716 | X | 6-1 | 12-1 | 4.5-12 | 179 | −20 | 13 | 3.3 |
| 717 | X | 6-1 | 12-1 | 4.5-13 | 182 | −25 | 19 | 3.6 |
| 718 | X | 6-1 | 12-1 | 4.5-14 | 177 | −10 | 10 | 3.3 |
| 719 | X | 6-1 | 12-1 | 4.5-15 | 168 | −14 | 9 | 3.5 |
| 720 | X | 6-1 | 12-1 | 4.5-16 | 172 | −13 | 8 | 3.5 |
| 721 | X | 6-1 | 12-1 | 4.5-17 | 166 | −12 | 14 | 3.2 |
| 722 | X | 6-1 | 12-1 | 4.5-18 | 174 | −16 | 12 | 3.0 |
| 723 | X | 6-1 | 12-2 | 4.5-2 | 173 | −17 | 11 | 2.9 |
| 724 | X | 6-1 | — | 4.5-2 | 198 | −19 | 9 | 2.9 |
| 725 | Ti | 6-1 | 12-1 | 4.5-2 | 195 | −20 | 8 | 2.9 |

TABLE 106

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 726 | X | 6-2 | 12-1 | 4.5-1 | 180 | −12 | 13 | 3.3 |
| 727 | X | 6-2 | 12-1 | 4.5-2 | 177 | −10 | 12 | 3.1 |
| 728 | X | 6-2 | 12-1 | 4.5-3 | 175 | −14 | 16 | 3.3 |
| 729 | X | 6-2 | 12-1 | 4.5-4 | 176 | −9 | 18 | 3.4 |
| 730 | X | 6-2 | 12-1 | 4.5-5 | 175 | −13 | 17 | 2.5 |
| 731 | X | 6-2 | 12-1 | 4.5-6 | 177 | −12 | 16 | 2.8 |
| 732 | X | 6-2 | 12-1 | 4.5-7 | 174 | −11 | 13 | 2.7 |
| 733 | X | 6-2 | 12-1 | 4.5-8 | 169 | −10 | 12 | 3.4 |
| 734 | X | 6-2 | 12-1 | 4.5-9 | 170 | −18 | 19 | 3.3 |
| 735 | X | 6-2 | 12-1 | 4.5-10 | 172 | −21 | 14 | 3.5 |
| 736 | X | 6-2 | 12-1 | 4.5-11 | 173 | −20 | 12 | 3.4 |

TABLE 107

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 737 | X | 6-2 | 12-1 | 4.5-12 | 170 | −25 | 11 | 3.2 |
| 738 | X | 6-2 | 12-1 | 4.5-13 | 168 | −22 | 10 | 3.1 |
| 739 | X | 6-2 | 12-1 | 4.5-14 | 174 | −24 | 9 | 3.2 |
| 740 | X | 6-2 | 12-1 | 4.5-15 | 176 | −21 | 14 | 3.3 |
| 741 | X | 6-2 | 12-1 | 4.5-16 | 175 | −20 | 11 | 3.5 |
| 742 | X | 6-2 | 12-1 | 4.5-17 | 177 | −15 | 16 | 3.2 |
| 743 | X | 6-2 | 12-1 | 4.5-18 | 176 | −13 | 13 | 3.0 |
| 744 | X | 6-2 | 12-2 | 4.5-2 | 169 | −14 | 12 | 3.0 |
| 745 | X | 6-2 | — | 4.5-2 | 205 | −13 | 11 | 3.1 |
| 746 | Ti | 6-2 | 12-1 | 4.5-2 | 197 | −12 | 18 | 3.4 |

TABLE 108

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 747 | X | 6-3 | 12-1 | 4.5-1 | 172 | −19 | 20 | 2.9 |
| 748 | X | 6-3 | 12-1 | 4.5-2 | 176 | −20 | 9 | 2.8 |
| 749 | X | 6-3 | 12-1 | 4.5-3 | 177 | −11 | 14 | 2.9 |
| 750 | X | 6-3 | 12-1 | 4.5-4 | 175 | −18 | 13 | 3.0 |
| 751 | X | 6-3 | 12-1 | 4.5-5 | 176 | −17 | 15 | 3.0 |
| 752 | X | 6-3 | 12-1 | 4.5-6 | 181 | −17 | 21 | 3.5 |
| 753 | X | 6-3 | 12-1 | 4.5-7 | 184 | −12 | 12 | 3.3 |
| 754 | X | 6-3 | 12-1 | 4.5-8 | 179 | −9 | 13 | 3.2 |
| 755 | X | 6-3 | 12-1 | 4.5-9 | 181 | −13 | 11 | 3.3 |
| 756 | X | 6-3 | 12-1 | 4.5-10 | 180 | −8 | 15 | 3.1 |
| 757 | X | 6-3 | 12-1 | 4.5-11 | 179 | −5 | 16 | 3.4 |

TABLE 109

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 758 | X | 6-3 | 12-1 | 4.5-12 | 169 | −9 | 18 | 3.4 |
| 759 | X | 6-3 | 12-1 | 4.5-13 | 174 | −14 | 16 | 3.1 |
| 760 | X | 6-3 | 12-1 | 4.5-14 | 173 | −21 | 15 | 3.2 |
| 761 | X | 6-3 | 12-1 | 4.5-15 | 176 | −16 | 13 | 3.3 |
| 762 | X | 6-3 | 12-1 | 4.5-16 | 175 | −13 | 11 | 3.4 |
| 763 | X | 6-3 | 12-1 | 4.5-17 | 174 | −12 | 12 | 3.1 |
| 764 | X | 6-3 | 12-1 | 4.5-18 | 173 | −11 | 10 | 3.0 |
| 765 | X | 6-3 | 12-2 | 4.5-2 | 172 | −9 | 9 | 3.1 |
| 766 | X | 6-3 | — | 4.5-2 | 201 | −14 | 14 | 3.3 |
| 767 | Ti | 6-3 | 12-1 | 4.5-2 | 192 | −12 | 12 | 3.4 |

TABLE 110

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 768 | X | 6-4 | 12-1 | 4.5-1 | 181 | −14 | 13 | 3.2 |
| 769 | X | 6-4 | 12-1 | 4.5-2 | 179 | −12 | 15 | 3.3 |
| 770 | X | 6-4 | 12-1 | 4.5-3 | 174 | −14 | 13 | 3.6 |
| 771 | X | 6-4 | 12-1 | 4.5-4 | 173 | −13 | 16 | 3.5 |
| 772 | X | 6-4 | 12-1 | 4.5-5 | 176 | −11 | 11 | 3.2 |
| 773 | X | 6-4 | 12-1 | 4.5-6 | 171 | −9 | 14 | 3.3 |
| 774 | X | 6-4 | 12-1 | 4.5-7 | 173 | −8 | 13 | 3.1 |
| 775 | X | 6-4 | 12-1 | 4.5-8 | 174 | −14 | 12 | 3.0 |
| 776 | X | 6-4 | 12-1 | 4.5-9 | 176 | −13 | 15 | 2.9 |
| 777 | X | 6-4 | 12-1 | 4.5-10 | 175 | −11 | 13 | 3.4 |
| 778 | X | 6-4 | 12-1 | 4.5-11 | 174 | −10 | 11 | 3.3 |

TABLE 111

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 779 | X | 6-4 | 12-1 | 4.5-12 | 172 | −20 | 18 | 3.6 |
| 780 | X | 6-4 | 12-1 | 4.5-13 | 173 | −21 | 17 | 3.5 |
| 781 | X | 6-4 | 12-1 | 4.5-14 | 174 | −21 | 17 | 3.2 |
| 782 | X | 6-4 | 12-1 | 4.5-15 | 174 | −15 | 17 | 3.1 |
| 783 | X | 6-4 | 12-1 | 4.5-16 | 170 | −13 | 16 | 3.3 |
| 784 | X | 6-4 | 12-1 | 4.5-17 | 169 | −14 | 15 | 3.6 |
| 785 | X | 6-4 | 12-1 | 4.5-18 | 181 | −20 | 19 | 3.5 |
| 786 | X | 6-4 | 12-2 | 4.5-2 | 182 | 13 | 20 | 3.1 |
| 787 | X | 6-4 | — | 4.5-2 | 199 | −21 | 9 | 3.2 |
| 788 | Ti | 6-4 | 12-1 | 4.5-2 | 195 | −22 | 15 | 3.0 |

TABLE 112

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 789 | X | 6-5 | 12-1 | 4.5-1 | 169 | −15 | 16 | 3.1 |
| 790 | X | 6-5 | 12-1 | 4.5-2 | 177 | −12 | 13 | 3.2 |
| 791 | X | 6-5 | 12-1 | 4.5-3 | 174 | −11 | 12 | 3.2 |
| 792 | X | 6-5 | 12-1 | 4.5-4 | 168 | −14 | 9 | 3.0 |
| 793 | X | 6-5 | 12-1 | 4.5-5 | 170 | −13 | 20 | 3.1 |
| 794 | X | 6-5 | 12-1 | 4.5-6 | 171 | −19 | 15 | 2.9 |
| 795 | X | 6-5 | 12-1 | 4.5-7 | 176 | −12 | 15 | 3.4 |
| 796 | X | 6-5 | 12-1 | 4.5-8 | 182 | −9 | 10 | 3.3 |
| 797 | X | 6-5 | 12-1 | 4.5-9 | 179 | −11 | 15 | 2.6 |
| 798 | X | 6-5 | 12-1 | 4.5-10 | 181 | −10 | 16 | 2.9 |
| 799 | X | 6-5 | 12-1 | 4.5-11 | 169 | −10 | 13 | 2.8 |

TABLE 113

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 800 | X | 6-5 | 12-1 | 4.5-12 | 166 | −9 | 11 | 2.9 |
| 801 | X | 6-5 | 12-1 | 4.5-13 | 174 | −19 | 10 | 3.1 |
| 802 | X | 6-5 | 12-1 | 4.5-14 | 173 | −18 | 19 | 3.2 |
| 803 | X | 6-5 | 12-1 | 4.5-15 | 177 | −17 | 9 | 3.4 |
| 804 | X | 6-5 | 12-1 | 4.5-16 | 174 | −12 | 8 | 3.2 |
| 805 | X | 6-5 | 12-1 | 4.5-17 | 175 | −14 | 14 | 3.3 |
| 806 | X | 6-5 | 12-1 | 4.5-18 | 176 | −13 | 13 | 3.1 |
| 807 | X | 6-5 | 12-2 | 4.5-2 | 173 | −12 | 12 | 3.0 |
| 808 | X | 6-5 | — | 4.5-2 | 196 | −15 | 11 | 3.4 |
| 809 | Ti | 6-5 | 12-1 | 4.5-2 | 196 | −12 | 12 | 3.3 |
| COMP. EX. 55 | X | C | — | 4.5-1 | 266 | −81 | 43 | 4.4 |
| COMP. EX. 56 | X | 6-5 | — | A | 200 | −99 | 35 | 8.9 |
| COMP. EX. 57 | X | B | — | 4.5-1 | 270 | −92 | 36 | 4.1 |

Examples 810 to 956

According to the same manner as that described in Examples 705 to 809 except for using 50 parts by weight of a benzidine derivative represented by the formula (7) as the hole transferring material, a single-layer type photosensitive material for digital light source was produced, respectively.

Comparative Example 58

According to the same manner as that described in Examples 810 to 956 except for using 50 parts by weight of a carbazole hydrazone derivative represented by the formula (C) as the hole transferring material, a single-layer type photosensitive material for digital light source was produced.

Comparative Example 59

According to the same manner as that described in Examples 810 to 956 except for using 100 parts by weight of a bisphenol A type polycarbonate represented by the formula (A) as the binding resin, a single-layer type photosensitive material for digital light source was produced.

Comparative Example 60

According to the same manner as that described in Examples 810 to 956 except for using 50 parts by weight of a conventional benzidine derivative represented by the formula (B) as the hole transferring material, a single-layer type photosensitive material for digital light source was produced.

Concrete compounds of the hole transferring material, electron transferring material and binding resin used in the above respective Examples and Comparative Examples are shown in Tables 114 to 127, using the compound numbers of the above-described embodiments. The single-layer type photosensitive materials of the respective Examples and Comparative Examples were subjected to the above respective tests I and their characteristics were evaluated. The results are shown in Tables 114 to 127.

TABLE 114

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 810 | X | 7-1 | 12-1 | 4.5-1 | 181 | −23 | 9 | 3.4 |
| 811 | X | 7-1 | 12-1 | 4.5-2 | 169 | −28 | 11 | 3.2 |
| 812 | X | 7-1 | 12-1 | 4.5-3 | 183 | −6 | 15 | 3.0 |
| 813 | X | 7-1 | 12-1 | 4.5-4 | 185 | −10 | 9 | 3.3 |
| 814 | X | 7-1 | 12-1 | 4.5-5 | 171 | −24 | 21 | 2.9 |
| 815 | X | 7-1 | 12-1 | 4.5-6 | 167 | −23 | 20 | 2.9 |
| 816 | X | 7-1 | 12-1 | 4.5-7 | 173 | −28 | 11 | 2.8 |
| 817 | X | 7-1 | 12-1 | 4.5-8 | 169 | −26 | 15 | 3.2 |
| 818 | X | 7-1 | 12-1 | 4.5-9 | 183 | −24 | 15 | 3.4 |
| 819 | X | 7-1 | 12-1 | 4.5-10 | 169 | −21 | 16 | 2.7 |
| 820 | X | 7-1 | 12-1 | 4.5-11 | 171 | −10 | 17 | 2.6 |

TABLE 115

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 821 | X | 7-1 | 12-1 | 4.5-12 | 169 | −21 | 16 | 3.3 |
| 822 | X | 7-1 | 12-1 | 4.5-13 | 176 | −10 | 14 | 3.5 |
| 823 | X | 7-1 | 12-1 | 4.5-14 | 176 | −10 | 11 | 2.6 |
| 824 | X | 7-1 | 12-1 | 4.5-15 | 182 | −10 | 12 | 2.9 |
| 825 | X | 7-1 | 12-1 | 4.5-16 | 175 | −12 | 21 | 2.q |
| 826 | X | 7-1 | 12-1 | 4.5-17 | 174 | −14 | 14 | 2.6 |
| 827 | X | 7-1 | 12-1 | 4.5-18 | 181 | −13 | 16 | 3.4 |
| 828 | X | 7-1 | 12-1 | 4.5-2 | 176 | −21 | 22 | 2.7 |
| 829 | X | 7-1 | — | 4.5-2 | 194 | −7 | 24 | 2.8 |
| 830 | Ti | 7-1 | 12-1 | 4.5-2 | 195 | −19 | 25 | 3.5 |

TABLE 116

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 831 | X | 7-2 | 12-1 | 4.5-1 | 163 | −9 | 19 | 2.9 |
| 832 | X | 7-2 | 12-1 | 4.5-2 | 171 | −13 | 22 | 3.3 |
| 833 | X | 7-2 | 12-1 | 4.5-3 | 165 | −15 | 24 | 2.5 |
| 834 | X | 7-2 | 12-1 | 4.5-4 | 174 | −10 | 16 | 2.8 |
| 835 | X | 7-2 | 12-1 | 4.5-5 | 176 | −23 | 14 | 3.6 |
| 836 | X | 7-2 | 12-1 | 4.5-6 | 176 | −9 | 10 | 3.7 |
| 837 | X | 7-2 | 12-1 | 4.5-7 | 169 | −11 | 11 | 3.5 |
| 838 | X | 7-2 | 12-1 | 4.5-8 | 196 | −11 | 9 | 2.8 |
| 839 | X | 7-2 | 12-1 | 4.5-9 | 168 | −22 | 14 | 3.4 |
| 840 | X | 7-2 | 12-1 | 4.5-10 | 174 | −21 | 16 | 2.8 |
| 841 | X | 7-2 | 12-1 | 4.5-11 | 179 | −9 | 19 | 2.7 |

TABLE 117

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 842 | X | 7-2 | 12-1 | 4.5-12 | 171 | −24 | 24 | 3.2 |
| 843 | X | 7-2 | 12-1 | 4.5-13 | 173 | −10 | 19 | 3.5 |
| 844 | X | 7-2 | 12-1 | 4.5-14 | 176 | −25 | 9 | 2.9 |
| 845 | X | 7-2 | 12-1 | 4.5-15 | 171 | −14 | 24 | 3.4 |
| 846 | X | 7-2 | 12-1 | 4.5-16 | 167 | −16 | 14 | 3.2 |
| 847 | X | 7-2 | 12-1 | 4.5-17 | 162 | −21 | 12 | 2.9 |
| 848 | X | 7-2 | 12-1 | 4.5-18 | 162 | −21 | 11 | 2.7 |
| 849 | X | 7-2 | 12-2 | 4.5-2 | 163 | −21 | 22 | 2.8 |
| 850 | X | 7-2 | — | 4.5-2 | 196 | −9 | 16 | 3.4 |
| 851 | Ti | 7- 2 | 12-1 | 4.5-2 | 199 | −9 | 14 | 3.1 |

TABLE 118

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 852 | X | 7-3 | 12-1 | 4.5-1 | 140 | −20 | 10 | 2.9 |
| 853 | X | 7-3 | 12-1 | 4.5-2 | 105 | −21 | 9 | 3.4 |
| 854 | X | 7-3 | 12-1 | 4.5-3 | 173 | −10 | 20 | 3.1 |
| 855 | X | 7-3 | 12-1 | 4.5-4 | 171 | −8 | 10 | 3.2 |
| 856 | X | 7-3 | 12-1 | 4.5-5 | 182 | −22 | 8 | 2.7 |
| 857 | X | 7-3 | 12-1 | 4.5-6 | 179 | −23 | 19 | 2.7 |
| 858 | X | 7-3 | 12-1 | 4.5-7 | 179 | −9 | 17 | 2.9 |
| 859 | X | 7-3 | 12-1 | 4.5-8 | 180 | −8 | 10 | 2.9 |
| 860 | X | 7-3 | 12-1 | 4.5-9 | 174 | −15 | 14 | 2.9 |
| 861 | X | 7-3 | 12-1 | 4.5-10 | 162 | −14 | 12 | 3.3 |
| 862 | X | 7-3 | 12-1 | 4.5-11 | 168 | −12 | 18 | 3.1 |

TABLE 119

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 863 | X | 7-3 | 12-1 | 4.5-12 | 140 | −10 | 16 | 2.5 |
| 864 | X | 7-3 | 12-1 | 4.5-13 | 105 | −8 | 18 | 2.5 |
| 865 | X | 7-3 | 12-1 | 4.5-14 | 171 | −22 | 13 | 2.5 |
| 866 | X | 7-3 | 12-1 | 4.5-15 | 173 | −23 | 15 | 3.2 |
| 867 | X | 7-3 | 12-1 | 4.5-16 | 182 | −24 | 23 | 3.3 |
| 868 | X | 7-3 | 12-1 | 4.5-17 | 174 | −18 | 8 | 2.6 |
| 869 | X | 7-3 | 12-1 | 4.5-18 | 162 | −19 | 21 | 2.9 |
| 870 | X | 7-3 | 12-2 | 4.5-2 | 105 | −20 | 10 | 3.1 |
| 871 | X | 7-3 | — | 4.5-2 | 199 | −20 | 11 | 2.5 |
| 872 | Ti | 7-3 | 12-1 | 4.5-2 | 209 | −21 | 20 | 2.5 |

TABLE 120

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 873 | X | 7-4 | 12-1 | 4.5-1 | 173 | −24 | 23 | 2.5 |
| 874 | X | 7-4 | 12-1 | 4.5-2 | 167 | −7 | 25 | 3.1 |
| 875 | X | 7-4 | 12-1 | 4.5-3 | 171 | −8 | 24 | 3.3 |
| 876 | X | 7-4 | 12-1 | 4.5-4 | 165 | −13 | 21 | 3.4 |
| 877 | X | 7-4 | 12-1 | 4.5-5 | 169 | −12 | 9 | 2.6 |
| 878 | X | 7-4 | 12-1 | 4.5-6 | 181 | −19 | 19 | 2.7 |
| 879 | X | 7-4 | 12-1 | 4.5-7 | 183 | −20 | 20 | 3.3 |
| 880 | X | 7-4 | 12-1 | 4.5-8 | 176 | −21 | 8 | 3.6 |
| 881 | X | 7-4 | 12-1 | 4.5-9 | 169 | −10 | 8 | 2.7 |
| 882 | X | 7-4 | 12-1 | 4.5-10 | 171 | −8 | 8 | 2.6 |
| 883 | X | 7-4 | 12-1 | 4.5-11 | 169 | −6 | 8 | 3.5 |

TABLE 121

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 884 | X | 7-4 | 12-1 | 4.5-12 | 176 | −25 | 23 | 3.1 |
| 885 | X | 7-4 | 12-1 | 4.5-13 | 176 | −13 | 18 | 3.1 |
| 886 | X | 7-4 | 12-1 | 4.5-14 | 182 | −24 | 21 | 3.1 |
| 887 | X | 7-4 | 12-1 | 4.5-15 | 181 | −12 | 9 | 2.9 |
| 888 | X | 7-4 | 12-1 | 4.5-16 | 180 | −10 | 10 | 2.7 |
| 889 | X | 7-4 | 12-1 | 4.5-17 | 180 | −6 | 8 | 3.2 |
| 890 | X | 7-4 | 12-1 | 4.5-18 | 180 | −24 | 13 | 3.0 |
| 891 | X | 7-4 | 12-2 | 4.5-2 | 180 | −21 | 15 | 2.8 |
| 892 | X | 7-4 | — | 4.5-2 | 204 | −6 | 18 | 3.0 |
| 893 | Ti | 7-4 | 12-1 | 4.5-2 | 201 | −10 | 23 | 3.3 |

TABLE 122

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 894 | X | 7-5 | 12-1 | 4.5-1 | 171 | −4 | 8 | 3.1 |
| 895 | X | 7-5 | 12-1 | 4.5-2 | 176 | −20 | 10 | 3.4 |
| 896 | X | 7-5 | 12-1 | 4.5-3 | 181 | −16 | 14 | 2.9 |
| 897 | X | 7-5 | 12-1 | 4.5-4 | 174 | −21 | 9 | 3.1 |
| 898 | X | 7-5 | 12-1 | 4.5-5 | 175 | −24 | 20 | 3.2 |
| 899 | X | 7-5 | 12-1 | 4.5-6 | 182 | −23 | 21 | 2.8 |
| 900 | X | 7-5 | 12-1 | 4.5-7 | 176 | −28 | 19 | 2.8 |
| 901 | X | 7-5 | 12-1 | 4.5-8 | 176 | −26 | 17 | 2.7 |
| 902 | X | 7-5 | 12-1 | 4.5-9 | 169 | −24 | 10 | 2.9 |
| 903 | X | 7-5 | 12-1 | 4.5-10 | 171 | −21 | 12 | 3.1 |
| 904 | X | 7-5 | 12-1 | 4.5-11 | 169 | −6 | 14 | 3.3 |

TABLE 123

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 905 | X | 7-5 | 12-1 | 4.5-12 | 176 | −10 | 15 | 3.4 |
| 906 | X | 7-5 | 12-1 | 4.5-13 | 183 | −12 | 16 | 2.6 |
| 907 | X | 7-5 | 12-1 | 4.5-14 | 181 | −24 | 18 | 2.5 |
| 908 | X | 7-5 | 12-1 | 4.5-15 | 169 | −13 | 13 | 3.3 |
| 909 | X | 7-5 | 12-1 | 4.5-16 | 165 | −25 | 15 | 3.2 |
| 910 | X | 7-5 | 12-1 | 4.5-17 | 171 | −6 | 21 | 3.1 |
| 911 | X | 7-5 | 12-1 | 4.5-18 | 167 | −8 | 23 | 3.5 |
| 912 | X | 7-5 | 12-2 | 4.5-2 | 173 | −10 | 8 | 2.5 |
| 913 | X | 7-5 | — | 4.5-2 | 205 | −21 | 10 | 2.5 |
| 914 | Ti | 7-5 | 12-1 | 4.5-2 | 202 | −20 | 11 | 2.8 |

TABLE 124

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 915 | X | 7-6 | 12-1 | 4.5-1 | 171 | −12 | 21 | 3.1 |
| 916 | X | 7-6 | 12-1 | 4.5-2 | 163 | −8 | 23 | 3.3 |
| 917 | X | 7-6 | 12-1 | 4.5-3 | 165 | −7 | 24 | 3.4 |
| 918 | X | 7-6 | 12-1 | 4.5-4 | 167 | −24 | 21 | 2.6 |
| 919 | X | 7-6 | 12-1 | 4.5-5 | 171 | −21 | 9 | 2.7 |
| 920 | X | 7-6 | 12-1 | 4.5-6 | 174 | −20 | 19 | 3.3 |
| 921 | X | 7-6 | 12-1 | 4.5-7 | 176 | −19 | 20 | 3.4 |
| 922 | X | 7-6 | 12-1 | 4.5-8 | 173 | −18 | 8 | 2.6 |
| 923 | X | 7-6 | 12-1 | 4.5-9 | 176 | −24 | 9 | 2.7 |
| 924 | X | 7-6 | 12-1 | 4.5-10 | 169 | −23 | 21 | 2.6 |
| 925 | X | 7-6 | 12-1 | 4.5-11 | 162 | −22 | 23 | 2.7 |

TABLE 125

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 926 | X | 7-6 | 12-1 | 4.5-12 | 168 | −8 | 18 | 3.5 |
| 927 | X | 7-6 | 12-1 | 4.5-13 | 174 | −10 | 15 | 3.4 |
| 928 | X | 7-6 | 12-1 | 4.5-14 | 180 | −12 | 13 | 3.4 |
| 929 | X | 7-6 | 12-1 | 4.5-15 | 179 | −14 | 9 | 2.7 |
| 930 | X | 7-6 | 12-1 | 4.5-16 | 179 | −15 | 10 | 2.7 |
| 931 | X | 7-6 | 12-1 | 4.5-17 | 182 | −8 | 8 | 2.9 |
| 932 | X | 7-6 | 12-1 | 4.5-18 | 171 | −9 | 13 | 3.3 |
| 933 | X | 7-6 | 12-2 | 4.5-2 | 173 | −23 | 15 | 3.3 |
| 934 | X | 7-6 | – | 4.5-2 | 210 | −22 | 18 | 3.5 |
| 935 | Ti | 7-6 | 12-1 | 4.5-2 | 209 | −8 | 23 | 2.9 |

TABLE 126

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 936 | X | 7-7 | 12-1 | 4.5-1 | 167 | −9 | 20 | 2.8 |
| 937 | X | 7-7 | 12-1 | 4.5-2 | 163 | −5 | 5 | 3.3 |
| 938 | X | 7-7 | 12-1 | 4.5-3 | 172 | −13 | 18 | 2.8 |
| 939 | X | 7-7 | 12-1 | 4.5-4 | 183 | −25 | 8 | 2.6 |
| 940 | X | 7-7 | 12-1 | 4.5-5 | 180 | −24 | 15 | 2.9 |
| 941 | X | 7-7 | 12-1 | 4.5-6 | 164 | −11 | 20 | 3.9 |
| 942 | X | 7-7 | 12-1 | 4.5-7 | 166 | −19 | 18 | 3.1 |
| 943 | X | 7-7 | 12-1 | 4.5-8 | 175 | −10 | 5 | 2.7 |
| 944 | X | 7-7 | 12-1 | 4.5-9 | 161 | −22 | 19 | 3.2 |
| 945 | X | 7-7 | 12-1 | 4.5-10 | 182 | −18 | 21 | 3.3 |
| 946 | X | 7-7 | 12-1 | 4.5-11 | 166 | −7 | 6 | 3.3 |

TABLE 127

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 947 | X | 7-7 | 12-1 | 4.5-12 | 163 | −20 | 13 | 2.6 |
| 948 | X | 7-7 | 12-1 | 4.5-13 | 172 | −10 | 16 | 3.0 |
| 949 | X | 7-7 | 12-1 | 4.5-14 | 182 | −24 | 7 | 2.8 |
| 950 | X | 7-7 | 12-1 | 4.5-15 | 175 | −7 | 11 | 3.1 |
| 951 | X | 7-7 | 12-1 | 4.5-16 | 180 | −12 | 19 | 2.7 |
| 952 | X | 7-7 | 12-1 | 4.5-17 | 164 | −22 | 18 | 2.5 |
| 953 | X | 7-7 | 12-1 | 4.5-18 | 161 | −12 | 16 | 3.2 |
| 954 | X | 7-7 | 12-2 | 4.5-2 | 181 | −20 | 19 | 3.3 |
| 955 | X | 7-7 | — | 4.5-2 | 201 | −18 | 23 | 2.9 |
| 956 | Ti | 7-7 | 12-1 | 4.5-2 | 205 | −11 | 13 | 2.6 |
| COMP. EX. 58 | X | C | — | 4.5-1 | 264 | −74 | 40 | 4.9 |
| COMP. EX. 59 | X | 7-1 | — | A | 208 | −66 | 38 | 9.4 |
| COMP. EX. 60 | X | B | — | 4.5-1 | 284 | −100 | 36 | 4.6 |

Examples 957 to 1040

According to the same manner as that described in Examples 705 to 809 except for using 50 parts by weight of a benzidine derivative represented by the formula (8) as the hole transferring material, a single-layer type photosensitive material for digital light source was produced, respectively.

Comparative Example 61

According to the same manner as that described in Examples 957 to 1040 except for using 50 parts by weight of a carbazole hydrazone derivative represented by the formula (C) as the hole transferring material, a single-layer type photosensitive material for digital light source was produced.

Comparative Example 62

According to the same manner as that described in Examples 957 to 1040 except for using 100 parts by weight of a bisphenol A type polycarbonate represented by the formula (A) as the binding resin, a single-layer type photosensitive material for digital light source was produced.

Comparative Example 63

According to the same manner as that described in Examples 957 to 1040 except for using 50 parts by weight of a conventional benzidine derivative represented by the formula (B) as the hole transferring material, a single-layer type photosensitive material for digital light source was produced.

Concrete compounds of the hole transferring material, electron transferring material and binding resin used in the above respective Examples and Comparative Examples are shown in Tables 128 to 135, using the compound numbers of the above-described embodiments. The single-layer type photosensitive material of the respective Examples and Comparative Examples was subjected to the above respective tests I and its characteristics were evaluated. The results are shown in Tables 128 to 135.

TABLE 128

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 957 | X | 8-1 | 12-1 | 4.5-1 | 164 | −19 | 9 | 2.5 |
| 958 | X | 8-1 | 12-1 | 4.5-2 | 161 | −6 | 5 | 2.4 |
| 959 | X | 8-1 | 12-1 | 4.5-3 | 179 | −14 | 9 | 2.4 |
| 960 | X | 8-1 | 12-1 | 4.5-4 | 185 | −20 | 12 | 3.2 |
| 961 | X | 8-1 | 12-1 | 4.5-5 | 167 | −11 | 22 | 3.3 |
| 962 | X | 8-1 | 12-1 | 4.5-6 | 181 | −21 | 10 | 3.6 |
| 963 | X | 8-1 | 12-1 | 4.5-7 | 167 | −19 | 19 | 3.5 |
| 964 | X | 8-1 | 12-1 | 4.5-8 | 170 | −19 | 16 | 2.7 |
| 965 | X | 8-1 | 12-1 | 4.5-9 | 173 | −8 | 20 | 2.8 |
| 966 | X | 8-1 | 12-1 | 4.5-10 | 165 | −10 | 22 | 3.3 |
| 967 | X | 8-1 | 12-1 | 4.5-11 | 186 | −22 | 18 | 2.9 |

TABLE 129

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 968 | X | 8-1 | 12-1 | 4.5-12 | 179 | −9 | 14 | 2.5 |
| 969 | X | 8-1 | 12-1 | 4.5-13 | 161 | −14 | 15 | 3.0 |
| 970 | X | 8-1 | 12-1 | 4.5-14 | 172 | −20 | 6 | 2.5 |
| 971 | X | 8-1 | 12-1 | 4.5-15 | 179 | −17 | 15 | 2.4 |
| 972 | X | 8-1 | 12-1 | 4.5-16 | 162 | −11 | 10 | 3.0 |
| 973 | X | 8-1 | 12-1 | 4.5-17 | 180 | −23 | 19 | 3.2 |
| 974 | X | 8-1 | 12-1 | 4.5-18 | 170 | −9 | 7 | 3.6 |
| 975 | X | 8-1 | 12-2 | 4.5-2 | 168 | −20 | 8 | 3.0 |
| 976 | X | 8-1 | — | 4.5-2 | 201 | −5 | 24 | 3.5 |
| 977 | Ti | 8-1 | 12-1 | 4.5-2 | 196 | −14 | 22 | 3.3 |

TABLE 130

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 978 | X | 8-2 | 12-1 | 4.5-1 | 165 | −23 | 9 | 3.2 |
| 979 | X | 8-2 | 12-1 | 4.5-2 | 181 | −11 | 11 | 3.0 |
| 980 | X | 8-2 | 12-1 | 4.5-3 | 178 | −12 | 14 | 2.8 |
| 981 | X | 8-2 | 12-1 | 4.5-4 | 162 | −16 | 11 | 3.6 |
| 982 | X | 8-2 | 12-1 | 4.5-5 | 170 | −19 | 18 | 2.8 |
| 983 | X | 8-2 | 12-1 | 4.5-6 | 181 | −22 | 18 | 3.6 |
| 984 | X | 8-2 | 12-1 | 4.5-7 | 164 | −18 | 10 | 2.6 |
| 985 | X | 8-2 | 12-1 | 4.5-8 | 177 | −6 | 22 | 3.5 |
| 986 | X | 8-2 | 12-1 | 4.5-9 | 168 | −20 | 14 | 2.4 |
| 987 | X | 8-2 | 12-1 | 4.5-10 | 178 | −13 | 20 | 3.0 |
| 988 | X | 8-2 | 12-1 | 4.5-11 | 180 | −8 | 8 | 2.9 |

TABLE 131

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 989 | X | 8-2 | 12-1 | 4.5-12 | 160 | −18 | 19 | 3.2 |
| 990 | X | 8-2 | 12-1 | 4.5-13 | 184 | −22 | 25 | 3.5 |
| 991 | X | 8-2 | 12-1 | 4.5-14 | 169 | −13 | 9 | 3.3 |
| 992 | X | 8-2 | 12-1 | 4.5-15 | 178 | −22 | 16 | 2.9 |
| 993 | X | 8-2 | 12-1 | 4.5-16 | 165 | −23 | 16 | 2.9 |
| 994 | X | 8-2 | 12-1 | 4.5-17 | 167 | −8 | 10 | 2.8 |
| 995 | X | 8-2 | 12-1 | 4.5-18 | 181 | −14 | 18 | 3.3 |
| 996 | X | 8-2 | 12-2 | 4.5-2 | 179 | −6 | 22 | 3.5 |
| 997 | X | 8-2 | — | 4.5-2 | 199 | −20 | 8 | 2.4 |
| 998 | Ti | 8-2 | 12-1 | 4.5-2 | 194 | −13 | 20 | 2.9 |

TABLE 132

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 999 | X | 8-3 | 12-1 | 4.5-1 | 180 | −21 | 7 | 3.0 |
| 1000 | X | 8-3 | 12-1 | 4.5-2 | 163 | −7 | 23 | 3.2 |
| 1001 | X | 8-3 | 12-1 | 4.5-3 | 174 | −20 | 9 | 2.4 |
| 1002 | X | 8-3 | 12-1 | 4.5-4 | 174 | −6 | 5 | 2.9 |
| 1003 | X | 8-3 | 12-1 | 4.5-5 | 179 | −17 | 14 | 2.7 |
| 1004 | X | 8-3 | 12-1 | 4.5-6 | 180 | −8 | 11 | 2.7 |
| 1005 | X | 8-3 | 12-1 | 4.5-7 | 166 | −19 | 19 | 3.4 |
| 1006 | X | 8-3 | 12-1 | 4.5-8 | 162 | −5 | 8 | 2.6 |
| 1007 | X | 8-3 | 12-1 | 4.5-9 | 185 | −17 | 23 | 2.9 |
| 1008 | X | 8-3 | 12-1 | 4.5-10 | 179 | −22 | 19 | 2.6 |
| 1009 | X | 8-3 | 12-1 | 4.5-11 | 181 | −16 | 22 | 3.0 |

TABLE 133

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1010 | X | 8-3 | 12-1 | 4.5-12 | 181 | −19 | 6 | 3.0 |
| 1011 | X | 8-3 | 12-1 | 4.5-13 | 177 | −25 | 19 | 3.4 |
| 1012 | X | 8-3 | 12-1 | 4.5-14 | 163 | −21 | 11 | 2.7 |
| 1013 | X | 8-3 | 12-1 | 4.5-15 | 178 | −20 | 9 | 3.1 |
| 1014 | X | 8-3 | 12-1 | 4.5-16 | 181 | −23 | 23 | 3.3 |
| 1015 | X | 8-3 | 12-1 | 4.5-17 | 176 | −17 | 17 | 2.6 |
| 1016 | X | 8-3 | 12-1 | 4.5-18 | 172 | −10 | 19 | 2.4 |
| 1017 | X | 8-3 | 12-2 | 4.5-2 | 177 | −7 | 22 | 2.9 |
| 1018 | X | 8-3 | — | 4.5-2 | 190 | −11 | 20 | 2.9 |
| 1019 | Ti | 8-3 | 12-1 | 4.5-2 | 199 | −13 | 7 | 3.1 |

TABLE 134

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1020 | X | 8-4 | 12-1 | 4.5-1 | 176 | −16 | 18 | 3.4 |
| 1021 | X | 8-4 | 12-1 | 4.5-2 | 177 | −20 | 23 | 2.9 |
| 1022 | X | 8-4 | 12-1 | 4.5-3 | 180 | −9 | 11 | 3.1 |
| 1023 | X | 8-4 | 12-1 | 4.5-4 | 163 | −19 | 18 | 2.8 |
| 1024 | X | 8-4 | 12-1 | 4.5-5 | 180 | −22 | 7 | 3.3 |
| 1025 | X | 8-4 | 12-1 | 4.5-6 | 176 | −23 | 20 | 2.4 |
| 1026 | X | 8-4 | 12-1 | 4.5-7 | 185 | −7 | 16 | 3.2 |
| 1027 | X | 8-4 | 12-1 | 4.5-8 | 178 | −19 | 12 | 2.5 |
| 1028 | X | 8-4 | 12-1 | 4.5-9 | 180 | −15 | 19 | 3.6 |
| 1029 | X | 8-4 | 12-1 | 4.5-10 | 181 | −16 | 24 | 2.9 |
| 1030 | X | 8-4 | 12-1 | 4.5-11 | 166 | −21 | 25 | 2.5 |

TABLE 135

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1031 | X | 8-4 | 12-1 | 4.5-12 | 163 | −8 | 15 | 2.6 |
| 1032 | X | 8-4 | 12-1 | 4.5-13 | 160 | −20 | 7 | 2.8 |
| 1033 | X | 8-4 | 12-1 | 4.5-14 | 178 | −17 | 18 | 3.3 |
| 1034 | X | 8-4 | 12-1 | 4.5-15 | 172 | −11 | 21 | 3.0 |
| 1035 | X | 8-4 | 12-1 | 4.5-16 | 161 | −21 | 17 | 2.9 |
| 1036 | X | 8-4 | 12-1 | 4.5-17 | 174 | −6 | 5 | 2.6 |
| 1037 | X | 8-4 | 12-1 | 4.5-18 | 183 | −15 | 14 | 2.8 |
| 1038 | X | 8-4 | 12-2 | 4.5-2 | 179 | −11 | 16 | 2.5 |
| 1039 | X | 8-4 | — | 4.5-2 | 194 | −13 | 6 | 3.0 |
| 1040 | Ti | 8-4 | 12-1 | 4.5-2 | 192 | −22 | 19 | 3.1 |
| COMP. EX. 61 | X | C | — | 4.5-1 | 280 | −84 | 34 | 4.4 |
| COMP. EX. 62 | X | 8-1 | — | A | 214 | −69 | 29 | 9.6 |
| COMP. EX. 63 | X | B | — | 4.5-1 | 275 | −94 | 31 | 4.2 |

Examples 1041 to 1124

According to the same manner as that described in Examples 705 to 809 except for using 50 parts by weight of a benzidine derivative represented by the formula (9) as the hole transferring material, a single-layer type photosensitive material for digital light source was produced, respectively.

Comparative Example 64

According to the same manner as that described in Examples 1041 to 1124 except for using 50 parts by weight of a carbazole hydrazone derivative represented by the formula (C) as the hole transferring material, a single-layer type photosensitive material for digital light source was produced.

Comparative Example 65

According to the same manner as that described in Examples 1041 to 1124 except for using 100 parts by weight of a bisphenol A type polycarbonate represented by the formula (A) as the binding resin, a single-layer type photosensitive material for digital light source was produced.

Comparative Example 66

According to the same manner as that described in Examples 1041 to 1124 except for using 50 parts by weight of a conventional benzidine derivative represented by the formula (B) as the hole transferring material, a single-layer type photosensitive material for digital light source was produced.

Concrete compounds of the hole transferring material, electron transferring material and binding resin used in the above respective Examples and Comparative Examples were shown in Tables 136 to 143, using the compound numbers of the above-described embodiments. The single-layer type photosensitive material of the respective Examples and Comparative Examples was subjected to the above respective tests I and its characteristics were evaluated. The results are shown in Tables 136 to 143.

TABLE 136

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1041 | X | 9-1 | 12-1 | 4.5-1 | 168 | −20 | 9 | 3.8 |
| 1042 | X | 9-1 | 12-1 | 4.5-2 | 183 | −18 | 12 | 2.4 |
| 1043 | X | 9-1 | 12-1 | 4.5-3 | 176 | −12 | 18 | 3.3 |
| 1044 | X | 9-1 | 12-1 | 4.5-4 | 174 | −21 | 21 | 2.6 |
| 1045 | X | 9-1 | 12-1 | 4.5-5 | 180 | −25 | 6 | 2.4 |
| 1046 | X | 9-1 | 12-1 | 4.5-6 | 163 | −19 | 17 | 3.0 |
| 1047 | X | 9-1 | 12-1 | 4.5-7 | 182 | −24 | 21 | 2.6 |
| 1048 | X | 9-1 | 12-1 | 4.5-8 | 176 | −20 | 11 | 3.2 |
| 1049 | X | 9-1 | 12-1 | 4.5-9 | 180 | −9 | 18 | 3.6 |
| 1050 | X | 9-1 | 12-1 | 4.5-10 | 175 | −21 | 19 | 2.9 |
| 1051 | X | 9-1 | 12-1 | 4.5-11 | 160 | −12 | 12 | 3.0 |

TABLE 137

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1052 | X | 9-1 | 12-1 | 4.5-12 | 161 | −17 | 7 | 2.9 |
| 1053 | X | 9-1 | 12-1 | 4.5-13 | 172 | −21 | 12 | 2.8 |
| 1054 | X | 9-1 | 12-1 | 4.5-14 | 170 | −8 | 17 | 2.9 |

TABLE 137-continued

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1055 | X | 9-1 | 12-1 | 4.5-15 | 165 | −19 | 20 | 3.5 |
| 1056 | X | 9-1 | 12-1 | 4.5-16 | 178 | −6 | 9 | 3.2 |
| 1057 | X | 9-1 | 12-1 | 4.5-17 | 179 | −10 | 20 | 3.0 |
| 1058 | X | 9-1 | 12-1 | 4.5-18 | 163 | −12 | 21 | 3.3 |
| 1059 | X | 9-1 | 12-2 | 4.5-2 | 162 | −20 | 8 | 3.5 |
| 1060 | X | 9-1 | — | 4.5-2 | 201 | −5 | 13 | 3.1 |
| 1061 | Ti | 9-1 | 12-1 | 4.5-2 | 201 | −16 | 19 | 2.4 |

TABLE 138

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1062 | X | 9-2 | 12-1 | 4.5-1 | 175 | −7 | 8 | 2.6 |
| 1063 | X | 9-2 | 12-1 | 4.5-2 | 178 | −19 | 11 | 3.3 |
| 1064 | X | 9-2 | 12-1 | 4.5-3 | 180 | −14 | 20 | 3.3 |
| 1065 | X | 9-2 | 12-1 | 4.5-4 | 171 | −17 | 12 | 3.5 |
| 1066 | X | 9-2 | 12-1 | 4.5-5 | 166 | −21 | 19 | 2.6 |
| 1067 | X | 9-2 | 12-1 | 4.5-6 | 180 | −8 | 11 | 3.1 |
| 1068 | X | 9-2 | 12-1 | 4.5-7 | 168 | −18 | 16 | 2.4 |
| 1069 | X | 9-2 | 12-1 | 4.5-8 | 177 | −24 | 9 | 3.2 |
| 1070 | X | 9-2 | 12-1 | 4.5-9 | 175 | −9 | 17 | 3.2 |
| 1071 | X | 9-2 | 12-1 | 4.5-10 | 169 | −11 | 23 | 2.9 |
| 1072 | X | 9-2 | 12-1 | 4.5-11 | 172 | −16 | 10 | 3.0 |

TABLE 139

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1073 | X | 9-2 | 12-1 | 4.5-12 | 168 | −24 | 20 | 2.5 |
| 1074 | X | 9-2 | 12-1 | 4.5-13 | 166 | −21 | 25 | 2.4 |
| 1075 | X | 9-2 | 12-1 | 4.5-14 | 171 | −14 | 11 | 3.0 |
| 1076 | X | 9-2 | 12-1 | 4.5-15 | 176 | −21 | 17 | 2.6 |
| 1077 | X | 9-2 | 12-1 | 4.5-16 | 181 | −22 | 15 | 3.3 |
| 1078 | X | 9-2 | 12-1 | 4.5-17 | 172 | −17 | 8 | 2.9 |
| 1079 | X | 9-2 | 12-1 | 4.5-18 | 183 | −20 | 18 | 2.6 |
| 1080 | X | 9-2 | 12-2 | 4.5-2 | 169 | −12 | 13 | 3.0 |
| 1081 | X | 9-2 | — | 4.5-2 | 196 | −23 | 23 | 2.8 |
| 1082 | Ti | 9-2 | 12-1 | 4.5-2 | 204 | −24 | 18 | 3.5 |

TABLE 140

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1083 | X | 9-3 | 12-1 | 4.5-1 | 177 | −14 | 9 | 3.0 |
| 1084 | X | 9-3 | 12-1 | 4.5-2 | 169 | −19 | 20 | 2.4 |
| 1085 | X | 9-3 | 12-1 | 4.5-3 | 160 | −22 | 13 | 3.2 |
| 1086 | X | 9-3 | 12-1 | 4.5-4 | 183 | −15 | 25 | 3.6 |
| 1087 | X | 9-3 | 12-1 | 4.5-5 | 171 | −20 | 21 | 2.4 |
| 1088 | X | 9-3 | 12-1 | 4.5-6 | 178 | −19 | 11 | 2.9 |
| 1089 | X | 9-3 | 12-1 | 4.5-7 | 162 | −8 | 14 | 2.7 |
| 1090 | X | 9-3 | 12-1 | 4.5-8 | 171 | −16 | 10 | 2.6 |
| 1091 | X | 9-3 | 12-1 | 4.5-9 | 180 | −14 | 9 | 3.3 |
| 1092 | X | 9-3 | 12-1 | 4.5-10 | 165 | −19 | 18 | 3.2 |
| 1093 | X | 9-3 | 12-1 | 4.5-11 | 165 | −23 | 14 | 2.5 |

TABLE 141

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1094 | X | 9-3 | 12-1 | 4.5-12 | 176 | −7 | 19 | 2.9 |
| 1095 | X | 9-3 | 12-1 | 4.5-13 | 171 | −21 | 8 | 3.5 |
| 1096 | X | 9-3 | 12-1 | 4.5-14 | 181 | −22 | 23 | 2.4 |
| 1097 | X | 9-3 | 12-1 | 4.5-15 | 166 | −11 | 22 | 2.6 |
| 1098 | X | 9-3 | 12-1 | 4.5-16 | 170 | −13 | 21 | 2..9 |
| 1099 | X | 9-3 | 12-1 | 4.5-17 | 168 | −8 | 18 | 2.9 |
| 1100 | X | 9-3 | 12-1 | 4.5-18 | 179 | −23 | 17 | 3.6 |
| 1101 | X | 9-3 | 12-2 | 4.5-2 | 183 | −16 | 14 | 2.8 |
| 1102 | X | 9-3 | — | 4.5-2 | 210 | −20 | 19 | 2.8 |
| 1103 | Ti | 9-3 | 12-1 | 4.5-2 | 206 | −11 | 9 | 3.2 |

TABLE 142

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1104 | X | 9-4 | 12-1 | 4.5-1 | 171 | −22 | 21 | 2.6 |
| 1105 | X | 9-4 | 12-1 | 4.5-2 | 180 | −5 | 13 | 2.9 |
| 1106 | X | 9-4 | 12-1 | 4.5-3 | 162 | −8 | 23 | 3.3 |
| 1107 | X | 9-4 | 12-1 | 4.5-4 | 176 | −19 | 8 | 2.6 |
| 1108 | X | 9-4 | 12-1 | 4.5-5 | 179 | −16 | 18 | 3.1 |
| 1109 | X | 9-4 | 12-1 | 4.5-6 | 170 | −16 | 19 | 3.2 |
| 1110 | X | 9-4 | 12-1 | 4.5-7 | 185 | −5 | 14 | 3.6 |
| 1111 | X | 9-4 | 12-1 | 4.5-8 | 167 | −18 | 20 | 2.7 |
| 1112 | X | 9-4 | 12-1 | 4.5-9 | 173 | −23 | 13 | 3.3 |
| 1113 | X | 9-4 | 12-1 | 4.5-10 | 179 | −6 | 21 | 3.0 |
| 1114 | X | 9-4 | 12-1 | 4.5-11 | 180 | −19 | 12 | 2.7 |

TABLE 143

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1115 | X | 9-4 | 12-1 | 4.5-12 | 168 | −15 | 9 | 3.2 |
| 1116 | X | 9-4 | 12-1 | 4.5-13 | 162 | −20 | 6 | 2.9 |
| 1117 | X | 9-4 | 12-1 | 4.5-14 | 176 | −19 | 19 | 2.6 |
| 1118 | X | 9-4 | 12-1 | 4.5-15 | 167 | −21 | 10 | 3.6 |
| 1119 | X | 9-4 | 12-1 | 4.5-16 | 183 | −23 | 6 | 3.3 |
| 1120 | X | 9-4 | 12-1 | 4.5-17 | 173 | −8 | 22 | 2.9 |
| 1121 | X | 9-4 | 12-1 | 4.5-18 | 180 | −10 | 25 | 3.1 |
| 1122 | X | 9-4 | 12-2 | 4.5-2 | 181 | −11 | 18 | 2.9 |
| 1123 | X | 9-4 | — | 4.5-2 | 200 | −20 | 14 | 2.7 |
| 1124 | Ti | 9-4 | 12-1 | 4.5-2 | 201 | −15 | 8 | 2.8 |
| COMP. EX. 64 | X | C | — | 4.5-1 | 288 | −80 | 41 | 4.7 |
| COMP. EX. 65 | X | 9-1 | — | A | 211 | −85 | 39 | 9.1 |
| COMP. EX. 66 | X | B | — | 4.5-1 | 269 | −92 | 31 | 4.4 |

Examples 1125 to 1208

According to the same manner as that described in Examples 705 to 809 except for using 50 parts by weight of an o-phenylenediamine derivative represented by the formula (10) as the hole transferring material, a single-layer type photosensitive material for digital light source was produced, respectively.

Comparative Example 67

According to the same manner as that described in Examples 1125 to 1208 except for using 50 parts by weight of a carbazole hydrazone derivative represented by the formula (C) as the hole transferring material, a single-layer type photosensitive material for digital light source was produced.

Comparative Example 68

According to the same manner as that described in Examples 1125 to 1208 except for using 100 parts by weight of a bisphenol A type polycarbonate represented by the formula (A) as the binding resin, a single-layer type photosensitive material for digital light source was produced.

Comparative Example 69

According to the same manner as that described in Examples 1125 to 1208 except for using 50 parts by weight of a conventional benzidine derivative represented by the formula (B) as the hole transferring material, a single-layer type photosensitive material for digital light source was produced.

Concrete compounds of the hole transferring material, electron transferring material and binding resin used in the above respective Examples and Comparative Examples are shown in Tables 144 to 151, using the compound numbers of the above-described embodiments. The single-layer type photosensitive material of the respective Examples and Comparative Examples was subjected to the above respective tests I and its characteristics were evaluated. The results are shown in Tables 144 to 151.

TABLE 144

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1125 | X | 10-1 | 12-1 | 4.5-1 | 170 | −11 | 12 | 1.7 |
| 1126 | X | 10-1 | 12-1 | 4.5-2 | 182 | −22 | 8 | 1.2 |
| 1127 | X | 10-1 | 12-1 | 4.5-3 | 161 | −6 | 5 | 1.5 |
| 1128 | X | 10-1 | 12-1 | 4.5-4 | 178 | −20 | 14 | 2.0 |
| 1129 | X | 10-1 | 12-1 | 4.5-5 | 166 | −10 | 11 | 2.1 |
| 1130 | X | 10-1 | 12-1 | 4.5-6 | 160 | −24 | 16 | 1.4 |
| 1131 | X | 10-1 | 12-1 | 4.5-7 | 169 | −11 | 20 | 2.0 |
| 1132 | X | 10-1 | 12-1 | 4.5-8 | 162 | −12 | 6 | 1.5 |
| 1133 | X | 10-1 | 12-1 | 4.5-9 | 175 | −9 | 18 | 1.4 |
| 1134 | X | 10-1 | 12-1 | 4.5-10 | 163 | −18 | 11 | 1.8 |
| 1135 | X | 10-1 | 12-1 | 4.5-11 | 184 | −13 | 16 | 2.0 |

TABLE 145

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1136 | X | 10-1 | 12-1 | 4.5-12 | 180 | −20 | 22 | 2.2 |
| 1137 | X | 10-1 | 12-1 | 4.5-13 | 175 | −7 | 7 | 1.6 |
| 1138 | X | 10-1 | 12-1 | 4.5-14 | 180 | −6 | 23 | 1.3 |
| 1139 | X | 10-1 | 12-1 | 4.5-15 | 161 | −24 | 19 | 1.5 |
| 1140 | X | 10-1 | 12-1 | 4.5-16 | 177 | −12 | 12 | 1.7 |
| 1141 | X | 10-1 | 12-1 | 4.5-17 | 177 | −20 | 13 | 1.7 |
| 1142 | X | 10-1 | 12-1 | 4.5-18 | 170 | −10 | 21 | 1.9 |
| 1143 | X | 10-1 | 12-2 | 4.5-2 | 179 | −10 | 7 | 1.3 |
| 1144 | X | 10-1 | — | 4.5-2 | 211 | −9 | 24 | 1.8 |
| 1145 | Ti | 10-1 | 12-1 | 4.5-2 | 209 | −23 | 16 | 1.4 |

TABLE 146

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1146 | X | 10-2 | 12-1 | 4.5-1 | 166 | −19 | 19 | 1.2 |
| 1147 | X | 10-2 | 12-1 | 4.5-2 | 175 | −23 | 12 | 2.2 |
| 1148 | X | 10-2 | 12-1 | 4.5-3 | 163 | −10 | 25 | 1.7 |
| 1149 | X | 10-2 | 12-1 | 4.5-4 | 184 | −18 | 10 | 1.6 |
| 1150 | X | 10-2 | 12-1 | 4.5-5 | 161 | −7 | 9 | 1.3 |
| 1151 | X | 10-2 | 12-1 | 4.5-6 | 169 | −18 | 13 | 1.5 |
| 1152 | X | 10-2 | 12-1 | 4.5-7 | 173 | −20 | 21 | 1.7 |
| 1153 | X | 10-2 | 12-1 | 4.5-8 | 177 | −15 | 17 | 2.2 |
| 1154 | X | 10-2 | 12-1 | 4.5-9 | 168 | −22 | 23 | 2.1 |
| 1155 | X | 10-2 | 12-1 | 4.5-10 | 164 | −12 | 15 | 1.6 |
| 1156 | X | 10-2 | 12-1 | 4.5-11 | 163 | −19 | 12 | 1.2 |

TABLE 147

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1157 | X | 10-2 | 12-1 | 4.5-12 | 173 | −25 | 20 | 1.2 |
| 1158 | X | 10-2 | 12-1 | 4.5-13 | 170 | −5 | 22 | 2.0 |
| 1159 | X | 10-2 | 12-1 | 4.5-14 | 166 | −18 | 25 | 1.9 |
| 1160 | X | 10-2 | 12-1 | 4.5-15 | 182 | −12 | 8 | 2.0 |
| 1161 | X | 10-2 | 12-1 | 4.5-16 | 173 | −18 | 12 | 1.2 |
| 1162 | X | 10-2 | 12-1 | 4.5-17 | 178 | −22 | 9 | 1.6 |

TABLE 147-continued

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1163 | X | 10-2 | 12-1 | 4.5-18 | 184 | −10 | 1.6 | 1.2 |
| 1164 | X | 10-2 | 12-2 | 4.5-2 | 160 | −22 | 1.7 | 2.0 |
| 1165 | X | 10-2 | — | 4.5-2 | 204 | −5 | 2.1 | 1.8 |
| 1166 | Ti | 10-2 | 12- | 4.5-2 | 214 | −20 | 1.4 | 2.1 |

TABLE 148

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1167 | X | 10-3 | 12-1 | 4.5-1 | 165 | −8 | 10 | 1.3 |
| 1168 | X | 10-3 | 12-1 | 4.5-2 | 185 | −5 | 15 | 1.4 |
| 1169 | X | 10-3 | 12-1 | 4.5-3 | 163 | −7 | 20 | 1.2 |
| 1170 | X | 10-3 | 12-1 | 4.5-4 | 179 | −25 | 5 | 1.9 |
| 1171 | X | 10-3 | 12-1 | 4.5-5 | 185 | −10 | 19 | 2.0 |
| 1172 | X | 10-3 | 12-1 | 4.5-6 | 165 | −13 | 9 | 1.4 |
| 1173 | X | 10-3 | 12-1 | 4.5-7 | 168 | −25 | 24 | 2.1 |
| 1174 | X | 10-3 | 12-1 | 4.5-8 | 182 | −6 | 11 | 1.5 |
| 1175 | X | 10-3 | 12-1 | 4.5-9 | 172 | −20 | 22 | 1.2 |
| 1176 | X | 10-3 | 12-1 | 4.5-10 | 177 | −23 | 5 | 1.2 |
| 1177 | X | 10-3 | 12-1 | 4.5-11 | 184 | −8 | 18 | 2.0 |

TABLE 149

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1178 | X | 10-3 | 12-1 | 4.5-12 | 169 | −10 | 13 | 1.9 |
| 1179 | X | 10-3 | 12-1 | 4.5-13 | 170 | −21 | 8 | 1.5 |
| 1180 | X | 10-3 | 12-1 | 4.5-14 | 179 | −11 | 10 | 1.3 |
| 1181 | X | 10-3 | 12-1 | 4.5-15 | 163 | −20 | 25 | 1.6 |
| 1182 | X | 10-3 | 12-1 | 4.5-16 | 184 | −9 | 20 | 1.8 |
| 1183 | X | 10-3 | 12-1 | 4.5-17 | 170 | −21 | 18 | 1.3 |
| 1184 | X | 10-3 | 12-1 | 4.5-18 | 182 | −6 | 7 | 2.2 |
| 1185 | X | 10-3 | 12-2 | 4.5-2 | 175 | −6 | 10 | 1.6 |
| 1186 | X | 10-3 | — | 4.5-2 | 211 | −10 | 13 | 1.6 |
| 1187 | Ti | 10-3 | 12-1 | 4.5-2 | 205 | −8 | 24 | 1.5 |

TABLE 150

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1188 | X | 10-4 | 12-1 | 4.5-1 | 182 | −13 | 16 | 2.0 |
| 1189 | X | 10-4 | 12-1 | 4.5-2 | 172 | −21 | 12 | 1.8 |
| 1190 | X | 10-4 | 12-1 | 4.5-3 | 166 | −16 | 8 | 1.5 |
| 1191 | X | 10-4 | 12-1 | 4.5-4 | 169 | −6 | 15 | 1.3 |
| 1192 | X | 10-4 | 12-1 | 4.5-5 | 177 | −19 | 20 | 2.2 |
| 1193 | X | 10-4 | 12-1 | 4.5-6 | 161 | −10 | 22 | 1.8 |
| 1194 | X | 10-4 | 12-1 | 4.5-7 | 160 | −16 | 9 | 1.9 |
| 1195 | X | 10-4 | 12-1 | 4.5-8 | 183 | −21 | 23 | 1.5 |
| 1196 | X | 10-4 | 12-1 | 4.5-9 | 166 | −23 | 18 | 1.8 |
| 1197 | X | 10-4 | 12-1 | 4.5-10 | 177 | −17 | 15 | 1.9 |
| 1198 | X | 10-4 | 12-1 | 4.5-11 | 180 | −22 | 5 | 1.3 |

TABLE 151

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1199 | X | 10-4 | 12-1 | 4.5-12 | 162 | −13 | 19 | 1.5 |
| 1200 | X | 10-4 | 12-1 | 4.5-13 | 177 | −8 | 12 | 2.1 |

TABLE 151-continued

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1201 | X | 10-4 | 12-1 | 4.5-14 | 179 | −20 | 17 | 1.4 |
| 1202 | X | 10-4 | 12-1 | 4.5-15 | 185 | −23 | 17 | 2.1 |
| 1203 | X | 10-4 | 12-1 | 4.5-16 | 167 | −7 | 25 | 1.2 |
| 1204 | X | 10-4 | 12-1 | 4.5-17 | 188 | −11 | 19 | 2.2 |
| 1205 | X | 10-4 | 12-1 | 4.5-18 | 180 | −16 | 12 | 1.3 |
| 1206 | X | 10-4 | 12-2 | 4.5-2 | 184 | −12 | 20 | 1.5 |
| 1207 | X | 10-4 | — | 4.5-2 | 203 | −10 | 19 | 1.8 |
| 1208 | Ti | 10-4 | 12-1 | 4.5-2 | 199 | −8 | 12 | 1.6 |
| COMP. EX. 67 | X | C | — | 4.5-1 | 269 | −71 | 33 | 4.7 |
| COMP. EX. 68 | X | 10-1 | — | A | 211 | −69 | 31 | 5.9 |
| COMP. EX. 69 | X | B | — | 14.5-1 | 272 | −91 | 30 | 4.5 |

Examples 1209 to 1313

According to the same manner as that described in Examples 705 to 809 except for using 50 parts by weight of a m-phenylenediamine derivative represented by the formula (11) as the hole transferring material, a single-layer type photosensitive material for digital light source was produced, respectively.

Comparative Example 70

According to the same manner as that described in Examples 1209 to 1313 except for using 50 parts by weight of a carbazole hydrazone derivative represented by the formula (C) as the hole transferring material, a single-layer type photosensitive material for digital light source was produced.

Comparative Example 71

According to the same manner as that described in Examples 1209 to 1313 except for using 100 parts by weight of a bisphenol A type polycarbonate represented by the formula (A) as the binding resin, a single-layer type photosensitive material for digital light source was produced.

Comparative Example 72

According to the same manner as that described in Examples 1209 to 1313 except for using 50 parts by weight of a conventional benzidine derivative represented by the formula (B) as the hole transferring material, a single-layer type photosensitive material for digital light source was produced.

Concrete compounds of the hole transferring material, electron transferring material and binding resin used in the above respective Examples and Comparative Examples are shown in Tables 152 to 161, using the compound numbers of the above-described embodiments.

The single-layer type photosensitive material of the respective Examples and Comparative Examples was subjected to the above respective tests I and its characteristics were evaluated. The results are shown in Tables 152 to 161.

TABLE 152

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1209 | X | 11-1 | 12-1 | 4.5-1 | 185 | −25 | 21 | 2.0 |
| 1210 | X | 11-1 | 12-1 | 4.5-2 | 179 | −5 | 23 | 1.2 |
| 1211 | X | 11-1 | 12-1 | 4.5-3 | 160 | −25 | 5 | 1.2 |
| 1212 | X | 11-1 | 12-1 | 4.5-4 | 180 | −24 | 18 | 2.2 |
| 1213 | X | 11-1 | 12-1 | 4.5-5 | 174 | −19 | 9 | 1.3 |
| 1214 | X | 11-1 | 12-1 | 4.5-6 | 178 | −11 | 11 | 1.8 |
| 1215 | X | 11-1 | 12-1 | 4.5-7 | 183 | −6 | 22 | 1.6 |
| 1216 | X | 11-1 | 12-1 | 4.5-8 | 166 | −10 | 16 | 1.2 |
| 1217 | X | 11-1 | 12-1 | 4.5-9 | 179 | −9 | 15 | 1.7 |
| 1218 | X | 11-1 | 12-1 | 4.5-10 | 168 | −22 | 19 | 2.0 |
| 1219 | X | 11-1 | 12-1 | 4.5-11 | 173 | −12 | 5 | 1.3 |

TABLE 153

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1220 | X | 11-1 | 12-1 | 4.5-12 | 161 | −8 | 12 | 1.8 |
| 1221 | X | 11-1 | 12-1 | 4.5-13 | 162 | −20 | 8 | 2.1 |
| 1222 | X | 11-1 | 12-1 | 4.5-14 | 174 | −17 | 20 | 1.2 |
| 1223 | X | 11-1 | 12-1 | 4.5-15 | 166 | −11 | 13 | 2.0 |

TABLE 153-continued

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1224 | X | 11-1 | 12-1 | 4.5-16 | 177 | −23 | 7 | 2.2 |
| 1225 | X | 11-1 | 12-1 | 4.5-17 | 161 | −22 | 8 | 2.0 |
| 1226 | X | 11-1 | 12-1 | 4.5-18 | 160 | −20 | 5 | 1.7 |
| 1227 | X | 11-1 | 12-2 | 4.5-2 | 178 | −12 | 18 | 2.1 |
| 1228 | X | 11- | — | 4.5-2 | 192 | −16 | 15 | 1.7 |
| 1229 | Ti | 11-1 | 12-1 | 4.5-2 | 199 | −18 | 8 | 1.5 |

TABLE 154

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1230 | X | 11-2 | 12-1 | 4.5-1 | 181 | −13 | 11 | 1.8 |
| 1231 | X | 11-2 | 12-1 | 4.5-2 | 174 | −22 | 11 | 1.8 |
| 1232 | X | 11-2 | 12-1 | 4.5-3 | 181 | −20 | 20 | 1.3 |
| 1233 | X | 11-2 | 12-1 | 4.5-4 | 180 | −9 | 19 | 2.2 |
| 1234 | X | 11-2 | 12-1 | 4.5-5 | 163 | −18 | 6 | 1.7 |
| 1235 | X | 11-2 | 12-1 | 4.5-6 | 161 | −12 | 9 | 1.8 |
| 1236 | X | 11-2 | 12-1 | 4.5-7 | 180 | −24 | 19 | 1.5 |
| 1237 | X | 11-2 | 12-1 | 4.5-8 | 179 | −20 | 6 | 1.9 |
| 1238 | X | 11-2 | 12-1 | 4.5-9 | 184 | −18 | 11 | 1.4 |
| 1239 | X | 11-2 | 12-1 | 4.5-10 | 163 | −12 | 15 | 1.6 |
| 1240 | X | 11-2 | 12-1 | 4.5-11 | 170 | −25 | 20 | 1.6 |

TABLE 155

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1241 | X | 11-2 | 12-1 | 4.5-12 | 166 | −24 | 23 | 1.4 |
| 1242 | X | 11-2 | 12-1 | 4.5-13 | 184 | −23 | 21 | 1.3 |
| 1243 | X | 11-2 | 12-1 | 4.5-14 | 177 | −16 | 18 | 1.3 |
| 1244 | X | 11-2 | 12-1 | 4.5-15 | 160 | −10 | 8 | 1.2 |
| 1245 | X | 11-2 | 12-1 | 4.5-16 | 179 | −12 | 11 | 1.5 |
| 1246 | X | 11-2 | 12-1 | 4.5-17 | 183 | −20 | 16 | 2.0 |
| 1247 | X | 11-2 | 12-1 | 4.5-18 | 162 | −22 | 18 | 1.6 |
| 1248 | X | 11-2 | 12-2 | 4.5-2 | 185 | −15 | 16 | 1.6 |
| 1249 | X | 11-2 | — | 4.5-2 | 190 | −11 | 19 | 1.8 |
| 1250 | Ti | 11-2 | 12-1 | 4.5-2 | 197 | −20 | 20 | 1.3 |

TABLE 156

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1251 | X | 11-3 | 12-1 | 4.5-1 | 173 | −17 | 15 | 1.4 |
| 1252 | X | 11-3 | 12-1 | 4.5-2 | 180 | −9 | 5 | 1.2 |
| 1253 | X | 11-3 | 12-1 | 4.5-3 | 165 | −20 | 13 | 2.0 |
| 1254 | X | 11-3 | 12-1 | 4.5-4 | 160 | −5 | 8 | 2.1 |
| 1255 | X | 11-3 | 12-1 | 4.5-5 | 177 | −21 | 11 | 1.4 |
| 1256 | X | 11-3 | 12-1 | 4.5-6 | 168 | −13 | 25 | 2.0 |
| 1257 | X | 11-3 | 12-1 | 4.5-7 | 176 | −11 | 6 | 2.2 |
| 1258 | X | 11-3 | 12-1 | 4.5-8 | 180 | −20 | 10 | 1.6 |
| 1259 | X | 11-3 | 12-1 | 4.5-9 | 185 | −25 | 22 | 1.5 |
| 1260 | X | 11-3 | 12-1 | 4.5-10 | 180 | −16 | 5 | 1.2 |
| 1261 | X | 11-3 | 12-1 | 4.5-11 | 183 | −19 | 19 | 1.8 |

TABLE 157

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1262 | X | 11-3 | 12-1 | 4.5-12 | 164 | −25 | 7 | 2.2 |
| 1263 | X | 11-3 | 12-1 | 4.5-13 | 178 | −6 | 20 | 1.6 |
| 1264 | X | 11-3 | 12-1 | 4.5-14 | 173 | −20 | 12 | 1.3 |
| 1265 | X | 11-3 | 12-1 | 4.5-15 | 161 | −11 | 5 | 1.9 |
| 1266 | X | 11-3 | 12-1 | 4.5-16 | 169 | −22 | 10 | 1.7 |
| 1267 | X | 11-3 | 12-1 | 4.5-17 | 183 | −19 | 9 | 2.0 |
| 1268 | X | 11-3 | 12-1 | 4.5-18 | 179 | −15 | 18 | 2.2 |
| 1269 | X | 11-3 | 12-2 | 4.5-2 | 182 | −18 | 5 | 1.3 |
| 1270 | X | 11-3 | — | 4.5-2 | 199 | −25 | 23 | 2.1 |
| 1271 | Ti | 11-3 | 12-1 | 4.5-2 | 211 | −6 | 16 | 1.6 |

TABLE 158

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1272 | X | 11-4 | 12-1 | 4.5-1 | 165 | −23 | 11 | 1.8 |
| 1273 | X | 11-4 | 12-1 | 4.5-2 | 175 | −13 | 18 | 1.4 |
| 1274 | X | 11-4 | 12-1 | 4.5-3 | 181 | −16 | 7 | 1.3 |
| 1275 | X | 11-4 | 12-1 | 4.5-4 | 170 | −20 | 22 | 1.4 |
| 1276 | X | 11-4 | 12-1 | 4.5-5 | 185 | −18 | 16 | 1.2 |
| 1277 | X | 11-4 | 12-1 | 4.5-6 | 165 | −24 | 13 | 2.0 |
| 1278 | X | 11-4 | 12-1 | 4.5-7 | 174 | −8 | 6 | 2.2 |
| 1279 | X | 11-4 | 12-1 | 4.5-8 | 162 | −25 | 24 | 1.8 |
| 1280 | X | 11-4 | 12-1 | 4.5-9 | 179 | −10 | 9 | 1.5 |
| 1281 | X | 11-4 | 12-1 | 4.5-10 | 166 | −23 | 8 | 2.0 |
| 1282 | X | 11-4 | 12-1 | 4.5-11 | 183 | −16 | 11 | 2.1 |

TABLE 159

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1283 | X | 11-4 | 12-1 | 4.5-12 | 170 | −8 | 23 | 1.9 |
| 1284 | X | 11-4 | 12-1 | 4.5-13 | 184 | −15 | 19 | 1.5 |
| 1285 | X | 11-4 | 12-1 | 4.5-14 | 168 | −11 | 18 | 1.6 |
| 1286 | X | 11-4 | 12-1 | 4.5-15 | 160 | −24 | 20 | 1.3 |
| 1287 | X | 11-4 | 12-1 | 4.5-16 | 178 | −20 | 19 | 1.9 |
| 1288 | X | 11-4 | 12-1 | 4.5-17 | 163 | −10 | 9 | 2.0 |
| 1289 | X | 11-4 | 12-1 | 4.5-18 | 185 | −19 | 24 | 1.5 |
| 1290 | X | 11-4 | 12-2 | 4.5-2 | 182 | −12 | 18 | 1.4 |
| 1291 | X | 11-4 | — | 4.5-2 | 206 | −16 | 23 | 1.8 |
| 1292 | Ti | 11-4 | 12-1 | 4.2-2 | 198 | −24 | 25 | 2.0 |

TABLE 160

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1293 | X | 11-5 | 12-1 | 4.5-1 | 175 | −21 | 11 | 1.8 |
| 1294 | X | 11-5 | 12-1 | 4.5-2 | 162 | −5 | 13 | 1.2 |
| 1295 | X | 11-5 | 12-1 | 4.5-3 | 166 | −23 | 8 | 2.0 |
| 1296 | X | 11-5 | 12-1 | 4.5-4 | 177 | −21 | 5 | 2.1 |
| 1297 | X | 11-5 | 12-1 | 4.5-5 | 181 | −16 | 20 | 1.3 |
| 1298 | X | 11-5 | 12-1 | 4.5-6 | 183 | −17 | 18 | 1.9 |
| 1299 | X | 11-5 | 12-1 | 4.5-7 | 160 | −20 | 12 | 1.2 |
| 1300 | X | 11-5 | 12-1 | 4.5-8 | 177 | −10 | 7 | 1.7 |
| 1301 | X | 11-5 | 12-1 | 4.5-9 | 168 | −24 | 10 | 1.5 |
| 1302 | X | 11-5 | 12-1 | 4.5-10 | 185 | −11 | 23 | 1.9 |
| 1303 | X | 11-5 | 12-1 | 4.5-11 | 18o | −7 | 15 | 1.7 |

TABLE 161

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1304 | X | 11-5 | 12-1 | 4.5-12 | 179 | −9 | 25 | 2.0 |
| 1305 | X | 11-5 | 12-1 | 4.5-13 | 173 | −19 | 8 | 2.0 |
| 1306 | X | 11-5 | 12-1 | 4.5-14 | 182 | −8 | 10 | 1.5 |
| 1307 | X | 11-5 | 12-1 | 4.5-15 | 162 | −15 | 9 | 2.2 |
| 1308 | X | 11-5 | 12-1 | 4.5-16 | 161 | −21 | 23 | 1.8 |
| 1309 | X | 11-5 | 12-1 | 4.5-17 | 167 | −13 | 13 | 1.3 |
| 1310 | X | 11-5 | 12-1 | 4.5-18 | 173 | −18 | 18 | 2.1 |
| 1311 | X | 11-5 | 12-2 | 4.5-2 | 183 | −24 | 22 | 2.0 |
| 1312 | X | 11-5 | — | 4.5-2 | 200 | −9 | 25 | 1.6 |
| 1313 | Ti | 11-5 | 12-1 | 4.5-2 | 205 | −18 | 19 | 1.5 |
| COMP. EX. 70 | X | C | — | 4.5-1 | 284 | −59 | 32 | 4.2 |
| COMP. EX. 71 | X | 11-1 | — | A | 225 | −68 | 31 | 4.9 |
| COMP. EX. 72 | X | B | — | 4.5-1 | 272 | −94 | 39 | 4.0 |

(Single-layer type photosensitive material for analog light source)

Examples 1314 to 1342

According to the same manner as that described in Examples 705 to 1313 except for using 5 parts by weight of a bisazo pigment represented by the formula (13) as the electric charge generating material, a single-layer type photosensitive material for analog light source was produced, respectively.

Concrete compounds of the hole transferring material, electron transferring material and binding resin used in the above respective Examples are shown in Tables 162 to 167, using the compound numbers of the above-described embodiments.

The single-layer type photosensitive material of the respective Examples was subjected to the above respective tests II and its characteristics were evaluated. The results are shown in Tables 162 to 167.

TABLE 162

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1314 | 13 | 6-1 | 12-1 | 4.5-2 | 204 | −18 | 21 | 3.3 |
| 1315 | 13 | 6-2 | 12-1 | 4.5-2 | 202 | −11 | 17 | 3.2 |
| 1316 | 13 | 6-3 | 12-1 | 4,5-2 | 202 | −11 | 13 | 3.6 |
| 1317 | 13 | 6-4 | 12-1 | 4.5-2 | 204 | −20 | 8 | 3.0 |
| 1318 | 13 | 6-5 | 12-1 | 4.5-2 | 210 | −13 | 11 | 3.1 |

TABLE 163

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1319 | 13 | 7-1 | 12-1 | 4.5-2 | 204 | −23 | 22 | 2.8 |
| 1320 | 13 | 7-2 | 12-1 | 4.5-2 | 210 | −11 | 17 | 2.9 |
| 1321 | 13 | 7-1 | 12-1 | 4.5-2 | 211 | −22 | 13 | 2.8 |
| 1322 | 13 | 7-4 | 12-1 | 4.5-2 | 209 | −12 | 25 | 3.5 |
| 1323 | 13 | 7-5 | 12-1 | 4.5-2 | 219 | −20 | 20 | 2.5 |
| 1324 | 13 | 7-6 | 12-1 | 4.5-2 | 220 | −10 | 25 | 2.8 |
| 1335 | 13 | 7-7 | 12-1 | 4.5-2 | 220 | −20 | 6 | 3.2 |

TABLE 164

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1326 | 13 | 8-1 | 12-1 | 4.5-2 | 212 | −11 | 14 | 2.5 |
| 1327 | 13 | 8-2 | 12-1 | 4.5-2 | 220 | −20 | 6 | 3.0 |
| 1328 | 13 | 8-3 | 12-1 | 4.5-2 | 208 | −9 | 20 | 3.2 |
| 1329 | 13 | 8-4 | 12-1 | 4.5-2 | 205 | −21 | 18 | 2.6 |

TABLE 165

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1330 | 13 | 9-1 | 12-1 | 4.5-2 | 220 | −20 | 5 | 2.5 |
| 1331 | 13 | 9-2 | 12-1 | 4.5-2 | 225 | −17 | 12 | 3.2 |
| 1332 | 13 | 9-3 | 12-1 | 4.5-2 | 229 | −9 | 13 | 3.6 |
| 1333 | 13 | 9-4 | 12-1 | 4.5-2 | 224 | −25 | 10 | 2.9 |

TABLE 166

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1334 | 13 | 10-1 | 12-1 | 4.5-2 | 230 | −6 | 23 | 2.1 |
| 1335 | 13 | 10-2 | 12-1 | 4.5-2 | 221 | −16 | 23 | 1.3 |
| 1336 | 13 | 10-3 | 12-1 | 4.5-2 | 229 | −23 | 7 | 2.0 |
| 1337 | 13 | 10-4 | 12-1 | 4.5-2 | 221 | −20 | 5 | 1.2 |

TABLE 167

| EXAMPLE NO. | CGM | HTM | ETM | BINDING RESIN | $V_L$ (V) | $\Delta V_0$ (V) | $\Delta V_L$ (V) | AMOUNT OF WEAR (μm) |
|---|---|---|---|---|---|---|---|---|
| 1338 | 13 | 11- | 12-1 | 4.5-2 | 211 | −10 | 12 | 1.3 |
| 1339 | 13 | 11-2 | 12-1 | 4.5-2 | 205 | −8 | 21 | 1.7 |
| 1340 | 13 | 11-3 | 12-1 | 4.5-2 | 221 | −9 | 8 | 1.9 |
| 1341 | 13 | 11-4 | 12-1 | 4.5-2 | 219 | 13 | 17 | 2.1 |
| 1342 | 13 | 11-5 | 12-1 | 4.5-2 | 211 | 20 | 9 | 1.9 |

(Multi-layer type photosensitive material for digital light source)

Examples 1343 to 1371

According to the same manner as that described in Examples 262 to 290 except for using 100 parts by weight of the bisphenol C-random copolymer type polycarbonate having two sorts of repeating units represented by the formulas (4) and (5) as the binding resin, a multi-layer type photosensitive material for digital light source was produced, respectively.

Concrete compounds of the hole transferring material and binding resin used in the above respective Examples are shown in Tables 168 to 173, using the compound numbers of the above-described embodiments.

The multi-layer type photosensitive materials of the respective Examples were subjected to the above respective tests III and their characteristics were evaluated. The results are shown in Tables 168 to 173.

TABLE 168

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 1343 | 6-1 | 4.5-2 | −99 | −15 | 11 | 3.2 |
| 1344 | 6-2 | 4.5-2 | −101 | −10 | 15 | 3.3 |
| 1345 | 6-3 | 4.5-2 | −96 | −18 | 11 | 3.1 |
| 1346 | 6-4 | 4.5-2 | −100 | −15 | 11 | 3.3 |
| 1347 | 6-5 | 4.5-2 | −108 | −16 | 13 | 3.0 |

TABLE 169

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 1348 | 7-1 | 4.5-2 | −96 | −20 | 10 | 2.6 |
| 1349 | 7-2 | 4.5-2 | −99 | −11 | 11 | 2.8 |
| 1350 | 7-3 | 4.5-2 | −104 | −21 | 15 | 2.5 |
| 1351 | 7-4 | 4.5-2 | −92 | −24 | 24 | 2.9 |
| 1352 | 7-5 | 4.5-2 | −108 | −19 | 13 | 2.8 |
| 1353 | 7-6 | 4.5-2 | −105 | −21 | 24 | 3.1 |
| 1354 | 7-7 | 4.5-2 | −100 | −13 | 6 | 3.5 |

TABLE 170

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 1355 | 8-1 | 4.5-2 | −109 | −18 | 7 | 3.0 |
| 1356 | 8-2 | 4.5-2 | −94 | −25 | 10 | 2.4 |
| 1357 | 8-3 | 4.5-2 | −94 | −16 | 14 | 2.6 |
| 1358 | 8-4 | 4.5-2 | −94 | −21 | 11 | 2.4 |

TABLE 171

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 1359 | 9-1 | 4.5-2 | −105 | −20 | 9 | 3.0 |
| 1360 | 9-2 | 4.5-2 | −99 | −19 | 18 | 3.0 |

TABLE 171-continued

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 1361 | 9-3 | 4.5-2 | −111 | −14 | 17 | 2.4 |
| 1362 | 9-4 | 4.5-2 | −106 | −18 | 24 | 3.1 |

TABLE 172

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 1363 | 10-1 | 4.5-2 | −110 | −5 | 25 | 1.7 |
| 1364 | 10-2 | 4.5-2 | −105 | −16 | 9 | 1.8 |
| 1365 | 10-3 | 4.5-2 | −99 | −8 | 22 | 2.0 |
| 1366 | 10-4 | 4.5-2 | −102 | −18 | 21 | 2.0 |

TABLE 173

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 1367 | 11-1 | 4.5-2 | −93 | −20 | 10 | 1.6 |
| 1368 | 11-2 | 4.5-2 | −96 | −25 | 5 | 2.0 |
| 1369 | 11-3 | 4.5-2 | −114 | −17 | 21 | 2.1 |
| 1370 | 11-4 | 4.5-2 | −111 | −10 | 8 | 1.4 |
| 1371 | 11-5 | 4.5-2 | −106 | −23 | 21 | 1.4 |

(Multi-layer type photosensitive material for analog light source)

Examples 1372 to 1400

According to the same manner as that described in Examples 1343 to 1371 except for using 2 parts by weight of a bisazo pigment represented by the formula (13) as the electric charge generating material, a multi-layer type photosensitive material for analog light source was produced, respectively.

Concrete compounds of the hole transferring material and binding resin used in the above respective Examples are shown in Tables 174 to 179, using the compound numbers of the above-described embodiments.

The multi-layer type photosensitive material of the respective Examples was subjected to the above respective tests IV and its characteristics were evaluated. The results are shown in Tables 174 to 179.

TABLE 174

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 1372 | 6-1 | 4.5-2 | −140 | −13 | 15 | 3.4 |
| 1373 | 6-2 | 4.5-2 | −138 | −9 | 13 | 3.5 |
| 1374 | 6-3 | 4.5-2 | −132 | −17 | 14 | 2.9 |
| 1375 | 6-4 | 4.5-2 | −138 | −16 | 10 | 3.4 |
| 1376 | 6-5 | 4.5-2 | −144 | −19 | 12 | 3.4 |

TABLE 175

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 1377 | 7-1 | 4.5-2 | −132 | −19 | 20 | 2.8 |
| 1378 | 7-2 | 4.5-2 | −136 | −13 | 18 | 2.9 |
| 1379 | 7-3 | 4.5-2 | −142 | −20 | 21 | 2.8 |
| 1380 | 7-4 | 4.5-2 | −139 | −8 | 8 | 2.8 |
| 1381 | 7-5 | 4.5-2 | −142 | −13 | 15 | 2.5 |
| 1382 | 7-6 | 4.5-2 | −144 | −20 | 8 | 3.0 |
| 1383 | 7-7 | 4.5-2 | −143 | −9 | 20 | 3.0 |

TABLE 176

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 1384 | 8-1 | 4.5-2 | −136 | −25 | 15 | 2.8 |
| 1385 | 8-2 | 4.5-2 | −138 | −23 | 20 | 2.5 |
| 1386 | 8-3 | 4.5-2 | −136 | −21 | 9 | 3.1 |
| 1387 | 8-4 | 4.5-2 | −139 | −7 | 16 | 3.4 |

TABLE 177

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 1388 | 9-1 | 4.5-2 | −136 | −22 | 12 | 2.9 |
| 1389 | 9-2 | 4.5-2 | −142 | −10 | 10 | 3.6 |
| 1390 | 9-3 | 4.5-2 | −148 | −22 | 20 | 3.3 |
| 1391 | 9-4 | 4.5-2 | −144 | −19 | 20 | 3.0 |

TABLE 178

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 1392 | 10-1 | 4.5-2 | −144 | −18 | 8 | 1.5 |
| 1393 | 10-2 | 4.5-2 | −142 | −8 | 20 | 1.9 |
| 1394 | 10-3 | 4.5-2 | −130 | −20 | 10 | 1.4 |
| 1395 | 10-4 | 4.5-2 | −134 | −6 | 25 | 2.1 |

TABLE 179

| EXAMPLE NO. | HTM | BINDING RESIN | $V_L$ (V) | $\Delta V_0$ (V) | $\Delta V_L$ (V) | AMOUNT OF WEAR (μm) |
|---|---|---|---|---|---|---|
| 1396 | 11-1 | 4.5-2 | −135 | −16 | 15 | 2.0 |
| 1397 | 11-2 | 4.5-2 | −139 | −19 | 23 | 2.2 |
| 1398 | 11-3 | 4.5-2 | −149 | −10 | 20 | 1.3 |
| 1399 | 11-4 | 4.5-2 | −144 | −22 | 20 | 1.2 |
| 1400 | 11-5 | 4.5-2 | −142 | −11 | 23 | 2.2 |

As described above, the electrophotosensitive material of the present invention is superior in mechanical strength and repeat characteristics and has a high glass transition temperature and a high sensitivity.

What is claimed is:

1. A single layer photosensitive material comprising a conductive substrate and an organic photosensitive layer provided on the conductive substrate, the organic photosensitive layer comprising a binding resin, an electron transferring material, an electric charge generating material and a hole transferring material, wherein the binding resin comprises at least one member selected from the group consisting of a polycarbonate of a repeating unit represented by the formula (1):

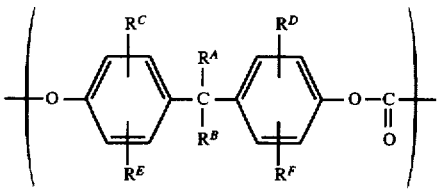

(1)

wherein $R^A$ and $R^B$ are the same or different and indicate a hydrogen atom or an alkyl group having 1 to 3 carbon atoms; $R^C$ and $R^D$ are the same or different and indicate an alkyl group having 1 to 3 carbon atoms; and $R^E$ and $R^F$ are the same or different and indicate a hydrogen atom, an alkyl group having 1 to 3 carbon atoms, or a halogen atom, a polycarbonate of a repeating unit represented by the formula (2):

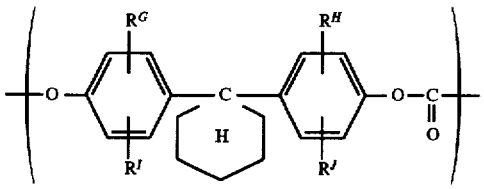

(2)

wherein $R^G$ and $R^H$ are the same or different and indicate an alkyl group having 1 to 3 carbon atoms; and $R^I$ and $R^J$ are the same or different and indicate a hydrogen atom, an alkyl group having 1 to 3 carbon atoms, or a halogen atom, a polycarbonate of a repeating unit represented by the formula (3):

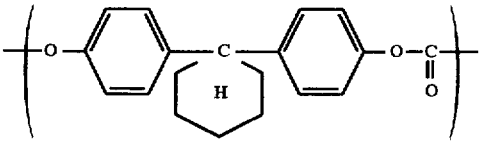

(3)

and a polycarbonate as a random copolymer or a block copolymer of a repeating unit represented by the formula (4):

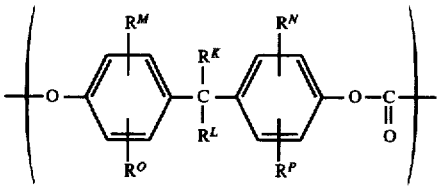

(4)

wherein $R^K$ and $R^L$ are the same or different and indicate a hydrogen atom or an alkyl group having 1 to 3 carbon atoms, and $R^K$ and $R^L$ may bond each other to form a ring; $R^M$ and $R^N$ are the same or different and indicate an alkyl group having 1 to 3 carbon atoms; and $R^O$ and $R^P$ are the same or different and indicate a hydrogen atom, an alkyl group having 1 to 3 carbon atoms, or a halogen atom and formula (5):

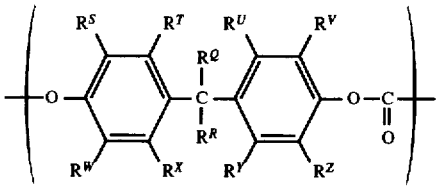

(5)

wherein $R^Q$ and $R^R$ are the same or different and indicate a hydrogen atom, an alkyl group having 1 to 3 carbon atoms or an aryl group which may have a substituent, and $R^Q$ and $R^R$ may bond each other to form a ring; and $R^S$, $R^T$, $R^U$, $R^V$, $R^W$, $R^X$, $R^Y$ and $R^Z$ are the same or different and indicate a hydrogen atom, an alkyl group having 1 to 3 carbon atoms, or a halogen atom, the electron transferring material is selected from the group consisting of the diphenoquinone derivative represented by the formula (6):

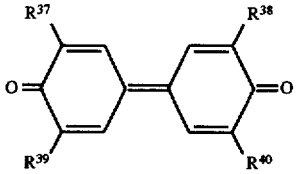

(6)

wherein $R^{37}$, $R^{38}$, $R^{39}$ and $R^{40}$ are the same or different and indicate a hydrogen atom, an alkyl group, an alkoxy group, an aryl group or an aralkyl group, the hole transferring material is at least one member selected from the group consisting of a benzidine derivative represented by the formula (7):

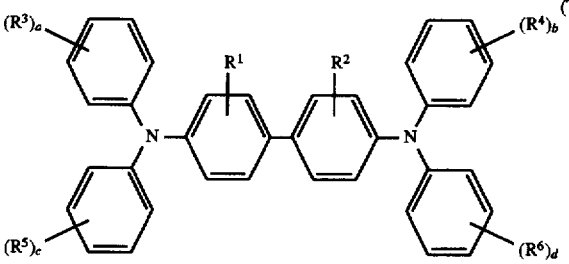

(7)

wherein $R^1$ and $R^2$ are the same or different and indicate a hydrogen atom or an alkyl group; $R^3$, $R^4$, $R^5$ and $R^6$ are the same or different and indicate an alkyl group, an alkoxy group or a halogen atom; and a, b, c and d are the same or different and indicate an integer of 0 to 5; provided that at least one of a, b, c and d indicates an integer of 2 or more, and c and d indicate an integer other than 0 when a and b indicate 0, simultaneously, a benzidine derivative represented by the formula (8):

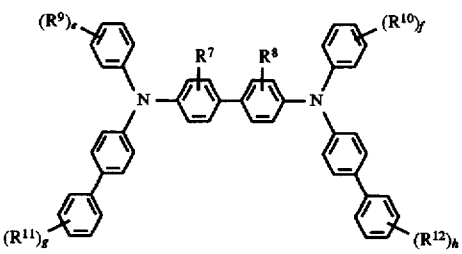

(8)

wherein $R^7$ and $R^8$ are the same or different and indicate a hydrogen atom or an alkyl group; $R^9$ and $R^{10}$ are the same or different and indicate an alkyl group, an alkoxy group, an aryl group which may contain a substituent, or a halogen atom; $R^{11}$ and $R^{12}$ are the same or different and indicate an alkyl group, an alkoxy group or a halogen atom; and e, f, g and h are the same or different and indicate an integer of 0 to 5, a benzidine derivative represented by the formula (9):

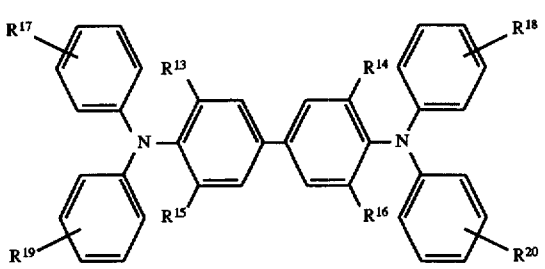

(9)

wherein $R^{13}$, $R^{14}$, $R^{15}$ and $R^{16}$ are the same or different and indicate an alkyl group; and $R^{17}$, $R^{18}$, $R^{19}$ and $R^{20}$ are the same or different and indicate a hydrogen atom, an alkyl group, an alkoxy group, an aryl group which may contain a substituent, or a halogen atom, a benzidine derivative represented by the formula (10):

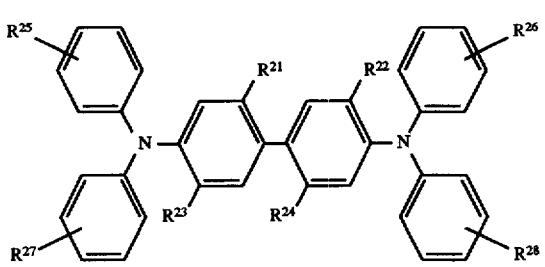

(10)

wherein $R^{21}$ $R^{22}$ $R^{23}$ and $R^{24}$ are the same or different and indicate an alkyl group, and $R^{25}$, $R^{26}$, $R^{27}$ and $R^{28}$ are the same or different and indicate a hydrogen atom, an alkyl group, an alkoxy group, an aryl group which may contain a substituent, or a halogen atom, an o-phenylenediamine derivative represented by the formula (11):

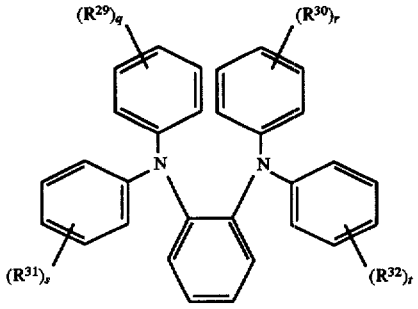

(11)

wherein $R^{29}$, $R^{30}$, $R^{31}$ and $R^{32}$ are the same or different and indicate an alkyl group, an alkoxy group, an aryl group which may contain a substituent, or a halogen atom; and q, r, s and t are the same or different and indicate an integer of 1 to 2, and a m-phenylenediamine derivative represented by the formula (12):

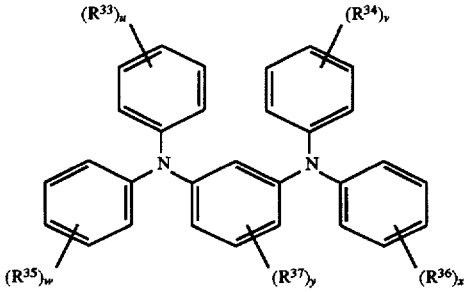

(12)

wherein $R^{33}$, $R^{34}$, $R^{35}$ and $R^{36}$ are the same or different and indicate an alkyl group, an alkoxy group, an aryl group which may contain a substituent, a halogen atom, an amino group or a N-substituted amino group; and u, v, w and x are the same or different and indicate an integer of 0 to 5.

2. An electrophotosensitive material according to claim 1, wherein the binding resin is a polycarbonate of a repeating unit represented by the formula (1) defined in claim 1.

3. An electrophotosensitive material according to claim 1, wherein the binding resin is a polycarbonate of a repeating unit represented by the formula (2) defined in claim 1.

4. An electrophotosensitive material according to claim 1, wherein the binding resin is a polycarbonate of a repeating unit represented by the formula (3) defined in claim 1.

5. An electrophotosensitive material according to claim 1, wherein the binding resin is a polycarbonate as a random copolymer or a block copolymer of a repeating unit represented by the formula (4) and formula (5) defined in claim 1.

6. The electrophotosensitive material according to claim 1, which contains a diphenoquinone derivative as the electron transferring material.

7. The electrophotosensitive material according to claim 1, wherein the electric charge generating material is a phthalocyanine pigment.

8. The electrophotosensitive material according to claim 1, wherein the electric charge generating material is a bisazo pigment.

9. A single layer photosensitive material comprising; a binding resin, an electron transferring material, an electric charge generating material and a hole transferring material, wherein the binding resin comprises at least one member selected from the group consisting of a polycarbonate of a repeating unit represented by the formula (1):

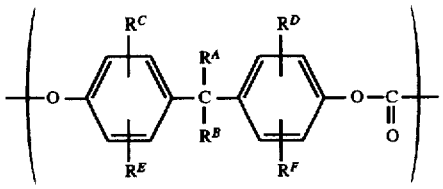

(1)

wherein $R^A$ and $R^B$ are the same or different and indicate a hydrogen atom or an alkyl group having 1 to 3 carbon atoms; $R^C$ and $R^D$ are the same or different and indicate an alkyl group having 1 to 3 carbon atoms; and $R^E$ and $R^F$ are the same or different and indicate a hydrogen atom, an alkyl group having 1 to 3 carbon atoms, or a halogen atom, a polycarbonate of a repeating unit represented by the formula (2):

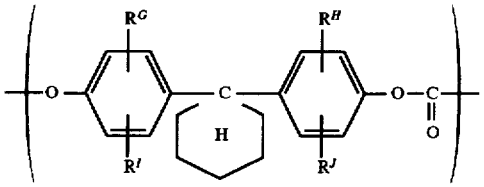

(2)

wherein $R^G$ and $R^H$ are the same or different and indicate an alkyl group having 1 to 3 carbon atoms; and $R^I$ and $R^J$ are the same or different and indicate a hydrogen atom, an alkyl group having 1 to 3 carbon atoms, or a halogen atom, a polycarbonate of a repeating unit represented by the formula (3):

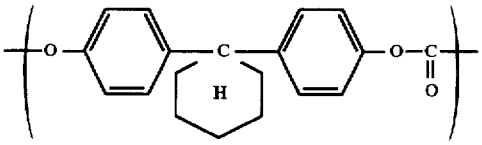

(3)

and a polycarbonate as a random copolymer or a block copolymer of a repeating unit represented by the formula (4):

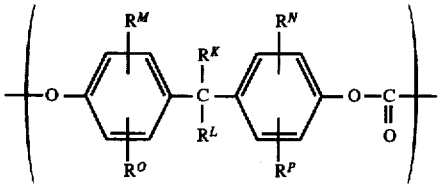

(4)

wherein $R^K$ and $R^L$ are the same or different and indicate a hydrogen atom or an alkyl group having 1 to 3 carbon atoms, and $R^K$ and $R^L$ may bond each other to form a ring; $R^M$ and $R^N$ are the same or different and indicate an alkyl group having 1 to 3 carbon atoms; and $R^O$ and $R^P$ are the same or different and indicate a hydrogen atom, an alkyl group having 1 to 3 carbon atoms, or a halogen atom and formula (5):

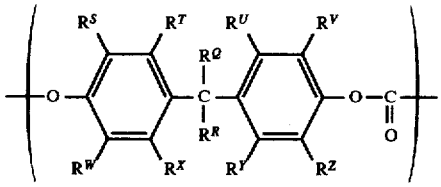

(5)

wherein $R^Q$ and $R^R$ are the same or different and indicate a hydrogen atom, an alkyl group having 1 to 3 carbon atoms or an aryl group which may have a substituent, and $R^Q$ and $R^R$ may bond each other to form a ring; and $R^S$, $R^T$, $R^U$, $R^V$, $R^W$, $R^X$, $R^Y$ and $R^Z$ are the same or different and indicate a hydrogen atom, an alkyl group having 1 to 3 carbon atoms, or a halogen atom, the electron transferring material is selected from the group consisting of the diphenoquinone derivative represented by the formula (6):

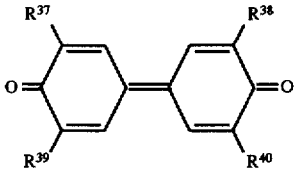

(12)

wherein $R^{37}$, $R^{38}$, $R^{39}$ and $R^{40}$ are the same or different and indicate a hydrogen atom, an alkyl group, an alkoxy group, an aryl group or an aralkyl group, the hole transferring material is at least one member selected from the group consisting of a benzidine derivative represented by the formula (7):

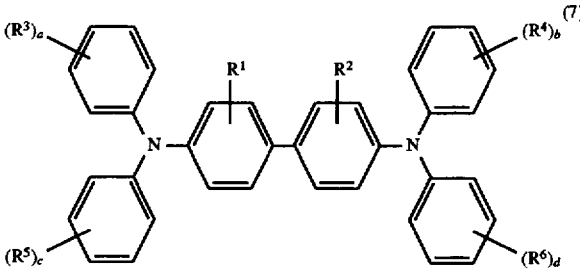

(7)

wherein $R^1$ and $R^2$ are the same or different and indicate a hydrogen atom or an alkyl group; $R^3$, $R^4$, $R^5$ and $R^6$ are the same or different and indicate an alkyl group, an alkoxy group or a halogen atom; and a, b, c and d are the same or different and indicate an integer of 0 to 5; provided that at least one of a, b, c and d indicates an integer of 2 or more, and c and d indicate an integer other than 0 when a and b indicate 0, simultaneously, a benzidine derivative represented by the formula (8):

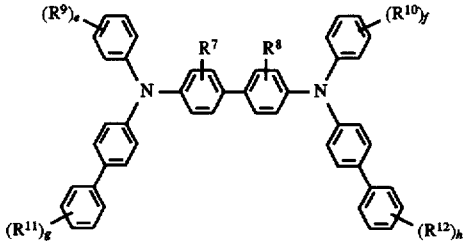

(8)

wherein $R^7$ and $R^8$ are the same or different and indicate a hydrogen atom or an alkyl group; $R^9$ and $R^{10}$ are the same or different and indicate an alkyl group, an alkoxy group, an aryl group which may contain a substituent, or a halogen atom; $R^{11}$ and $R^{12}$ are the same or different and indicate an alkyl group, an alkoxy group or a halogen atom; and e, f, g and h are the same or different and indicate an integer of 0 to 5, a benzidine derivative represented by the formula (9):

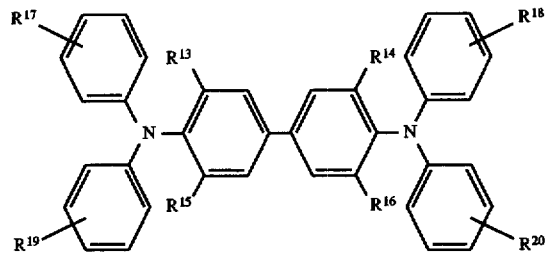

(9)

wherein $R^{13}$, $R^{14}$, $R^{15}$ and $R^{16}$ are the same or different and indicate an alkyl group; and $R^{17}$, $R^{18}$, $R^{19}$ and $R^{20}$ are the same or different and indicate a hydrogen atom, an alkyl group, an alkoxy group, an aryl group which may contain a substituent, or a halogen atom, a benzidine derivative represented by the formula (10):

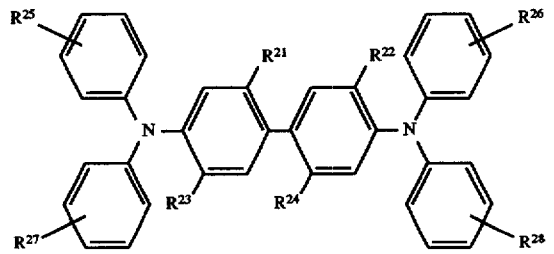

(10)

wherein $R^{21}$ $R^{22}$ $R^{23}$ and $R^{24}$ are the same or different and indicate an alkyl group, and $R^{25}$, $R^{26}$, $R^{27}$ and $R^{28}$ are the same or different and indicate a hydrogen atom, an alkyl group, an alkoxy group, an aryl group which may contain a substituent, or a halogen atom, an o-phenylenediamine derivative represented by the formula (11):

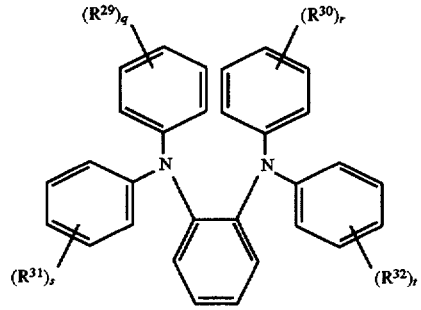

(11)

wherein $R^{29}$, $R^{30}$, $R^{31}$ and $R^{32}$ are the same or different and indicate an alkyl group, an alkoxy group, an aryl group which may contain a substituent, or a halogen atom; and q, r, s and t are the same or different and indicate an integer of 1 to 2, and a m-phenylenediamine derivative represented by the formula (12):

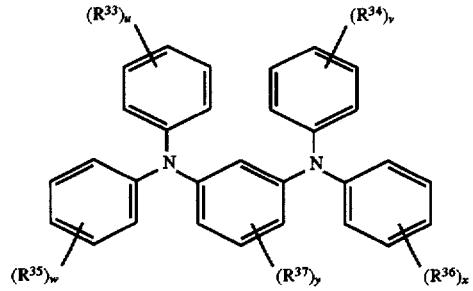

(12)

wherein $R^{33}$, $R^{34}$, $R^{35}$ and $R^{36}$ are the same or different and indicate an alkyl group, an alkoxy group, an aryl group which may contain a substituent, a halogen atom, an amino group or a N-substituted amino group; and u, v, w and x are the same or different and indicate an integer of 0 to 5.

* * * * *

UNITED STATES PATENT AND TRADEMARK OFFICE

CERTIFICATE OF CORRECTION

PATENT NO : 5,629,117

DATED : May 13, 1997

INVENTOR(S): Masato Katsukawa; Masashi Tanaka; Ichiro Yamazato; Yuka Nakamura

It is certified that error appears in the above-identified patent and that said Letters Patent is hereby corrected as shown below:

In claim 1 of the claims:

Column 130, line 18, "formula (6):" should read --formula (12):--.
Column 130, line 20, "(6)" should read --(12)--.
Column 130, line 32, "formula (7):" should read --formula (6):--.
Column 130, line 34, "(7)" should read --(6)--.
Column 130, line 54, "formula (8):" should read --formula (7):--.
Column 130, line 56, "(8)" should read --(7)--.
Column 131, line 7, "formula (9):" should read --formula (8):--.
Column 131, line 9, "(9)" should read --(8)--.
Column 131, line 26, "formula (10):" should read --formula (9):--.
Column 131, line 28, "(10)" should read --(9)--.
Column 131, line 45-46, "formula (11):" should read --formula (10):--.
Column 131, line 48, "(11)" should read --(10)--.
Column 131, line 66, "formula (12):" should read --formula (11):--.
Column 132, line 2, "(12)" should read --(11)--.

UNITED STATES PATENT AND TRADEMARK OFFICE

CERTIFICATE OF CORRECTION

PATENT NO : 5,629,117

DATED : May 13, 1997

INVENTOR(S): Masato Katsukawa; Masashi Tanaka; Ichiro Yamazoto; Yuka Nakamura

It is certified that error appears in the above-identified patent and that said Letters Patent is hereby corrected as shown below:

In claim 9 of the claims:

Column 134, line 2, "formula (6):" should read --formula (12):--.
Column 134, line 16, "formula (7):" should read --formula (6):--.
Column 134, line 18, "(7)" should read --(6)--.
Column 134, line 38, "formula (8):" should read --formula (7):--.
Column 134, line 40, "(8)" should read --(7)--.
Column 134, line 58, "formula (9):" should read --formula (8):--.

UNITED STATES PATENT AND TRADEMARK OFFICE

CERTIFICATE OF CORRECTION

PATENT NO. : 5,629,117

DATED : May 13, 1997

INVENTOR(S) : Masato Katsukawa; Masashi Tanaka, Ichiro Yamazoto, Yuka Nakamura

It is certified that error appears in the above-indentified patent and that said Letters Patent is hereby corrected as shown below:

Column 135, line 1, "(9)" should read --(8)--.
Column 135, line 18, "formula (10):" should read --formula (9):--.
Column 135, line 21, "(10)" should read --(9)--.
Column 135, line 37-38, "formula (11):" should read --formula (10):--.
Column 136, line 1, "(11)" should read --(10)--.
Column 136, line 18, "formula (12):" should read --formula (11):--.
Column 136, line 21, "(12)" should read --(11)--.

Signed and Sealed this

Sixteenth Day of September, 1997

*Attest:*

Bruce Lehman

BRUCE LEHMAN

*Attesting Officer*

*Commissioner of Patents and Trademarks*